US005152661A

United States Patent [19]

Sheets

[11] Patent Number: 5,152,661

[45] **Date of Patent: * Oct. 6, 1992**

[54] METHOD AND APPARATUS FOR PRODUCING FLUID PRESSURE AND CONTROLLING BOUNDARY LAYER

[76] Inventor: Herman E. Sheets, 87 Neptune Dr., Mumford Cove, Groton, Conn. 06340

[ * ] Notice: The portion of the term of this patent subsequent to Aug. 9, 2008 has been disclaimed.

[21] Appl. No.: 513,495

[22] Filed: Apr. 20, 1990

Related U.S. Application Data

[62] Division of Ser. No. 200,113, May 27, 1988, Pat. No. 4,981,414.

[51] Int. Cl.[5] ..... F01D 1/00; F01D 9/00

[52] U.S. Cl. ..... 415/84; 415/206; 415/208.4; 415/209.1

[58] Field of Search ..... 415/203, 206, 208.1, 415/209.1, 181, 208.4, 211.2, 83, 84, 149.2

[56] References Cited

U.S. PATENT DOCUMENTS

| | | | |
|---|---|---|---|
| 2,350,839 | 6/1944 | Szydlowski | 415/149.1 |
| 2,839,239 | 6/1958 | Stalker | 415/181 |
| 3,075,743 | 1/1963 | Sheets | 253/77 |
| 3,173,604 | 3/1965 | Sheets et al. | 230/120 |
| 3,195,807 | 7/1965 | Sheets | 230/134 |
| 3,433,163 | 3/1969 | Sheets et al. | 103/87 |
| 3,588,270 | 6/1971 | Bogles | 415/181 |
| 4,050,849 | 9/1977 | Sheets | 416/171 |
| 4,428,715 | 1/1984 | Wiggins | 415/199.2 |
| 4,824,325 | 4/1989 | Bandiknalla | 415/208.4 |
| 4,877,370 | 10/1989 | Nakagawa et al. | 415/208.4 |

OTHER PUBLICATIONS

Herrig, L. J.; Emery, J. C.; and Ervin, J. P.: "Systematic Two-Dimensional Cascade Tests of NACA 65-Series Compressor Blades at Low Speeds", NACA Technical Note 3916, Feb., 1957.

Bammert, K. and Staude, R.: "Optimization for Rotor Blades of Tandem Design for Axial Flow Compressors, Journal of Engineering for Power", ASME Transactions, Apr. 1979.

Bammert, K. and Staude, R.: "New Features in the Design of Axial-Flow Compressor with Tandem Blades", ASME Paper No. 81-Ct-113, Jun., 1989.

Ace Industries Advertisement, Turbo Machinery Industries (May 1984).

Wu, Cuo Chuan, Zhuang, Biaonan and Guo, Bingheng: "Experimental Investigation of Tandem Blade Cascades with Double-Circular Arc Profiles", ASME Paper No. ICT-94, Sep. 1989.

Erwin, J. R. and Schulze, W. M.: "Investigation of an Impulse Axial-Flow Compressor," NACA RM L9J05a, (Feb. 8, 1950).

Schulze, W. M., Erwin, J. R., and Westphal, W. R.: "Investigation of an Impulse Axial-Flow Compressor Rotor Over a Range of Blade Angles", NACA RM L50F27a, (Aug. 29, 1950).

Sheets, H. E.: "The Slotted Blade Axial Flow Blower; Transactions of the ASME" vol. 78, No. 8, pp. 1683-1690, Nov. 1956.

*Primary Examiner*—Edward K. Look

*Assistant Examiner*—Hoang Nguyen

*Attorney, Agent, or Firm*—Duane Burton

[57] ABSTRACT

This invention relates to a blower of a centrifugal turbomachine type for producing fluid pressure from mechanical energy. The invention relates to the guide vane rows or vaned diffuser used in centrifugal blowers. The vaned diffuser is located downstream by the impeller. The impellers of the centrifugal blowers can have blades which are backwardly curved, radially ending or forwardly curved. Each of these impellers can have a vaned or vaneless diffusing system following the impeller. During operation of the impeller blades at the design point, the average outlet relative velocity is equal to or greater than 0.6 times the inlet relative velocity at the hub of the impeller portion of the impeller blades and the angle of flow deflection within the impeller blades is at least equal to approximately 50° or more. The centrifugal turbomachine also includes a series of guide vane rows, each of said guide vane rows, including at least a forward row of blades and an aft row of blades. The chord of each of the blades in the aft row is greater than the chord of each of the blades in the forward row and each blade in the aft row cooperates with the corresponding blade in the forward row to form, during operation of the centrifugal turbomachine, multiple rows of blades. The pressure coefficient for each centrifugal blower stage is greater than approximately 1.1.

5 Claims, 23 Drawing Sheets

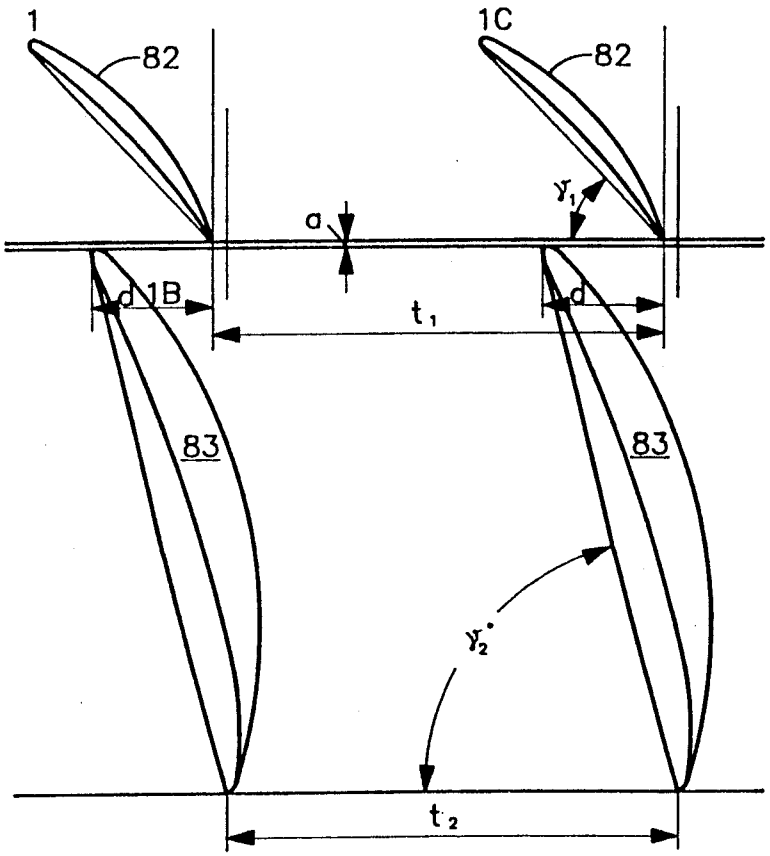
FIG.10
FIG.9A
FIG.9B
FIG.9C
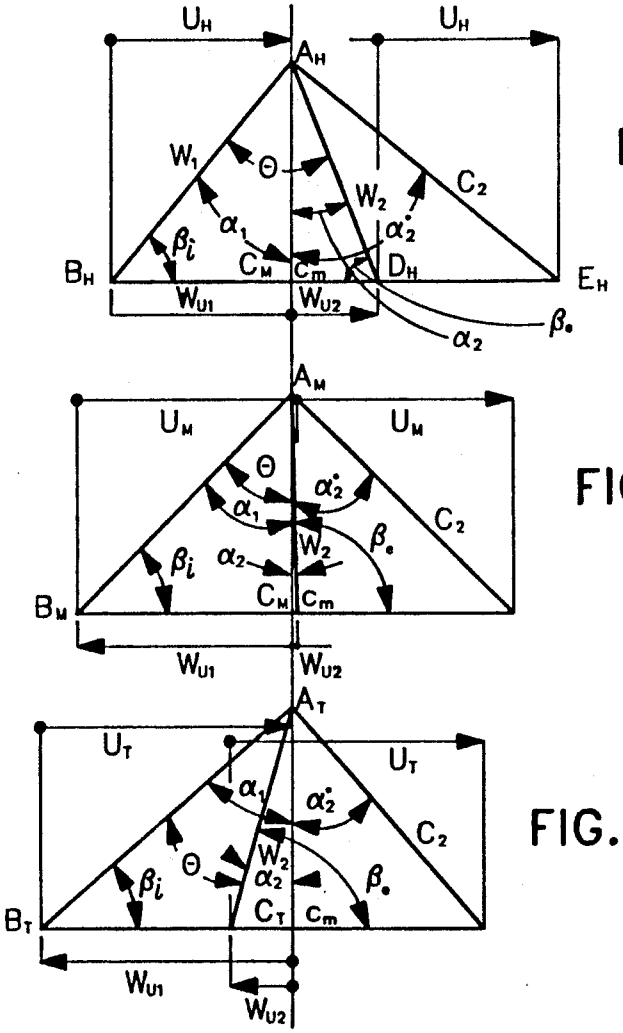

Notation:

k = Velocity in the boundary layer
K = Velocity just outside the boundary layer
s = Distance from surface
$\varepsilon$ = Displacement thickness
$\mu$ = Boundary layer thickness
$\phi$ = Momentum thickness Note: Separation imminent at F=1.8 but may be delayed up to a value of 2.8.

METHOD AND APPARATUS FOR PRODUCING FLUID PRESSURE AND CONTROLLING BOUNDARY LAYER

This is a division of application Ser. No. 07/200,113 filed May 27, 1988 now U.S. Pat. No. 4,981,414.

TECHNICAL FIELD

This invention relates to a method and apparatus for producing fluid pressure. The apparatus is of the turbomachine type including blowers, compressors, pumps, turbines, fluid motors and the like. More particularly, it involves the use of specially designed impeller blades to deflect the flow of fluid while simultaneously maintaining the average outlet relative velocity equal to or greater than approximately 0.6 times the inlet relative velocity at the hub and tip of the impeller blade followed by generating substantial pressure in guide vanes by turning back the flow of fluid by an amount approximately equal to the amount of deflection of the fluid through the impeller blades while simultaneously decelerating the flow of fluid by maintaining the ratio of the axial through flow velocity through the fluid flow path to the outlet velocity equal to approximately 0.66 or less. It also relates to a method and apparatus for producing pressurized fluid at reduced noise levels. It also relates to a method and apparatus for controlling the thickness of boundary layers formed along fluid flow paths. This invention also relates to the use of appropriately selected guide vanes to increase the length of the flow path between said guide vanes. This invention also relates to the selection of blade solidity based upon the maximum deceleration required as fluid flows through said guide vanes.

BACKGROUND ART

Tandem or multiple row blades are discussed in papers by Bammert, K and Staude, R., "New Features in the Design of Axial-Flow Compressors with Tandem Blades", ASME Paper No. 81-GT-113, and Wu Guochuan, Zhuang Biaonan and Guo Bingheng, "Experimental Investigation of Tandem Blade Cascades with Double Circular Arc Profiles", ASME Paper No. 85-IGT-94. These papers recite the history as well as the recent research on this subject. Heretofore, turbomachines of the pressure generating type were constructed to generate a substantial pressure within the rotating impeller blades, e.g., all centrifugal blowers and most axial flow machines. Prior art turbomachines developed at least approximately 50% of the pressure generated in the "rotor" or impeller blades and the remaining amount of pressure in the guide vanes. Prior art turbomachines did not use impeller blades to deflect the fluid flow essentially without generating pressure therein while simultaneously generating all or substantially all of the pressure in the guide vanes. Conventional axial flow blowers generate substantial pressure within the rotating impeller blades; the degree of reaction in the rotating impeller blades is high with values up to 85%. The high pressure generated in the rotating blades produces flow leakage losses between the tips of the blades and the adjacent housing because the rotating blades must have a gap with a stationary structure in order to rotate. This leakage imposed performance and efficiency limitations on the apparatus.

Slotted turbomachine blades are known per se. My U.S. Pat. Nos. 3,075,734 and 3,195,807 relate to turboengine blades in which each blade contains a single slot of defined dimensions with a limited amount of fluid flowing through the slot. Thus, these two patents disclose two separate parts of a single blade, located in close relationship to each other, with the objective being to extend the laminar flow region of the combined blade further downstream than theretofore had been possible. Moreover, the slot formed between the two (separate) blade sections was located in the aft part of the combined blades; i.e., approximately sixty percent of the chord of the combined blade downstream from the leading edge of the combined blade. Prior art devices did not use slotted blades to provide a flow path of extended length in which the fluid is supported between adjacent blades thereby increasing the amount of flow deceleration. Prior art devices did not use separate rows of blades in which the gap between rows was located in the forward part of the combined blade.

Prior axial flow fans and centrifugal fans operated within certain specific speed $\eta_s$ ranges. Prior art axial flow fans and centrifugal fans could not be operated within reduced specific speed ranges in which the turbomachine of this invention can be operated.

Prior art impeller blades which generated substantial pressure as fluid flowed therethrough could not be used to deflect the fluid by more than approximately 49° because stalling occurred where any larger amount of deflection was attempted due to the inability of the blades to discharge fluid therefrom.

Maximum pressure coefficients at the point of maximum efficiency for prior art axial flow blowers have been on the order of 0.8; pressure coefficients for prior art radial blowers have been approximately 1.1 with maximum values up to 1.4. Prior art axial flow blowers did not operate at a pressure coefficient of 1.0 and certainly not as large as 1.4 to 3.6 and more. Prior art centrifugal fans did not operate at a pressure coefficient of 3.0 or more.

Vector flow diagrams of prior art axial flow impeller blades show that the circumferential components of the relative velocities $w_{u1}$ and $w_{u2}$ are in the same direction and are opposed to the direction of the circumferential impeller velocity direction (u). Vector flow diagrams of prior art impeller blades did not show the flow vector of the circumferential component of relative velocity ($w_{u2}$) of said impeller blades at the outlet to be in the same direction as the circumferential velocity (u).

Prior art diffusers provided a flow path of substantial length with converging and/or diverging flow directing surfaces to assist in the recovery of static pressure from dynamic pressure. Prior art diffusers conventionally are of considerable length requiring extra cost to manufacture and additional space to house the diffuser. Prior art diffusers did not include means for removing a portion of the boundary layer from the surfaces thereof and returning same to the fluid flow path at a point upstream of the place where same had been removed. Prior art diffusers did not include means to remove a portion of the boundary layer and use said removed boundary layer to cool the motor of the pump or blower before it was returned to the fluid flow path.

Previously, a complex analysis of axial flow blower blades was involved to determine the limits of flow deflection and deceleration as functions of entrance angle, solidity and blade profile configuration. Maximum flow deflection of the numerous blades has been published in NACA Technical Note 3916, "Systematic 2-Dimensional Cascade Test of NACA 65-Series Compressor Blades at Low Speeds" by L. Joseph Herrig, James C. Emery and John A. Erwin, February, 1957. It was unknown in the prior art that multiple row blades with different numbers of blades in each row and optimum blade solidity can achieve higher flow deflection angles than conventional blades.

DISCLOSURE OF INVENTION

In a blower or pump or the like of the turbomachine type and having a hub member, a plurality of impeller blades mounted on the hub member for rotation, each of said blades having a hub portion, a tip portion, a rounded leading edge and relatively sharp trailing edge, said blades having a combination of camber and blade solidity wherein, during operation of said blades at the design point, the outlet relative velocity is equal to or greater than approximately 0.6 times the inlet relative velocity at the hub of the impeller, the ratio of the outlet relative velocity to the inlet relative velocity at the hub is greater than at the tip, and the angle of flow deflection within the impeller blades is equal to approximately 49° or more; a plurality of stationary guide vanes located downstream from said impeller blades and through which flows the entire flow discharged by the impeller blades, each of said guide vanes including a forward row and an aft row of blades, the chord of each of the blades in the aft row being greater than the chord of each of the blades in the forward row, said blades in the aft row cooperating with said blades in the forward row, to form during operation of the blower or pump, multiple rows of blades, and each of said guide vanes having a combination of camber and blade solidity wherein the direction of discharge from said impeller blades is turned by said guide vanes back to the direction of entry of said flow into said impeller blades while the absolute flow through said stationary guide vanes undergoes a substantial flow deceleration wherein the ratio of the axial through flow velocity to absolute impeller blade exit velocity from the impeller blades equals approximately 0.66 or less at the hub location; and the pressure coefficient for the blower or pump is equal to at least 1.0 or more.

In a blower or pump as aforedescribed in which said impeller blades have a combination of camber and blade solidity wherein, during operation of said impeller blades at the design point, the circumferential component of the relative inlet velocity is in a direction opposed to the direction of the circumferential impeller velocity, and the circumferential component of the relative outlet velocity is in the same direction as the circumferential impeller velocity at least at one location between the hub and the tip, and the absolute blade exit flow velocity at the impeller outlet is greater than both the blade inlet relative velocity and the blade exit relative velocity at least at one location between the hub and the tip, and the relative flow velocity within the impeller blades is turned in the direction of the circumferential impeller velocity from blade inlet to blade exit at any location between the hub and the tip; and the guide vane flow deflection angle is greater than 49° at the hub, and the cosine of the guide vane flow direction angle is equal to the ratio of the through flow velocity divided by the outlet velocity from the impeller blades.

In a blower or pump as aforedescribed in which the absolute value of the angle between the impeller inlet velocity and the axial through flow velocity is approximately equal to the absolute value of the angle between the impeller outlet velocity and the axial through flow velocity at one location between the hub and the tip.

In a blower or pump as aforedescribed in which the average value of relative velocity through the impeller blades between the hub and tip is maintained substantially constant.

In a blower or pump as aforedescribed in which the absolute value of the relative velocity through the impeller blades is maintained substantially constant only at one location of the impeller blades between the hub and tip.

In a blower or pump as aforedescribed in which the absolute value of the relative velocity through the impeller blades is maintained substantially constant only at one location of the impeller blades and at some other locations the values of the relative exit flow velocity are larger than the value of the relative inlet velocity.

In a blower or pump as aforedescribed in which the pressure generated by the pump or blower is constant and the axial through flow velocity is constant from the hub to the tip at the design point of the blower or pump.

In a blower or pump as aforedescribed in which the flow area for the relative flow at the hub of the impeller blades from the inlet to the outlet is substantially constant, and the flow area at the inlet of the impeller blade is smaller than the flow area at the outlet of the impeller blade both at the mean and the tip diameter whereby the relative flow velocity through the impeller blades at the mean and the tip decelerates as the flow passes from the inlet to the outlet.

In a blower or pump as aforedescribed including means to reduce high inlet velocities at the inlet of the impeller blades, said means including a hub member having an inlet diameter smaller than the outlet diameter whereby the axial flow area decreases from the inlet to the exit and the absolute through flow velocity increases from the inlet to the exit of said impeller blades.

In a blower or pump as aforedescribed in which the pressure coefficient for the combined impeller blades and guide vanes is equal to at least approximately 1.4 or more.

In a blower or pump as aforedescribed in which said guide vanes include a plurality of part or half blades each of which is disposed intermediate the adjacent aft blades to form two flow channels between said adjacent aft blades wherein each flow channel row has approximately equal amounts of flow and approximately equal rates of flow diffusion therethrough.

In a blower or pump as aforedescribed in which each part blade has the trailing edge located on the same line as the trailing edge of said aft blades, each part blade has a chord equal to approximately one-half the chord of the aft blades and each blade row has a solidity equal to approximately $1.1 \pm 0.6$.

In a blower or pump as aforedescribed in which said blower or pump includes stationary inlet guide vanes located upstream of said impeller blades, and each of the inlet guide vanes has a combination of camber and blade solidity wherein during operation of said blower or pump the circumferential component of the flow at the exit of said inlet guide vanes is turned in a direction opposite to the direction of the circumferential impeller velocity.

In a blower or pump as aforedescribed in which each of the blades in the forward row of said stationary outlet guide vanes has a blade solidity equal to approximately $1.3 \pm 0.6$, and each of the blades in the aft row of said guide vanes has a blade solidity equal to approximately $1.1 \pm 0.6$.

In a blower or pump as aforedescribed in which said guide vanes have two rows of blades wherein the number of blades in the forward row and the number of blades in the aft row are essentially the same, and the blades in the aft row cooperate with the blades in the forward row to form, during operation of the blower or pump, multiple rows of blades, the axial distance between the trailing edge of the forward blades and the leading edge of the aft blades is equal to or less than the absolute value of approximately 0.12 times the chord of the aft blades of the multiple rows of blades for each pair of blade rows, and the circumferential distance between the leading edge of each aft blade and the trailing edge of the forward blade nearest the upper surface of said aft blade is equal to or less than 0.33 times the pitch of the aft blades for each pair of blade rows.

In a blower or pump as aforedescribed in which the ratio of the outlet guide vane exit fluid velocity to the outlet guide vane inlet fluid velocity is equal to approximately 0.28 or more.

In a blower or pump as aforedescribed in which the deceleration of fluid flow in the forward row of blades is greater than the deceleration of fluid flow in the aft row of blades.

In a blower or pump as aforedescribed in which the deceleration of fluid flow in the aft row of blades is equal to $$\frac{1}{A} \times \sqrt{\cos \alpha^{\circ}_2}$$

in which $\alpha^{\circ}_2$ equals the angle that the guide vanes turn the flow from the direction of impeller discharge and A is equal to or less than $1-0.005\ (\alpha^{\circ}_2-49^{\circ})$, and the deceleration of fluid flow in the forward row of blades is equal to $$\frac{\cos \alpha^{\circ}_2}{\cos \alpha_2^{x}}$$

in which the $\alpha^{x}_2$ equals the flow discharge angle from the forward row of blades.

In a blower or pump as aforedescribed in which each of the blades in the forward row of the stationary guide vanes includes means for adjusting pressure and flow velocity through the blower or pump during operation thereof at a predetermined speed of rotation, said means including means for mounting each of said forward blades for pivotal movement about a point located closely adjacent the trailing edge of each blade of said forward row, and means for pivoting each forward blade about said point thereby changing the angle of attack of the forward row of blades and changing the flow deflection of the combined forward and aft row of blades.

In a blower or pump as aforedescribed in which said stationary guide vanes includes a third row of blades located downstream of said aft row of blades.

In a blower or pump as aforedescribed in which the blades providing deceleration and deflection have forward blades forming alternating fluid flow paths, a first one of said alternating fluid flow paths discharging the fluid between adjacent aft blades and a second one of said alternating fluid flow paths discharging fluid on opposite sides of one of said adjacent aft blades, the circumferential distance separating the trailing edges of the forward blades forming the first alternating fluid flow path being equal to approximately 0.9 to 1.0 times the circumferential distance separating the trailing edges of the forward blades forming the second alternating fluid flow path.

In a blower or pump or the like of the turbomachine type and having a hub member, a plurality of impeller blades mounted on the hub member for rotation, each of said blades having a hub portion, a tip portion, a rounded leading edge and a relatively sharp trailing edge, said blades having a combination of camber and blade solidity wherein, during operation of said blades at the design point, the outlet relative velocity is equal to or greater than approximately 0.6 times the inlet relative velocity at the hub of the impeller, the ratio of the outlet relative velocity to the inlet relative velocity at the hub is greater than at the tip, and the angle of flow deflection within the impeller blades is equal to or more than approximately 49° at the hub location; a plurality of stationary guide vanes mounted on the hub member, said guide vanes being located downstream from said impeller blades and through which flows the entire flow discharged by the impeller blades, each of said guide vanes having a hub portion and tip portion, each of said guide vanes having a combination of camber and blade solidity wherein the direction of discharge from said impeller blades is turned by said guide vanes back to the direction of entry of flow into said impeller blades while the absolute flow through said stationary guide vanes undergoes a substantial flow deceleration wherein the ratio of the axial through flow velocity to absolute impeller blade exit velocity from the impeller blades equals at least approximately 0.66 or less at the hub location, and the pressure coefficient for said blower or pump is equal to at least 1.0 or more.

In a blower of the centrifugal turbomachine type said blower having a stationary annular member, an impeller positioned for rotation in said stationary annular member and being radially spaced therefrom by an annular fluid path which has a fluid inlet end and a fluid outlet end of larger diameter and which has a curved flow path of progressively increasing area which extends from said fluid inlet end to said fluid outlet end, a series of impeller blade rows located in said fluid flow path and being connected to said impeller and a series of guide vane rows located in said flow path and being connected to said annular stationary member, said guide vane rows being alternated with said impeller blade rows along said flow path, each of said impeller blade rows in conjunction with an adjacent one of said guide vane rows constituting one of a series of pressure generation stages in said curved portion of said flow path, each of said impeller blades having an impeller portion, an outer blade portion, a rounded leading edge and a relatively sharp trailing edge, a combination of camber and solidity wherein, during operation of said impeller blades at the design point, the average outlet relative velocity is equal to or greater than 0.6 times the inlet relative velocity at the hub of the impeller portion of said blades, and the angle of flow deflection within the impeller blades is at least equal to approximately 50° or more, each of said guide vane rows including at least a forward row of blades and an aft row of blades, the chord of each of the blades in the aft row being greater than the chord of each of the blades in the forward row, each blade in the aft row cooperating with a corresponding blade in the forward row to form, during operation of the blower, multiple rows of blades, the axial distance between the trailing edge of the forward blades and the leading edge of the aft blades is equal to or less than the absolute value of approximately 0.12 times the chord of the aft blade of the multiple rows of blades for each pair of blade rows, the circumferential distance between the leading edge of each aft blade and the trailing edge of the forward blade nearest the upper surface of said aft blade is equal to or less than one-third times the pitch of the aft blades for each pair of blade rows, each row of blades of said guide vanes having a combination of camber and blade solidity wherein, during operation of the blower, the direction of discharge from said impeller blades is turned by said guide vane rows back to the direction of the entry of said row into said impeller blades, the deflection of flow being greater than approximately 49°; and the pressure coefficient for each of said centrifugal blower stages is greater than approximately 1.1.

In a blower or pump or the like of the axial flow or mixed flow turbo machine type and having a hub member, a plurality of impeller blades mounted on the hub member for rotation, each of said blades having a hub portion, a tip portion, a rounded leading edge and a relatively sharp trailing edge, said blades having a combination of camber and blade solidity wherein, during operation of said blades at the design point, the outlet relative velocity is equal to or greater than approximately 0.6 times the inlet relative velocity at the hub of the impeller, the ratio of the outlet relative velocity to the inlet relative velocity at the hub is greater than at the tip, and the angle of flow deflection within the impeller blades is equal to or greater than 50° at the hub location; a plurality of stationary guide vanes mounted on the hub member, said guide vanes being located downstream from said impeller blades and through which flows the entire flow is charged by the impeller blades, each of said guide vanes having a hub portion and a tip portion, each of said guide vanes having a combination of camber and blade solidity wherein, the direction of discharge from said impeller blades is turned by said guide vanes back to the direction of entry of said flow into said impeller blades while the absolute flow through said stationary guide vanes undergoes a substantial flow deceleration of approximately 0.66 or less at the hub location; and the pressure coefficient for said blower or pump is equal to at least 1.0 or more.

In a blower or pump or the like of the turbomachine type having a plurality of impeller blades mounted on an impeller for rotation, means for rotating said impeller blades, and a fluid flow path through which the fluid flows during operation of the blower or pump, said fluid flow path including surfaces for directing the flow of fluid passing through said fluid flow path, said surfaces, during operation of the blower or pump, having a boundary layer formed thereon, the improvement comprising means for removing a portion of the boundary layer from a first predetermined part of one of said flow directing surfaces located downstream of said impeller blades and returning said removed boundary layer to the fluid flow path at a second predetermined part of said flow directing surface located upstream of said first predetermined part.

In a blower or pump as aforedescribed in which said boundary layer removal means includes means attenuating noise during operation of said blower or pump.

In a blower or pump as aforedescribed in which the boundary layer removal means includes means for returning said removed boundary layer to the boundary layer at a second predetermined part of said flow directing surface located upstream of said first predetermined part.

In a blower or pump of the type as aforedescribed in which said boundary layer removal means includes means for directing the removed boundary layer through said means for rotating said impeller blades thereby cooling said means for rotating said impeller blades.

In a blower or pump as aforedescribed in which said boundary layer removal means includes means for removing particulate matter from the portion of the boundary layer removed from said flow directing surface.

In a blower or pump as aforedescribed in which the means for returning the removed boundary layer to the fluid flow path includes a plurality of hollow blades each of which extends into the fluid flow path.

A method of producing pressurized fluid comprising the steps of forming a fluid flow path, generating a flow of fluid through said fluid flow path, deflecting the flow of fluid as same flows through said fluid flow path while simultaneously maintaining substantially constant relative velocity at least at one location within said fluid flow path, and generating pressure by turning back the flow of fluid by an amount approximately equal to the amount of deflection of the fluid while simultaneously decelerating the flow of fluid by maintaining the ratio of the axial through flow velocity through the fluid flow path to the outlet velocity, before the generation of said pressure, equals approximately 0.66 or less.

A method of removing a portion of the boundary layer formed on flow directing surfaces, forming a fluid flow passage, said method comprising the steps of forming a fluid flow path having flow directing surfaces, generating a flow of fluid through said flow path along said flow directing surfaces while simultaneously forming a boundary layer on said flow directing surfaces, and removing a portion of the boundary layer from a first part of said boundary layer formed on at least one of said flow directing surfaces and returning said portion of said boundary layer to the fluid flow path at a location upstream of said first part by simultaneously connecting said fluid passage and fluid communication with said first part in said upstream location.

A method of producing pressurized fluid, comprising the steps of forming a fluid flow path having flow directing surfaces, generating a flow of fluid through said flow path along said flow directing surfaces while simultaneously forming a boundary layer on said flow directing surfaces, deflecting the flow of fluid as same flows through said fluid flow path while simultaneously maintaining the average relative velocity following said deflection approximately equal to the relative velocity prior to said deflection at least at one location within the fluid flow path, generating pressure by turning back the flow of fluid by an amount approximately equal to the amount of deflection of the fluid while simultaneously decelerating the flow of fluid by maintaining the ratio of the axial through flow velocity through the fluid flow path to the impeller outlet velocity during the generation of said pressure equal to approximately 0.66 or less at the hub, forming a fluid flow passage, and removing a portion of the boundary layer from a first part of said boundary layer formed on at least one of said flow directing surfaces and returning said portion of said boundary layer to the fluid flow path at a second predetermined part of said flow directing surface located upstream of said first predetermined part.

A method of producing pressurized fluid at reduced noise levels comprising the steps of forming a fluid flow path, generating a flow of fluid through said fluid flow path, deflecting the flow of fluid as same flows through the fluid flow path while simultaneously maintaining the average relative velocity following said deflection approximately equal to the relative velocity prior to said deflection at least at one point in the fluid flow path, and generating pressure by turning back the flow of absolute fluid velocity by an amount approximately equal to the amount of absolute velocity deflection of the fluid while simultaneously decelerating the flow of fluid.

BRIEF DESCRIPTION OF THE DRAWINGS

FIGS. 9A–9C are flow vector diagrams of another blower constructed in accordance with the present invention showing flow conditions at the hub, mean and tip of the impeller blades;

FIG. 10 shows a two row guide vane constructed in accordance with the present invention in which the same number of blades are used in the forward and aft rows;

DETAILED DESCRIPTION

Nomenclature

Figure 1:
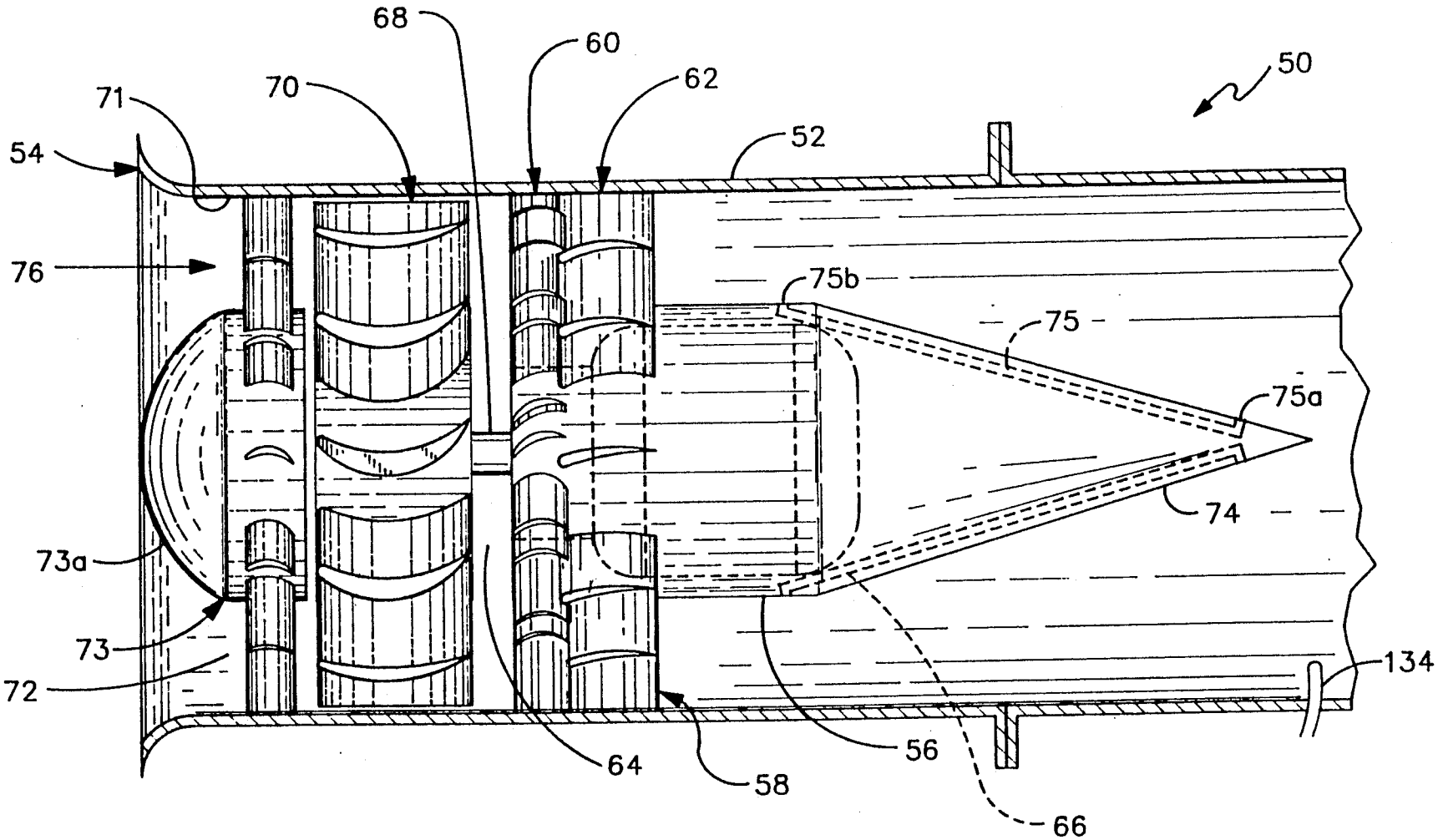
FIG. 1 is a schematic, longitudinal view, in partial cross-section, of a turbomachine constructed in accordance with this invention including inlet guide vanes, a rotor having impeller blades, stationary exit guide vanes and a diffuser downstream of the stationary guide vanes.

The following nomenclature is used in connection with the description of the turbomachine of this invention:

a: Axial distance between blade rows in the guide vanes—inches
c: Absolute velocity—feet per second
ch: Chord length—inches
$c_m$: Axial through flow velocity—feet per second
d: Circumferential distance of leading edge of the aft airfoil to the trailing edge of the forward airfoil nearest the upper surface of aft airfoil—inches
g: Acceleration of gravity (32.2 feet per second) per second
k: Velocity in boundary layer—feet per second
n: Speed in revolutions per second of the driving motor
$\eta_s$: Specific speed
p: Pressure—inches water column (inches W. C.)
s: Distance from surface—inches
t: Blade pitch—inches
u: Circumferential velocity—feet per second
v: Hub/tip ratio
w: Impeller relative velocity—feet per second
z: Blade number
$\beta$: Flow angle between velocity components—degrees
C: Hydraulic diameter
D: Diameter—inches
F: Shape parameter
H: Head generated by the blower—feet
K: Velocity just outside the boundary layer— feet per second
L: Channel length—inches
M: Length of diffuser—inches
N: Power
Q: Flow quantity—cubic feet per second (CFS)
R: Radius—inches
S: Degree of impeller reaction
V: Mean velocity within the boundary layer
W: Diffuser entrance width
$\alpha$: Airfoil angle of attack—degrees
$\gamma$: Stagger angle of airfoil—degrees
$\delta$: One-half diffuser included angle—degrees
$\theta$: Impeller flow deflection—degrees
$\epsilon$: Displacement thickness—inches
$\sigma$: Airfoil solidity
$\phi$: Momentum thickness
$\psi$: Pressure coefficient
$\Phi$: Flow coefficient
$\mu$: Boundary layer thickness—inches
$\tau$: Specific gravity of fluid Subscripts D: diffuser
e: exit
E: equivalent diffuser angle
H: hub
i: inlet
I: impeller
M: mean
o: guide vane inlet
p: part blade
s: static
T: tip
t: total
u: circumferential
1: forward row
2: aft row
3: third row 1 inch=2.540 centimeters
1 foot=30.480 centimeters
1 cubic foot=0.02832 cubic meters

THE NEW TURBOMACHINE

The present invention relates to a blower or pump or the like of the turbomachine type for generating pressurized fluid. The performance of this turbomachine is characterized by a much greater pressure coefficient than has heretofore been possible for comparable devices. This is accomplished through the use of a combination of special impeller blades and guide vanes constructed in accordance with this invention. The turbomachine of this invention uses a smaller impeller diameter resulting in a smaller casing size so that the machine is less expensive to manufacture thereby resulting in a saving in space and weight while performing at high efficiency. This turbomachine generates pressure using impeller blades providing large angles of flow deflection without any appreciable reaction and guide vanes which convert the dynamic pressure to static pressure. This turbomachine uses a low impeller tip speed together with special configurations of impeller blades and guide vanes thereby resulting in a substantial reduction of noise levels for the same amount of flow and pressure. This turbomachine enables the manufacture of an axial flow machine which can be operated at a higher flow coefficient than comparable axial flow machines. This is due to the use of a smaller annulus of the through flow area and a smaller impeller tip diameter than comparable axial flow machines.

This turbomachine also provides an axial flow machine operating at a lower specific speed than is presently possible for axial flow machines; thus, this new turbomachine can be used in lieu of certain conventional mixed flow and centrifugal blowers. This turbomachine also provides a centrifugal blower capable of operating at a higher pressure coefficient and lower specific speed than is presently possible for existing centrifugal machines. Thus, this invention provides a new range of application for pumps and blowers. The turbomachine of this invention utilizes means for adjusting pressure and flow velocity through the machine; this is achieved by changing the angle of attack of the forward row of blades included in the guide vanes thereby changing the flow deflection of the guide vanes as a whole. Through the use of this means, the length of flow path through the guide vanes is increased which, in turn, permits greater deceleration of flow within the guide vanes without flow separation.

The turbomachine of this invention also includes a boundary layer removal system to reduce boundary layer thickness to relatively low values. A turbomachine so constructed permits large increases in the value of the included angle or equivalent diffusion angle thereby reducing the length of diffusers heretofore used. In turn, this reduces the weight of the blower and the cost to manufacture same. The returned boundary layer flow may, in turn, also be used to cool the blower's motor before it is returned to the fluid flow path or boundary layer.

The invention consists of a pressure generating turbomachine such as a fan, blower or pump. These machines increase fluid pressure between fluid entrance and fluid exit from the machine. The machines have a rotating impeller which is driven by a shaft with energy being supplied by a motor of prime mover. These machines include impeller blades for turning or deflecting the flow within the impeller. They may optionally include inlet guide vanes for guidance of flow into the impeller. They also include outlet guide vanes for turning the direction of the flow, and for generating pressure as the flow passes through the downstream guide vanes. The performance of these machines is characterized by the non-dimensional coefficients of specific speed $\eta_s$, pressure coefficient and flow coefficient $$\eta_s = \frac{nQ^{\frac{1}{2}}}{g^{\frac{3}{4}}\,h^{\frac{3}{4}}}$$

$$\psi = \frac{2gH}{U_T^2}$$

$$\phi = \frac{c_m}{U_T}$$

Construction of rotating and stationary blades of an axial flow blower in accordance with this invention results in a much higher pressure output and simultaneously a much smaller size of blower. The diameter may be reduced by as much as two-thirds. Heretofore, the maximum pressure coefficient ($\Phi$) at the point of maximum efficiency of prior axial flow blowers have been on the order of approximately 0.8, and the maximum pressure coefficient ($\Phi$) for radial blowers have been approximately 1.1 up to a maximum of 1.4. However, axial flow blowers using the rotating and stationary blades of the present invention can achieve pressure coefficients ($\Phi$) of 1.4 to 3.6 and higher at the point of maximum efficiency. The pressure coefficients achieved for radial blowers or fans constructed in accordance with the present invention is approximately 3.0 and above. The use of a smaller diameter results in a higher flow coefficient ($\Phi$). In fact, a flow coefficient ($\Phi$) of more than twice that normally associated with existing machines may be achieved.

At present, axial flow blowers operate at a specific range of the specific speed ($\eta_s$) and centrifugal blowers operate at a lower range of the specific speed. The two ranges of specific speed are in adjoining areas and the mixed floor blowers operate in the area where the two ranges have a common border. However, axial flow blowers constructed in accordance with the principles of the present invention operate at a much lower specific speed ($\eta_s$) because they achieve a much higher pressure coefficient than was possible with conventional blowers. Thus, axial flow blowers constructed according to the present invention will compete with a certain group of centrifugal blowers except, for the same specification and shaft speed, they will be much smaller, use less space and are less costly to build. Centrifugal blowers constructed in accordance with the principles of the present invention will operate at a lower specific speed ($\eta_s$) than conventional centrifugal blowers. Also, they will compete with the expensive positive displacement machines in the range of specific speed which is presently below centrifugal blowers.

The enhanced performance of the turbomachine of this invention is based on the use of special blades in the impeller and the stationary guide vanes. The pressure change in the fluid that passes through the impeller blades is very small; essentially, the impeller blades are reactionless at least at one location within the impeller. This is a substantial difference from conventional pressure generating turbomachinery which generates about 50% or more of the pressure in the impeller blades. In the turbomachine of this invention, however, all or substantially all the pressure is generated in the stationary guide vanes which are located downstream of the impeller.

It will be understood that the flow leaving the guide vanes can enter a diffuser if it is desireable to reduce the discharge velocity of the turbomachine. Alternatively, the flow leaving the guide vanes can enter a second or several additional impeller-guide vane blade rows to form a multistage turbomachine. As a multistage device, the turbomachine can generate a predetermined value of pressure and flow volume within a smaller diameter and with a much smaller number of stages than conventional multistage machines. Additionally, a multistage turbomachine constructed in accordance with this invention can deliver specific values of pressure and flow at higher efficiency than certain positive displacement compressors or pumps.

Since axial flow and centrifugal fans constructed in accordance with the principles of this invention can now operate at lower specific speeds, this means that such turbomachines are lighter in weight, smaller in diameter and can be operated at reduced rotational speeds; thus, they can be constructed at a reduced cost. In addition, such turbomachines operate at a lower noise level and reduced vibration output. Thus, not only can axial flow blowers compete in performance with conventional mixed flow and centrifugal blowers but also they can be smaller in size which, in turn, means they can be manufactured at a lower cost.

Figure 3:
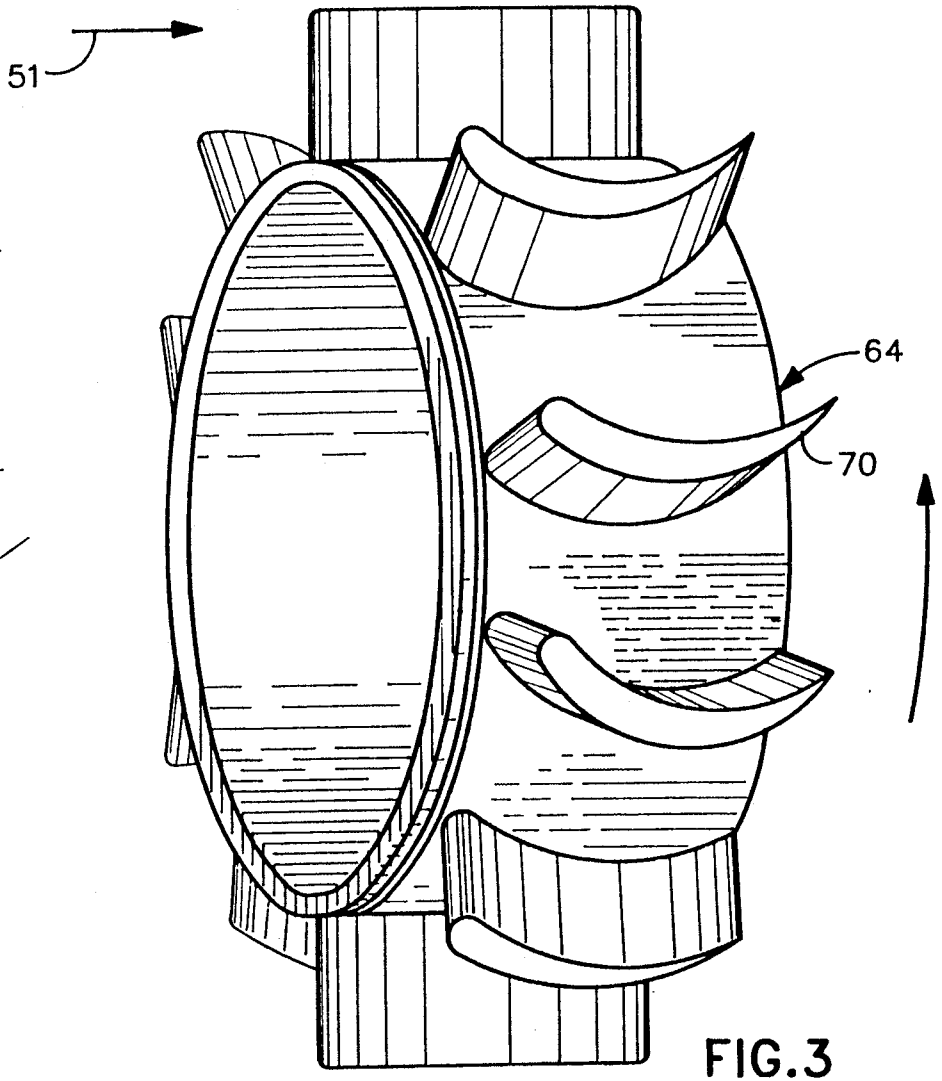
FIG. 3 is a perspective view showing a turbomachine rotor having impeller blades assembled in cascade thereon, constructed in accordance with this invention.
Figure 2:
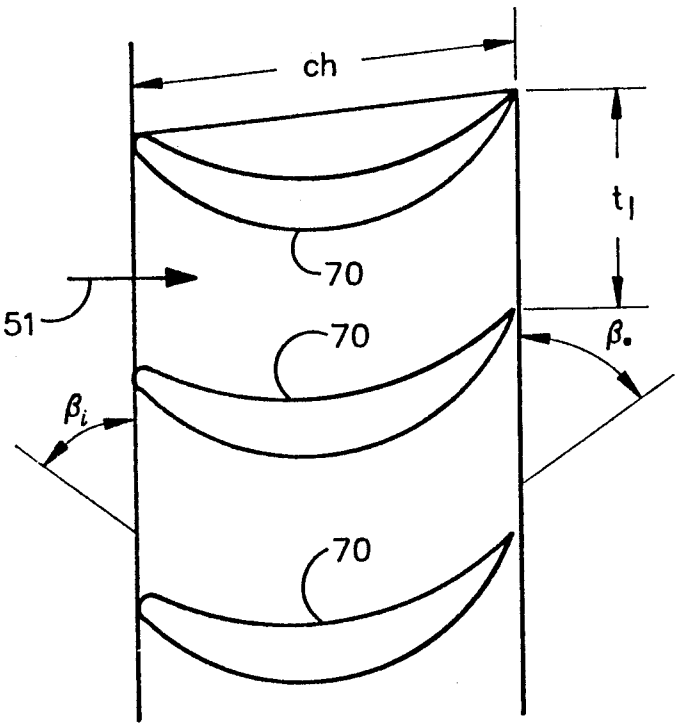
FIG. 2 shows a set of impeller blades constructed in accordance with the present invention.

Referring now to the drawings, FIGS. 1–3 show one form of a pump or blower constructed in accordance with the subject invention. The blower 50 shown in FIG. 1 is of the axial flow type. The direction of fluid flow is from left to right as viewed in FIGS. 1–3, see arrow 51 in FIG. 3. The blower 50 includes a cylindrical or tubular housing 52 having an outwardly flared intake end 54. A motor housing 56 is supported by at least a part of the outlet guide vanes 58. As shown in FIG. 1, the guide vanes 58 comprise two rows of blades 60 and 62. Under some circumstances, it may be desireable to fabricate the forward row of blades 60 such that it can be removed and replaced by another row of blades or the same blades disposed at a different angle. However, the aft blades 62 are used to support the motor housing 56. The blower 50 also includes a rotor 64 driven by a motor 66 through a drive shaft 68 and it carries impeller blades 70, the tips of which extend to points closely adjacent the inner surface 71 of the housing 52. The blower 50 may, as shown, include stationary inlet guide vanes 72 mounted upstream of the impeller blades 70 on the housing 52. The inlet guide vanes 72 support a hub member 73, said hub member has a hemispherical cap 73*a* formed at the upstream end thereof. The blower 50 includes a conical diffuser 74 extending rearwardly or downstream of but supported by the motor housing or second hub member 56. The conical diffuser 74 includes means, including fluid passage 75, for removing a portion of the boundary layer from a first predetermined part 75*a* of the outer surface of said conical diffuser 74 and returning said removed boundary layer to the fluid flow path 76 formed through the blower at a second predetermined part 75*b* of said flow directing surface location upstream of said first predetermined part 75*a*. FIG. 1 shows the present preferred embodiment for a blower or pump of the axial flow turbomachine type in which the guide vanes turn back the flow of fluid by more than 49° up to 70°. It will be appreciated that the blower 50 shown in FIG. 1 is somewhat diagrammatic and is illustrative of a form of possible application of the new impeller blades and guide vanes which are a part of this invention as well as the means for removing a portion of the boundary layer from a flow directing surface.

Conventional Axial Flow Blower

Figure 7A:
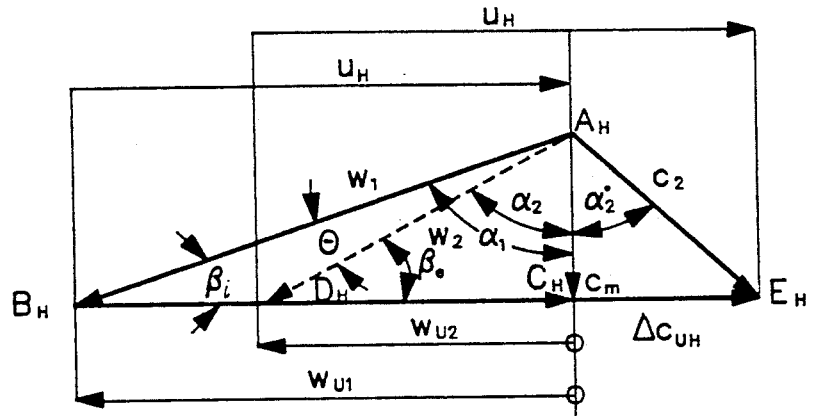
FIGS. 7A–7C are vector flow diagrams for a conventional axial flow blower showing the flow conditions, respectively, at the hub, mean and tip of the impeller blades.
Figure 7B:
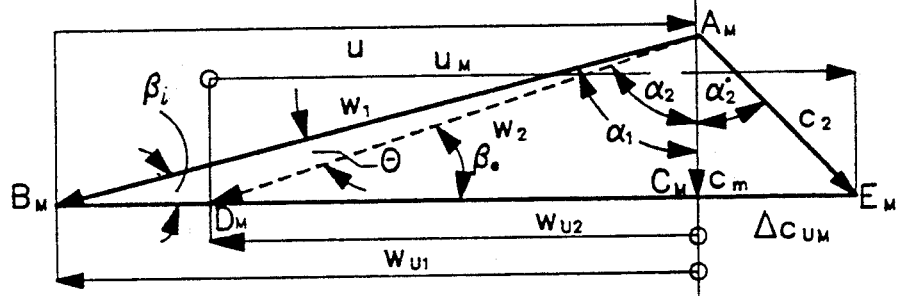
Figure 7C:
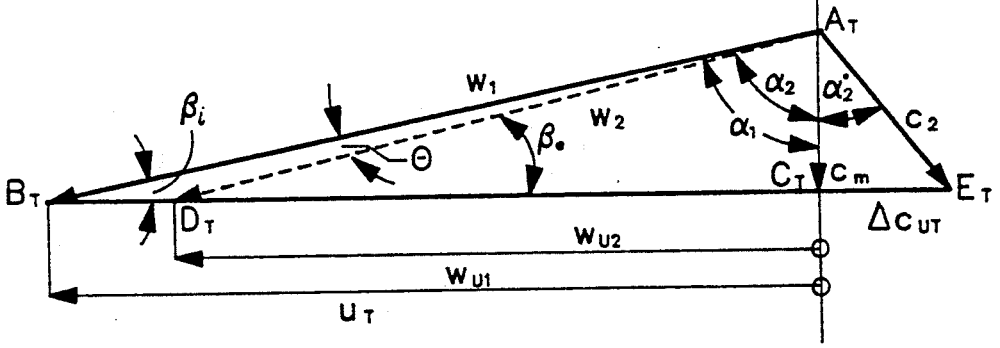

FIGS. 7A–C show the vector flow diagrams for a conventional axial flow blower. As shown in FIG. 7, the impeller blades reduced the entering relative velocity $w_1$ to the value of the exiting relative velocity $w_2$. The vectors of the circumferential component of the entering relative velocity $w_{u1}$ and the exiting relative velocity $w_{u2}$ are both in the direction opposing the circumferential velocity u. The flow channel formed between adjacent impeller blades is of increasing flow area resulting in a reduction of the relative velocity from $w_1$ to $w_2$ and a corresponding increase in impeller pressure or head which is equal to H equals $(W_1^2-w_2^2)/2g$. As shown in FIGS. 7A–C, the flow vector diagrams clearly identifies velocity changes which must be accomplished by the blade configuration. As shown in FIGS. 7A–C, the ratios of $w_2/w_1$, $c_m/c_2$ and other values at the mean, hub and tip are as follows:

| | Hub | Mean | Tip |
|---|---|---|---|
| $w_2/w_1$ | 0.677 | 0.788 | 0.854 |
| $c_m/C_2$ | 0.664 | 0.748 | 0.808 |
| $c_m$ | 49.3 | 49.3 | 49.3 |
| u | 150.2 | 191.8 | 233 |
| $w_1$ | 158 | 198 | 239 |
| $w_2$ | 107 | 156 | 204 |
| $c_2$ | 74.3 | 65.9 | 61.0 |

Another important characteristic conventional axial flow blower is the degree of reaction in the impeller to be accomplished by the impeller blades. The degree of reaction is the ratio of the pressure or head generated in the impeller to the total head of the blower. For an axial flow blower, the head in the impeller $$H_I = \frac{w_1^2 - w_2^2}{2g}$$

and the total head $$H = \frac{w_1^2 - w_2^2}{2g} + \frac{c_2^2 - c_1^2}{2g} = \frac{u\Delta c_u}{g}$$

The degree of reaction in the impeller ($S_I$) equals $H_I/H$ which equals $1-\Delta c_u/2u$. For the flow vector diagram shown in FIGS. 7A–C, the degree of reaction in the impeller ($S_I$) equals approximately 0.88 or 88%. By comparison, the degree of reaction ($S_I$) in the turbomachine of this invention is very small.

Flow vector Diagram and Impeller Blades for the New Turbomachine

Figure 4A:
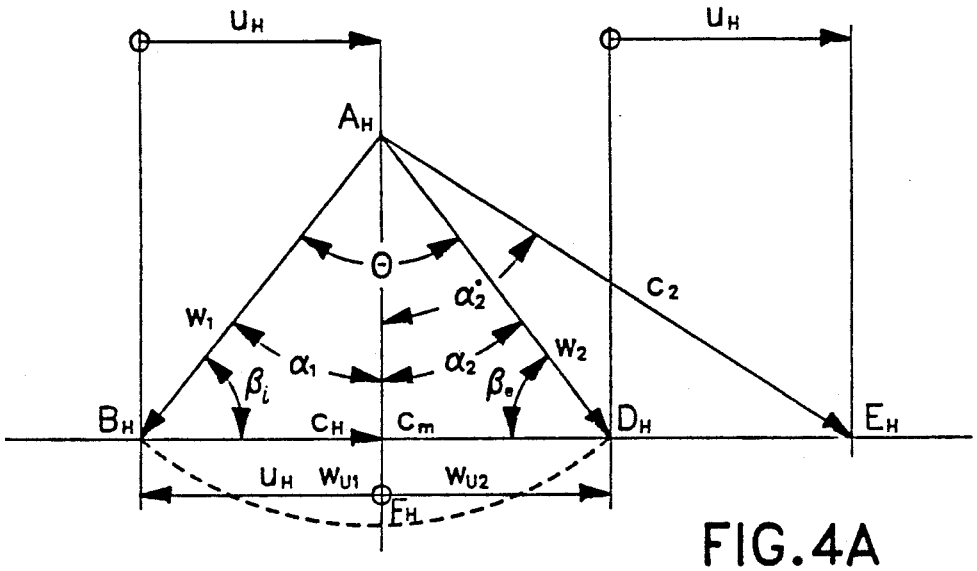
FIGS. 4A–4C are vector flow diagrams for an axial flow blower constructed in accordance with the present invention, showing the flow conditions, respectively, at the hub, mean and tip of the impeller blades, wherein the inlet velocity is equal to the outlet velocity at the hub.

One aspect of this invention is to provide impeller blades which generate a large deflection of flow in the impeller while simultaneously keeping changes in relative velocity between the blade entrance and exit to a minimum. Thus, the impeller blades of this invention perform an entirely different function from those used in prior art axial flow blowers. The required performance of the impeller blades of this invention is represented in the flow diagram shown in FIGS. 4A–C for the case $w_1$ equals $w_2$ at the hub. As shown in FIG. 4A, at the hub location the flow vector $w_1$ equals $w_2$; thus, there is neither flow acceleration or deceleration at that location. If the impeller blade configuration for the hub as shown in FIG. 4A would permit the change of flow from vector $A_HB_H$ through $A_HC_H$ to $A_HD_H$, the impeller relative flow would undergo a flow deceleration from $A_HB_H$ to $A_HC_H$ and subsequently a flow acceleration from $A_HC_H$ to $A_HD_H$. Such a change in flow velocity is an inherently inefficient process. In order to avoid this inefficiency, the impeller blades must be designed to induce a flow vector path from the blade entrance at $A_HB_H$ in FIG. 4A at the hub through location $A_HF_H$ to the blade exit at $A_HD_H$, thereby creating a flow channel of essentially constant flow area and consequently constant flow velocity. By avoiding flow decelerations, the efficiency of the impeller is substantially improved and the boundary layer thickness is reduced thereby reducing noise generation within the blower. It will also be noted that the vector of the circumferential component of the entering relative velocity $w_{u1}$ is in the direction opposing the direction of the circumferential impeller velocity u while the vector of the circumferential component of the exiting relative velocity $w_{u2}$ is in the same direction as the circumferential velocity u at least at one location between the hub and the tip. This is an entirely new concept of blade design and is different from impulse turbine blades as well as conventional blower blades, see FIGS. 7A–C.

Figure 4B:
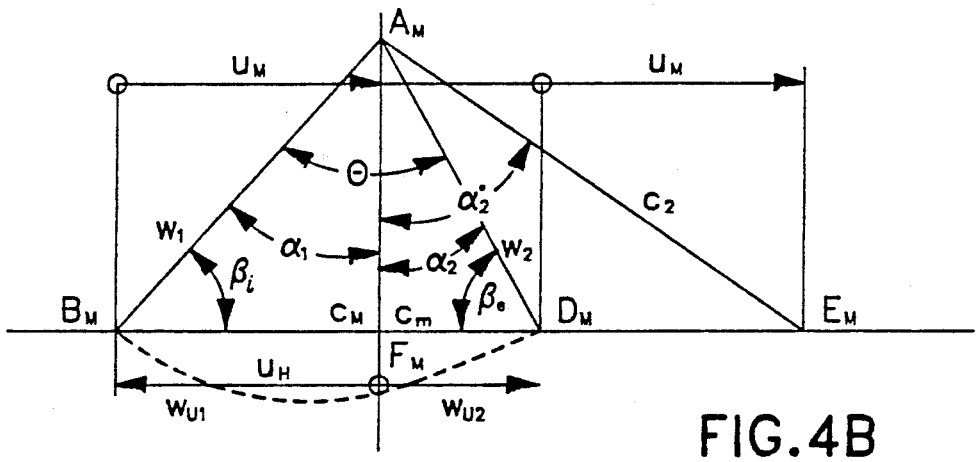
Figure 4C:
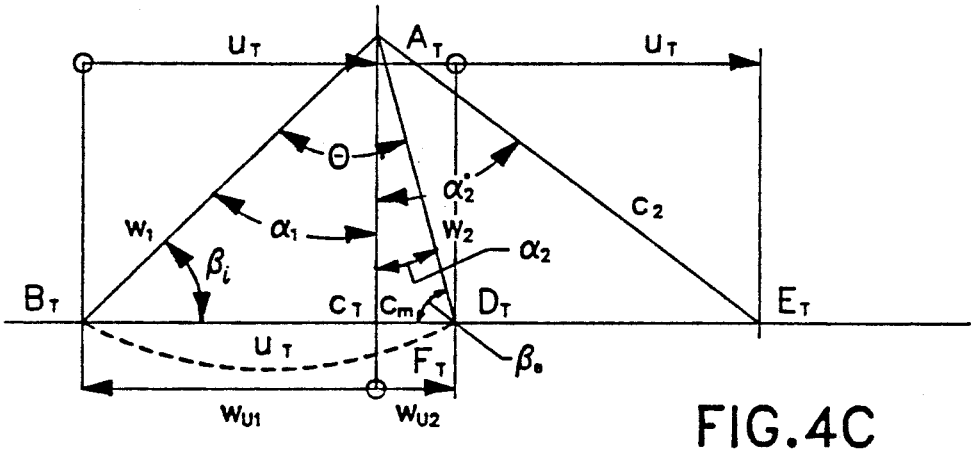

FIG. 4B also shows there is a flow deceleration at the mean diameter from $w_1$ at $A_HB_H$ to $w_2$ at $A_HD_H$. FIG. 4C shows there is a flow deceleration at the tip diameter from $w_1$ at $A_TBr_T$ to $w_2$ at $A_TD_T$. In both these cases, if the impeller blade configuration changed the flow from vector $A_MB_M$ ($A_TB_T$) through $A_MC_M$ ($A_TC_T$) to $A_MD_M$ ($A_TD_T$), the flow vectors undergo a large flow deceleration from $A_MB_M$ ($A_TB_T$) to $A_MC_M$ ($A_TC_T$) and subsequently a flow acceleration from $A_MC_M$ ($A_TC_T$) to $A_MD_M$ ($A_TD_T$). Again, this is a very inefficient process as the large flow deceleration is followed by a flow acceleration. This process must be replaced by a single process of moderate deceleration $A_MB_M$ ($A_TB_T$) to $A_MF_M$ ($A_TF_T$) to $A_MD_M$ ($A_TD_T$) in order to get the best efficiency.

For a fuller appreciation of the impeller blade configuration contemplated by this invention and the performance thereof, the following information relating to the impeller blade configuration diagramed in FIGS. 4A-C which has a flow coefficient (Φ) of 1.0 is furnished:

| | Hub | Mean | Tip |
|---|---|---|---|
| $w_2/w_1$ | 1 | 0.841 | 0.735 |
| $c_m/c_2$ | 0.530 | 0.575 | 0.616 |
| $c_m$ | 63.8 | 63.8 | 63.8 |
| u | 51.1 | 57.4 | 63.8 |
| $w_1$ | 81.7 | 85.6 | 90.2 |
| $w_2$ | 81.7 | 72 | 66.3 |
| $c_2$ | 120.4 | 110.9 | 103.7 |
| $\theta$ | 77.3° | 69.6° | 60.6° |
| $\alpha_1$ | 38.7° | 42.0° | 45.0° |
| $\alpha_2$ | 38.7° | 27.6° | 15.6° |
| $\alpha^e_2$ | 58.0° | 54.9° | 52.0° |
| $\beta_i$ | 51.3° | 48.0° | 45.0° |
| $\beta_e$ | 51.3° | 62.4° | 74.4° |

The flow vector diagram of FIGS. 4A-C represents an axial flow machine; similar diagrams can be drawn from mixed flow and centrifugal machines demonstrating the principle of the invention. In the impeller, the inlet relative velocity is turned by the impeller blades through the angle $\theta$ to the outlet relative velocity $w_2$. The inlet velocity w equals the outlet flow velocity $w_2$ at the hub as shown in the flow vector diagram in FIG. 4A. Small changes in the relative velocity from $w_1$ to $w_2$ are within the scope of this invention and are discussed below.

An acceleration of relative velocity from $w_1$ to $w_2$ in the impeller blades results in a larger absolute velocity $c_2$ leaving the impeller; in turn, this produces a larger pressure coefficient for the complete machine. Conversely, a deceleration of relative velocity from $w_1$ to $w_2$ in the impeller blades results in a smaller absolute velocity $C_2$ leaving the impeller; in turn, this produces a smaller pressure coefficient for the complete system. A reduction in flow velocity from $w_1$ to $w_2$ also results in a generation of pressure in the impeller. Thus, it is important to realize that large deflections $\theta$ within the impeller blades can only be achieved if the deceleration flow within these blades is zero or very small because otherwise the flow within the impeller blades will stall with corresponding large losses in efficiency. Thus, the following relationship must be maintained anywhere within the impeller blades:

$$w_2 \geqq 0.6\ w \quad (1)$$

The impeller blades which precede the guide vanes will be of a very specific configuration so that the combined performance of the impeller and guide vanes will result in a pressure coefficient of $\Phi = 1.4$ to 3.6 and above. The impeller blades are of a type generating large deflection of flow:

$$\theta \geqq 50° \quad (2)$$

$$\theta = \alpha_1 - \alpha_2 \quad (3)$$

Figure 8A:
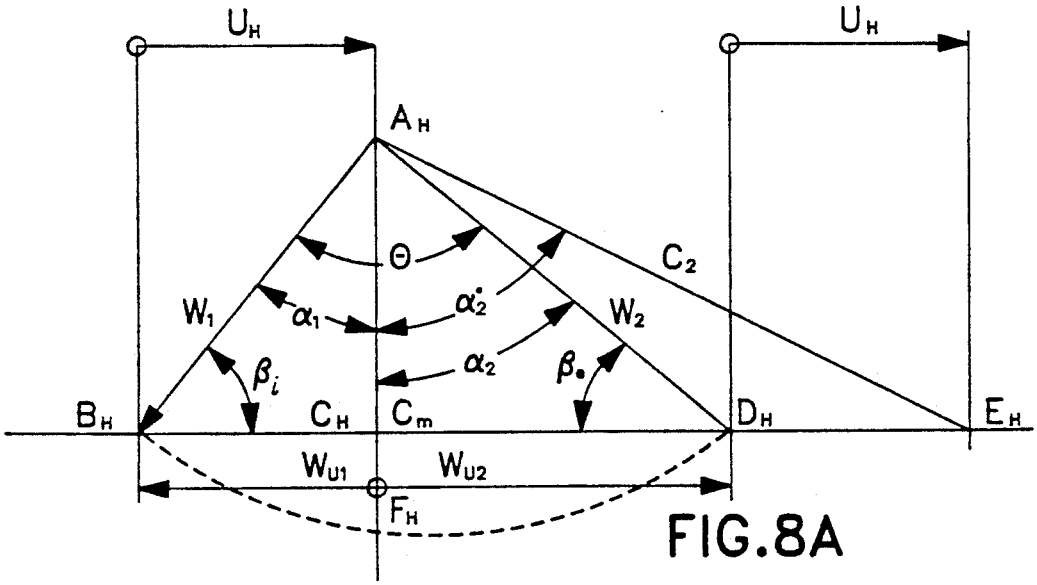
FIGS. 8A–8C are vector flow diagrams for a blower constructed in accordance with the present invention showing flow conditions at the hub, mean and tip of the impeller blades where the inlet velocity is equal to the outlet velocity at the mean.
Figure 8B:
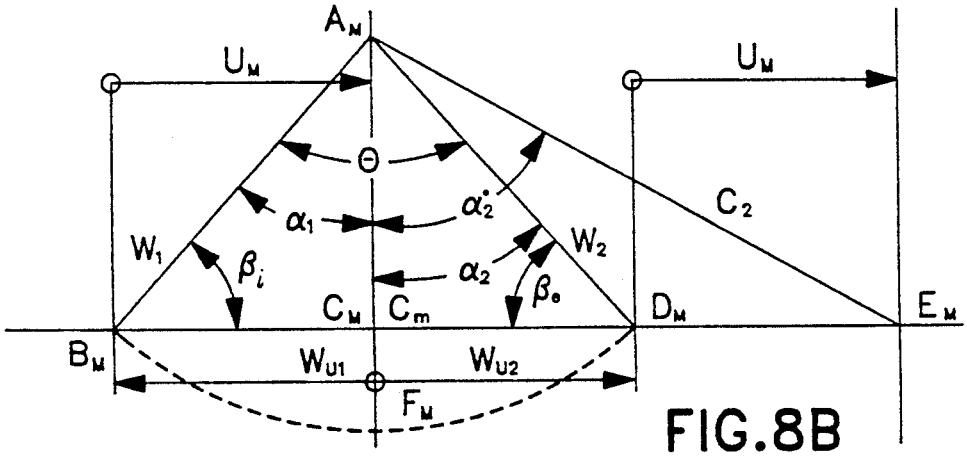
Figure 8C:
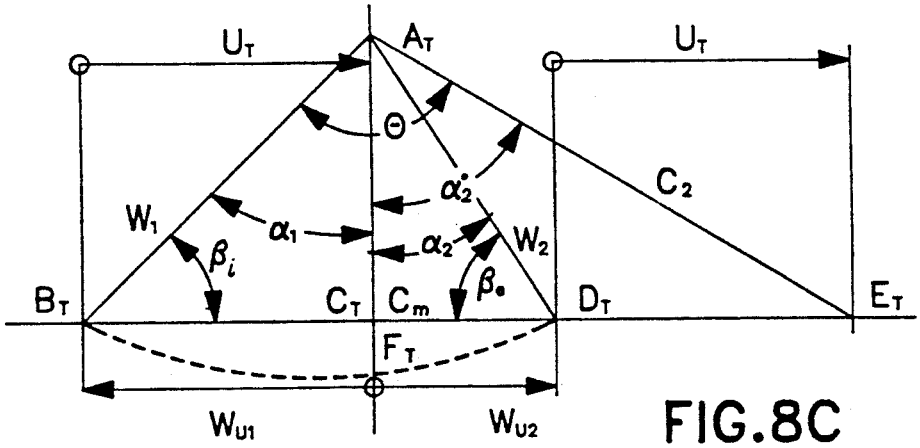

FIGS. 8A-C represent the case of using an impulse blade section at the mean impeller blade location. As set forth above, the impeller blade configuration must be designed to avoid flow velocity changes at the mean blade section from AB to AC to AD. Thus, the impeller blades must be designed to have a configuration such that the flow velocities follow the path AB to AF to AD. In the example shown in FIG. 8, in which the flow coefficient (Φ) equals 1.0, there is relative flow deceleration at the tip of the blade $A_TB_T$ to $A_TD_T$. The blade configuration at the tip must have flow velocities to follow the path $A_TB_T$ to $A_TF_T$ to $A_TD_T$ and avoid $A_TB_T$ to $A_TC_T$ to $A_TD_T$. At the blade hub there is relative flow acceleration within the impeller blades from blade entrance $A_HB_H$ to blade exit $A_HD_H$. The blade configuration at the hub must have flow velocities to follow the path $A_HB_H$ to $A_HF_H$ to $A_HD_H$ and avoid $A_HB_H$ to $A_HC_H$ to $A_HD_H$. Thus, there must be a gradual decrease in flow area between the blades with associated gradual increase in flow velocity without flow deceleration.

For a fuller appreciation of the performance of the impeller blade configuration shown in FIGS. 8A-C, the following information relating to impeller blade configuration is furnished:

| | Hub | Mean | Tip |
|---|---|---|---|
| $w_2/w_1$ | 1.235 | 1.0 | 0.832 |
| $c_m/c_2$ | 0.443 | 0.486 | 0.525 |
| $c_m$ | 63.8 | 63.8 | 63.8 |
| u | 51.1 | 57.4 | 63.8 |
| $w_1$ | 81.7 | 85.9 | 90.2 |
| $w_2$ | 100.9 | 85.9 | 75.1 |
| $c_2$ | 144.1 | 131.4 | 121.5 |
| $\theta$ | 89.4° | 84.0° | 76.8° |
| $\alpha_1$ | 38.7° | 42.0° | 45.0° |
| $\alpha_2$ | 50.8° | 42.0° | 31.8° |
| $\alpha^e_2$ | 63.7° | 60.9° | 58.3° |
| $\beta_i$ | 51.3° | 48.0° | 45.0° |
| $\beta_e$ | 39.2° | 48.0° | 58.2° |

FIGS. 9A-C show the flow vector diagram for a blower which has no impulse blade section within the impeller. There is flow deceleration from hub to tip and a corresponding pressure increase in the impeller. However, this type of blower has at the hub section and to a small degree at the mean section a flow vector diagram which is quite similar to the flow vector diagram of FIGS. 8A and 8C. The blade configuration at these locations must be designed to avoid large flow decelerations followed by a flow acceleration. The blades must have a configuration to provide a gradual increase in flow area which has a corresponding gradual decrease in flow velocity with the minimum flow velocity occurring at the blade exit. At the blade tip of this blower, the impeller flow vector diagram approaches conventional practice and the blade configuration as well as a vector diagram show a gradual change from entrance to exit. At the hub section, the flow deflection in the guide vanes is about 50° and for good performance, multiple blade guide vanes are desirable. Thus, this blower needs at the hub section impeller and guide vanes constructed in accordance with this invention.

For a fuller appreciation of the impeller blade configuration used to prepare the flow vector diagram shown in FIGS. 9A-C, the following information is furnished:

| | Hub | Mean | Tip |
|---|---|---|---|
| $w_2/w_1$ | 0.829 | 0.712 | 0.682 |
| $c_m/c_2$ | 0.636 | 0.703 | 0.756 |

-continued

| | Hub | Mean | Tip |
|---|---|---|---|
| $c_m$ | 207.9 | 207.9 | 207.9 |
| u | 171.0 | 205.3 | 239.5 |
| $w_1$ | 269.2 | 292.1 | 317.1 |
| $w_2$ | 223.2 | 207.9 | 216.2 |
| $c_2$ | 326.9 | 295.6 | 275.1 |
| D | 3.5" | 4.2" | 4.9" |
| $\theta$ | 60.8° | 46.0° | 33.1° |
| $\alpha_1$ | 39.5° | 44.6° | 49.0° |
| $\alpha_2$ | 21.3° | 1.4° | 15.9° |
| $\alpha^*_2$ | 50.5° | 45.3° | 40.9° |
| $\beta_i$ | 50.5° | 45.4° | 41.0° |
| $\beta_e$ | 68.7° | 88.6° | 74.1° |

This blower operated at 11,200 rpm, had a pressure coefficient of 1.11, a flow coefficient of 0.868 and a hub/tip ratio (v) of 0.714.

The present invention also consists of a special feature that the configuration of the impeller blades is essentially symmetric to the circumferential direction or that the deflection of relative flow is essentially symmetric to the vertical axis or through flow direction. The vector diagram shown in FIG. 4A represents impeller blades which, at the hub, are essentially symmetric to the circumferential direction $|\alpha_1| = |\alpha_2|$. It will be noted that in FIG. 4A, the angle $\alpha_1$ is negative and the angle $\alpha_2$ is positive.

The flow deflection in the impeller, as shown in FIG. 4A, keeps the absolute value of the relative velocity constant from the impeller blade inlet $w_1$ to the impeller blade exit $w_2$. This results in impulse type blading. If the blower is designed according to the free vortex flow principle, the constant value of relative velocity $w_1$ equals $w_2$ can be maintained only at one location, such as the hub, mean or tip of the impeller blade. At the other locations, the value of relative exit flow velocity $w_2$ will be accelerated or decelerated relative to the inlet velocity $w_1$ according to the free vortex principle. In impeller blades according to this invention, the maximum deceleration of the relative velocity from $w_1$ to $w_2$ shall fall within the limits of equation 1 anywhere between the hub and tip of the impeller at the design point or point of maximum efficiency. When designing the blower according to the free vortex principle, the pressure generated by the blower is constant from hub to tip and the axial through flow velocity is constant at the design point. In order to meet the free vortex flow principle, the impeller blades require a certain amount of twist from hub to tip so that the flow can enter the impeller blades without shock losses.

In addition to the use of the free vortex principle to design impeller blades, impeller blades constructed in accordance with this invention may include other design modifications. For impellers having a high hub to tip ratio (v), the amount of twist in the impeller blades from the hub to tip will be small. In such a case, the impeller blades can be designed and built to have a constant inlet and exit angle from hub to tip. In that case, the flow no longer follows the free vortex principle because there will be no twist in the blades. This features saves construction costs and the blades are easier to build. For this case, according to the present invention, the maximum deceleration of the relative velocity from w1 to $w_2$ shall fall within the limits of equation 1 anywhere between the hub and tip of the impeller at the design point or point of maximum efficiency. Generally, the velocity value of $w_1$ and $w_2$ will not be exactly constant and symmetric to the circumferential direction but $w_1$ and $w_2$ will approximate these conditions.

Another variation of impeller blade design consists of a blower impeller having a decreasing axial flow area from inlet to exit. Thus, the through flow velocity $c_m$ increases from the inlet to the exit of the impeller. For this type of impeller, the inlet hub diameter is substantially smaller than the exit hub diameter of the impeller and the flow through the impeller is no longer a conventional axial flow but of the mixed flow type. Such a design has the advantage of a different pressure-flow characteristic. This type of design is also used in pumps to reduce the danger of cavitation at the impeller inlet.

For all of the above mentioned designs, the impeller blade according to this invention have, at least at one location between the impeller hub and tip, the following characteristics:

$$c_{2u} \geqq u \tag{4}$$

$$c_{2u} \approx 2u \tag{5}$$

In addition, with the impeller blades essentially symmetric to the circumferential direction, the following relations regarding impeller flow velocity are maintained:

$$c_{2u} \geqq w_1 \tag{6}$$

$$c_2 > w_1 \tag{7a}$$

$$c_2 > w_2 \tag{7b}$$

$$\alpha_2 > \alpha_2 \tag{8}$$

$$|\alpha_1| \geqq |\alpha_2| \tag{9}$$

The characteristics of equation (7*a*) and (7*b*) are required at least at one location between the hub and the tip. As previously mentioned, the absolute value of $\alpha_1$ approximately equals the absolute value of $\alpha_2$.

As indicated in the vector flow diagrams shown in FIGS. 4A–C (and 9A–C), blowers constructed in accordance with this invention, have impeller blades of a specific configuration from hub to tip. This configuration turns the relative flow velocity within the impeller in the direction of the circumferential velocity u from blade inlet to blade exit at any location between the hub and the tip.

Blowers constructed in accordance with this invention also have the characteristic that the pressure generation in the guide vanes is much larger than the pressure generation in the impeller:

$$\frac{c_2^2 - c_1^2}{2g} > \frac{w_1^2 - w_2^2}{2g}$$

For the impulse blower, the above inequality exists at any location between the hub and the tip, as shown in FIGS. 4A–C. For the modified blower shown in FIGS. 9A–C, the above inequality exists at least at one location, i.e., at the hub location.

The detailed design of the impeller blades depends substantially upon the deflection angle and the blade solidity $\sigma$. The blade solidity is defined as the chord of the blades divided by the tangential spacing. It will be understood that the blade solidity decreases from the hub out to the tip because of the increased tangential spacing between adjacent blades. In addition, the blades must have a rounded leading edge and a reasonably sharp trailing edge to have high efficiency. FIG. 2 shows impeller blades having a deflection angle $\alpha_{.2}$ of 74.9° with a solidity of 1.72. In FIG. 2, the angle $\beta_i=53.2°$ and the angle $\beta_e=51.9°$. It will be understood that impeller blades having larger deflection angles and higher solidities may also be constructed. For deflection angles greater than approximately 85°, the blades will resemble steam turbine blades which are shown in FIG. 3 carried by the impeller.

In view of the foregoing, it will be understood that for an impulse blade section at the mean impeller blade location, the blade configuration must be designed to avoid flow velocity changes at the mean blade section. In order to do this, there can be a gradual decrease in flow area at the blade entrance with a corresponding gradual increase in flow area near the blade exit. It will also be understood that for an impulse blade section at the tip impeller blade location, the blade configuration must be designed to avoid flow velocity changes at the tip blade location. In order to do this, there can be a gradual decrease in flow area at the blade entrance with a corresponding gradual increase in flow area near the blade exit. Large discharge blade angles which would prevent discharge of flow from the blades must be avoided.

Where there is no impulse blade section included within the impeller blade, there is flow deceleration from hub to tip and a corresponding pressure increase in the impeller. Under these circumstances, the blade configuration at the hub section, and possibly at the mean section, must be designed to avoid large flow deceleration followed by flow acceleration. In order to do this, the blades must have a configuration to provide a gradual increase in flow area which has a corresponding gradual decrease in flow velocity with the minimum flow velocity occurring at the blade exit. At the blade tip of this blower, the impeller flow vector diagram approaches conventional practice and the blade configuration as well as the vector diagram show a gradual change from entrance to exit. At the hub section, the flow deflection in the guide vanes is about 49°; thus, for good performance, as will be hereinafter described in greater detail, a multiple blade guide vane is desired. Accordingly, this blower needs at the hub section impeller and guide vane blades constructed in accordance with this invention.

Inlet Guide Vanes

The pressure coefficient ( $\psi$ ) for a turbomachine constructed in accordance with this invention can be increased by the appropriate use of inlet guide vanes 72, see FIG. 1. The inlet guide vanes selected for use with the turbomachine of this invention will turn the absolute velocity $c_1$ through an angle $\alpha$. in the direction opposite the impellers circumferential velocity u. It is estimated that the use of inlet guide vanes as aforesaid will substantially increase the value of the pressure coefficient ( $\psi$ ) previously mentioned. This will correspondingly reduce the impeller tip speed, wherein the size of the impeller casing diameter as well as manufacturing costs will be reduced. Since a higher pressure coefficient results from the use of appropriate inlet guide vanes, it is calculated that a higher pressure may be obtained from a single stage unit constructed in accordance with this invention than is currently available from a conventional two stage unit. In one particular design, it is calculated that a theoretical pressure coefficient ($\psi_{TH}$) equals 8; with a total efficiency of 75%, this turbomachine will have an actual pressure coefficient ($\psi$ ) equal to 6.0. This pressure coefficient is substantially higher than that achieved with existing turbomachines.

Figure 15:
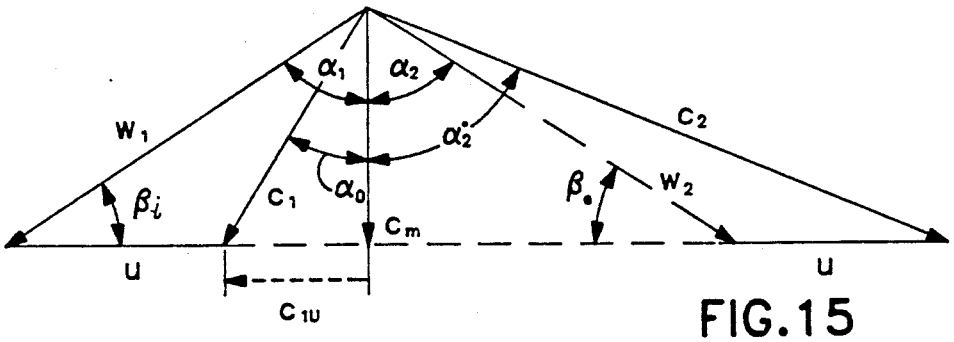
FIG. 15 shows a flow vector diagram for a blower using inlet guide vanes.

FIG. 15 is a flow vector diagram for a blower constructed in accordance with this invention which contains inlet guide vanes. As shown in FIG. 15, the absolute value of the angle $\alpha_1$ between the inlet velocity $w_1$ and the axial through flow velocity $c_m$ is approximately equal to the absolute value of angle $\alpha_2$ between the outlet velocity $w_2$ and the axial through flow velocity $c_m$.

It will be noted that the inlet guide vanes turn the flow against the direction of the circumferential velocity u. The inlet guide vanes also turn the flow in opposite direction to the impeller vanes.

Exit Guide Vanes

Flow Deceleration Through the Guide Vanes

Another important aspect of this invention is the use of appropriate exit guide vanes located downstream of the impeller blades. The exit guide vanes are used to turn the flow from the direction of the impeller discharge absolute velocity flow vector $c_2$ back to the direction of the entrance or exit velocity flow vector $c_1$ or $c_m$ through the angle $\alpha°_2$. In the process, the absolute flow undergoes a substantial flow deceleration from the values of $c_2$ to $c_m$.

It was found that new concepts and configurations of blades were needed to achieve the required high values of turning and flow deceleration without flow stalling and losses in efficiency. In order to obtain large flow deflections without losses, it was found necessary to give the flow leaving the impeller blades more guidance and better flow direction when entering the guide vanes. It was found that this could be accomplished by using stationary outlet guide vanes constructed in accordance with this invention. Stationary guide vanes constructed in accordance with this invention include a single row of blades or two or multiple rows of blades depending upon the amount of flow deflection $\alpha°_2$ and the value of flow deceleration from the flow vector $c_2$ to the flow vector $c_m$. The single row of guide vanes has a limit of flow deceleration of about 0.66 or higher values; the amount of flow deceleration is equal to the cosine of the flow angle $\alpha°_2$. The use of two rows in the guide vanes produces a flow deceleration up to a value of about 0.28 with a range of 0.28 to 0.66; the use of three rows in the guide vanes can produce a flow deceleration of about 0.15 with a range of 0.15 to 0.28.

Heretofore, the use of forward and aft blades in guide vanes separated by a slot has been known; however, such uses involved relatively small increases in flow deflections over conventional blades and corresponding small amounts of additional flow deceleration over conventional blades wherein the forward and aft parts of the blade operated as a single or combined blade with the slot being located in the aft half of the single or combined blade because that is the location where the largest deceleration of flow along the combined blade occurs. It has been found, however, that for large deflections and large amounts of deceleration of flow, the forward and aft blades must be so arranged that there will be two rows of blades separated by a substantial gap which is located in the forward part of the two blade rows. For example, the leading edge of this gap separating the two blade rows is preferably located downstream from the leading edge of "chord" for the combined blade, i.e., a line joining the leading edge of the forward blade and the trailing edge of a corresponding aft blade, e.g., see line 108 in FIG. 12, by an amount equal to about one fourth of the length of said "chord". Separation of the blades at this location makes the chord of the forward blade of the two rows of blade relatively short. By selecting a proper solidity for the forward row of blades, this configuration provides the needed guidance for the flow at the entrance to the cascade of guide vanes. This configuration of blades also allows at this forward location large values of flow deceleration which are needed for large angles of flow deflection. With the separation between two rows of blades located as defined above, the chord $ch_2$ of the aft row of blades is always larger than the chord $ch_1$ of the forward rows of blades. Thus, for a set of two rows of blades, it has been found that the following controls:

$$ch_2 \geqq ch_1 \tag{10}$$

Guide Vane Blade Solidity

Another important aspect of the guide vanes of this invention is the solidity of the blade system and of each of the rows of blades. As previously indicated, the solidity of the blades equals the chord of the blades divided by the tangential spacing of said blades. With constant blade chord from hub to tip, the solidity of the blades at the hub is greater than the solidity at the tip because the tangential spacing at the hub is smaller than the tangential spacing at the tip. Thus, solidity of axial flow blower guide vanes covers a range of values. For large deflections and related large flow decelerations, the solidity of each row of blades must be considered separately. The aft row of blades may also include part or half blades located between adjacent aft blades. For good guidance of the flow entering the guide vanes, the solidity of the first or forward row of blades $\alpha_1$, and the solidity of the second or aft row of blades $\sigma_2$ as well as part blades $\sigma_p$ shall have the following values:

$$\sigma_1 = 1.3 \pm 0.6 \tag{11}$$

$$\sigma_2 = 1.1 \pm 0.6 \tag{12}$$

$$\sigma_p = 1.1 \pm 0.6 \tag{13}$$

In accordance with this invention, exit guide vanes built according to equations (10)—(13) inclusive and related features have the following range of characteristics:

Flow deflection range: $\alpha^\circ_2 \geqq 49^\circ$

Flow deceleration range: $c_1/c_2 \leqq 0.66$

Distribution Of Flow Deflection and Deceleration in Multiple Row Guide vanes

Figure 6:
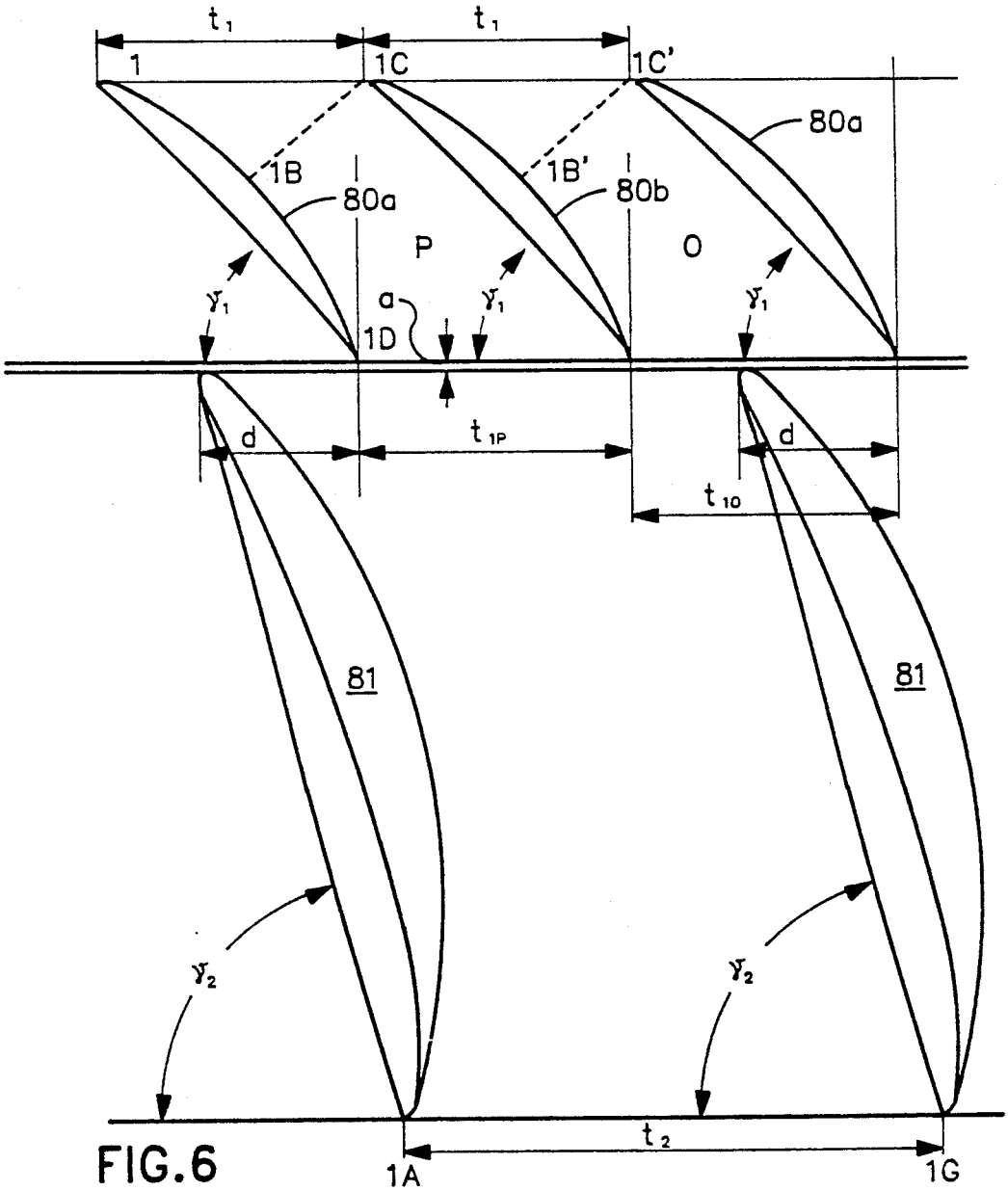
FIG. 6 shows a blade design for a two row guide vane in which the forward row has twice the number of blades as the aft row.

As shown in FIG. 6, the number of blades 80*a* and 80*b* in the forward row ($z_1$) equals twice the number of blades 81 in the aft row ($z_2$). As shown in FIG. 10, the number of blades 82 in the forward row ($z_1$) equals the number of blades 83 in the aft row ($z_2$) for the guide vanes. The number of blades used in the forward row will depend, in principal part, upon the amount of guidance required for the flow passing through the guide vanes in order to avoid stalling of the flow and associated losses in efficiency. As shown in FIGS. 6 and 10, the flow through the guide vanes has good guidance from the line or location 1C1B to the guide vane exit 1A–1G. However, on the upper side of the blades from location 1–1B, the flow is guided only by one side of the blade system, namely the upper surface of the forward blade 80 in FIG. 6 and the upper surface of the forward blade 82 and a portion of the aft blade 83 in FIG. 10. The distance 1—1B becomes larger with guide vanes for larger deflection angles $\alpha^\circ_2$ which require blades of larger camber. Where the same pitch $t_2$ exists for both aft blades such as aft blades 81 in FIG. 6 and aft blades 83 in FIG. 10, it will be noted that better flow guidance is provided by the use of twice as many blades in the forward row as in the aft row, see FIG. 6.

Figure 5:
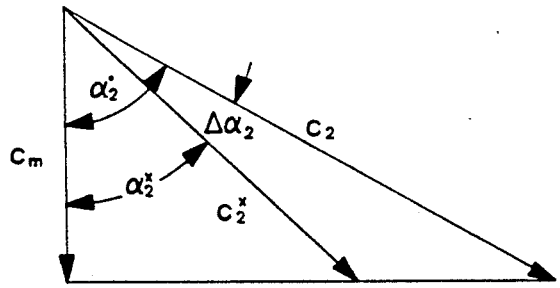
FIG. 5 is a vector flow diagram for a two row guide vane as shown in FIG. 6 showing the deceleration of flow through the forward and aft blade rows of the guide vanes.

Guide vanes constructed in accordance with this invention require attention be given to the distribution of flow deflection and deceleration both in the forward and aft rows of the guide vanes. FIG. 6 shows a two row guide vane configuration in which the number of blades in the forward row is equal to twice the number of blades in the aft row. FIG. 5 depicts the flow vector diagram for the guide vanes of FIG. 6. From FIG. 5, it is noted:

$$\cos \alpha^\circ_2 = c_m/c_2;\ c_2 = c_m/\cos \alpha^\circ_2 \tag{14a}$$

$$\cos \alpha^x_2 = c_m/c^{x2} = c_m/\cos \alpha^x_2 \tag{14b}$$

Thus, the deceleration in the first row equals $$c^x_2/c_2 = (c_m/\cos \alpha^x_2) \cdot \cos \alpha^\circ_2/c_m) = \cos \alpha^\circ_2/\cos \alpha^x_2 \tag{15}$$

The deceleration in the second row equals $$c_m/c^x_2 = \cos \alpha^x_2$$

If the same deceleration exists in both rows, then:

$$\cos \alpha^\circ_2/\cos \alpha_2{}^x = \cos \alpha_2{}^x \tag{16}$$

$$\cos \alpha^\circ_2 = (\cos \alpha_2{}^x)^2$$

$$\cos \alpha_2{}^x = \sqrt{\cos \alpha^\circ_2}$$

Since $\alpha^\circ_2$ is generally known and since it is assumed preliminary that there is equal deceleration in both rows (or in three rows with a three row guide vane), $\alpha^x_2$ can be found by equation (16) above. However, it is been found that equal deceleration in each row does not result in the best performance. Generally, the blades used in the forward row have much less camber than the blades used in the aft row. This causes the flow channels formed between the blades of the forward row to have less curvature than the channels formed between the blades of the aft row. Consequently, the forward blades have a different lift coefficient and different circulation than the aft blades. As a result, the velocity distribution is much more uniform within the forward row channels and at the discharge of the forward row blades as compared with the velocity distribution within and at the discharge of the aft row blades. These differences in velocity distribution permit more deceleration of flow in the forward row of blades, with corresponding lower deceleration values, as compared to the amount of flow deceleration which is permitted in aft row of blades. In other words, the flow through the aft row of blades will stall and have loss of efficiency at a predetermined value of deceleration when the forward row of blades is still performing well.

In order to obtain optimum performance, a correction is needed to the formula for equal deceleration in each row of guide vanes. The angle $\alpha^\circ_2$ is known and it is necessary to determine the values of deceleration in each row of the guide vanes. It has been found that the following formula gives the correct deceleration of fluid in the aft row of guide vane blades:

$$\text{Cos } \alpha_2^x = \frac{1}{A} \sqrt{\text{Cos } \alpha^\circ_2} \tag{17}$$

in which $\alpha^\circ_2$ equals the total angle that the guide vanes turn the flow from the direction of impeller discharge.

If B is designated as the degrees of $\alpha^\circ_2$ deflection above 49°:

$$B = \alpha^\circ_2 - 49 \tag{18}$$

then A is equal to or less;

$$1 - 0.005B \text{ or } 1 - 0.005(\alpha^\circ_2 - 49^\circ) \tag{19}$$

It has been found that above formula should be used in the range of $\alpha^\circ_2$ from 49° to 70°. Below a value of $\alpha^\circ_2 = 49°$, only one row of guide vanes is required. In the vicinity of 70° for $\alpha^\circ_2$ there is a limit for deflection of two row guide vanes. The correction factor in formula (17) must be larger when there is a larger difference in camber between the forward and aft rows or when the flow channel curvature becomes larger between forward and aft rows. Equations (17), (18) and (19) accomplish this requirement.

Example No. I:

$$\alpha^\circ_2 = 60^\circ; \quad \text{Cos } 60^\circ = 0.5000; \quad \sqrt{\text{Cos } 60^\circ} = 0.7071$$

With equal deceleration:

$$\text{Cos } \alpha^x_2 = 0.7071 \quad \alpha x_2 = 45.0^\circ; \quad \Delta_2 = 15^\circ$$

Second or aft row deceleration = 0.7483
First or forward row deceleration:

$$\frac{\text{Cos } \alpha^\circ_2}{\text{Cos } \alpha_2^x} = \frac{0.5000}{0.7071} = 0.7071$$

Using formula (17):

$$\text{Cos } \alpha_2^x = \frac{0.7071}{0.945} = 0.7483; \ \alpha_2^x = 41.6^\circ; \ \Delta\alpha_2 = 18.4^\circ$$

Second or aft row deceleration = 0.7483
First or forward row deceleration:

$$\frac{\text{Cos } \alpha^\circ_2}{\text{Cos } \alpha_2^x} = \frac{0.5000}{0.7483} = 0.6682$$

Example No. II:

$$\alpha^\circ_2 = 70^\circ; \quad \text{Cos } 70^\circ = 0.3420; \quad \sqrt{\text{Cos } 70^\circ} = 0.5848$$

With equal deceleration:

$$\text{Cos } \alpha^x_2 = 0.5848; \quad \alpha^x_2 = 54.21^\circ; \quad \Delta\alpha_2 = 15.79^\circ$$

Second or aft row deceleration = 0.7483
First or forward row deceleration:

$$\frac{\text{Cos } \alpha^\circ_2}{\text{Cos } \alpha_2^x} = \frac{0.3420}{0.5848} = 0.5848$$

In this case, angle $\alpha_{x2}$ is too large and the deceleration value of 0.5848 is too low for the aft row.

Using Formula (17):

$$\text{Cos } \alpha^\circ_2 = \frac{1}{A} \times \sqrt{0.3420} = 0.6534; \ \alpha_2^x = 49.20^\circ; \ \Delta\alpha_2 = 20.80^\circ$$

Second or aft row deceleration = 0.6534
First or forward row deceleration:

$$\frac{\text{Cos } \alpha^\circ_2}{\text{Cos } \alpha_2^x} = \frac{0.3420}{0.6534} = 0.5234$$

Spacing Between Blade Rows

There is some spacing between the impeller and the guide vane blade row. This spacing exists also in present axial flow blowers and there is data in the literature providing information for the value of this blade spacing in conventional blowers. In reassessing the values of this spacing for the turbomachine of this invention, it is important to understand the differences between conventional axial flow blower blades and the blades used in the turbomachine of this invention. The new impeller blades have a much larger deflection angle and consequently, have a larger camber than conventional axial flow blower blades. The spacing between impeller blade row and guide vane blade row is a function of the following characteristics: deflection angle; blade camber; deceleration or acceleration in the impeller blade channel; blade solidity; Reynolds number; boundary layer thickness at the impeller blade trailing edge and wake downstream of the blades. The impeller blades of this invention have more flow deflection within the blade channel and the blades have more camber. Both characteristics may require an increase in spacing between the impeller blades and the guide vanes when compared with conventional axial flow blower impeller blades. However, when compared to conventional axial flow blowers, the flow in the impeller flow passage has much less deceleration, perhaps zero deceleration or even acceleration. Thus, these flow conditions would indicate a possible decrease in spacing between the impeller blades and the guide vanes when compared with conventional axial flow blower impeller blades. The two phenomena described compensate their effect so that the spacing between impeller blade row and the guide vane blade row for a turbomachine of this invention can be selected to have about the same value as provided in the conventional axial flow impeller blade row and the blades in the guide vanes provided the flow deflection is in the moderate range and the blades are streamlined as shown in FIGS. 2 and 3.

The blade solidity also affects the spacing between the blade rows. Low blade solidity requires relatively more spacing between the blade rows because flow discharge velocity from the row of blades has a larger variation from a mean value. The Reynolds number should remain approximately constant for the high performance turbomachine of this invention and the conventional blower, for the same shaft speed and flow volume, but with the high performance turbomachine generating about 50% more pressure. Under high values of flow deflection and/or sheet metal blades and for low impeller blade solidity, the blade spacing between impeller row and guide vanes must be increased for the high performance turbomachine of this invention in order to provide early constant fluid flow velocity at the entrance to the guide vanes. More accurate spacing values between the impeller blades and the guide vane blade rows can be determined by calculating the boundary layer thickness at the trailing edge of the impeller blades and the associated values of the wake behind the impeller blades.

The spacing between impeller and guide vane blade rows should also be increased when there is a requirement to reduce noise levels. The improved noise levels are due to the improvement of the wake size and configuration but this increased spacing may result in increased fluid friction. Increase in solidity of the impeller blades permits a reduction in the blade spacing. When the guide vanes are provided with an adjustable forward blade row, additional axial space must be provided between the impeller blade row and the guide vane blade row. The additional axial space can be determined by a lay-out of a guide vane configuration which indicates the range of additional axial space which is required by movement of the forward blades of the guide vanes.

It is a part of this invention to provide for an increase in the spacing between the impeller and guide vane blade rows with large values of flow deflection, with the occurrence of flow deceleration in the impeller blade passage, and with relatively low blade solidity. Additional axial spacing will also be required for movable or adjustable forward blades of the guide vanes as described in FIG. 13.

Distance "a" Between Guide Vane Rows

The spacing between the forward and aft row of multiple guide vane blades is based on the same principles which have been described above with respect to the spacing between the impeller blades and the guide vanes. If the two rows of blades are located close to each other, the entire flow field must be considered.

This requires analysis and evaluation of the characteristics mentioned above for the aft row of blades as well as the forward row of blades. For two rows of blades located close to each other, the arrangement of the two blade rows, forward and aft blade row, is such that a flow is established from the lower side of the forward airfoil to the upper side of the aft airfoil. In that case, the velocity distribution of the discharge of the forward row of blades is nonuniform when entering the aft row of blades. In this arrangement, the flow from the forward blade is used for boundary layer removal at the aft blades. For moderate total deceleration and deflection, such as $c_m/c_2=0.64$ and the angle $\alpha^\circ_2 \approx 50^\circ$, this configuration is satisfactory as it provides the necessary deceleration and deflection at good efficiency in a short flow path. In that case, the overlap of the lower surface of the trailing edge of the forward blade relative to the upper surface of the aft blade is positive. The axial spacing a can be zero or may have small positive or negative values. In this arrangement, the forward and aft row of blades have the same number of blades. This configuration has a low solidity in the forward row of blades if their chord is shorter than the chord of the aft blades and is limited regarding the deceleration and flow deflection which can be achieved in the forward row of blades.

Figure 13:
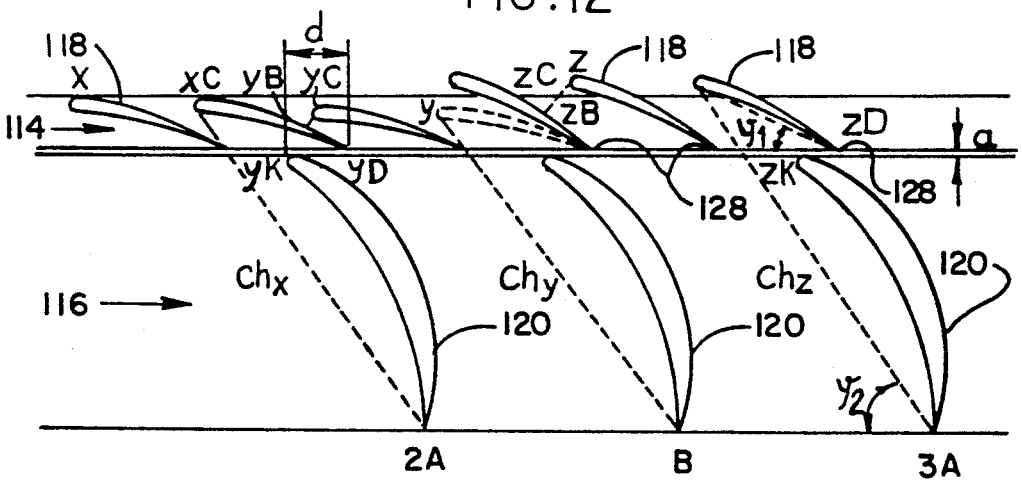
FIG. 13 shows a two row guide vane constructed in accordance with the present invention in which the number of blades in the forward row equals twice the number of blades in the aft row and each of the blades in the forward row is mounted for pivotal movement about a point located closely adjacent the trailing edge of each said blade.

For lower values of total guide vane flow deceleration $c_m/c_2$ than the value mentioned above and larger values of total flow deflection $\alpha^\circ_2$ in the guide vanes, the solidity of the forward row of the blades must be increased. In that case, forward and aft row of blades will have different numbers of blades. A special configuration is shown in FIG. 13 where the forward row of blades have twice the number of blades in the aft row ($z_1=2z_2$).

It is possible to have in each blade row an arbitrary number of blades as long as the forward row of blades has more blades than the aft row.

With an increased arbitrary number of blades in the forward row, being of a larger number than the blades in the aft row, the axial distance "a" must be increased so that the flow deceleration $c^x_2/c_2$ and flow deflection $\Delta\alpha_2$ in the forward blade row has reached its predicted value before the flow enters the aft row of blades. In order to reach its predicted value, a predetermined level of uniformity of discharge flow must have been reached from the forward row of the blades. With added increase of the number of blades in the forward row, two events can happen. First, the configuration shown in FIG. 14, an unsymmetric forward blade, is reached or, second, with increased blade number in the forward row, the configuration shown in FIG. 13, a symmetric forward blade, is reached. This will permit successively reduced flow velocities $c^x_2$ and increased flow deflection $\Delta\alpha^\circ_2$ as the blade solidity is increased.

With reduced values of flow deceleration and increased values of flow deflection, not only is the blade number of the forward row of blades increased relatively to the number of aft blades, but also the axial spacing "a" will be increased. With this increase of axial spacing "a", the overlap as aforedescribed can become negative. The number of blades in he forward and aft row are determined by their respective values of solidity which in urn is a function of the required deceleration of flow as presented in FIG. 18. In addition, the total value of the axial spacing "a" is also a function of the values of the forward row deceleration $c^x_2/c_2$, forward row deflection $\Delta\alpha_2$ and forward row solidity $\sigma_1$ together with the total guide vane flow deceleration $c_m/c_2$ and total flow deflection $\alpha^\circ_2$.

It is an aspect of this invention to provide for an increase in the axial spacing "a" between the forward row of blades and the aft row of blades of the multiple row guide vanes with reduced values of total guide vane deceleration $c_m/c_2$ and increased values of total deflection angle $\alpha^\circ_2$. The value of this axial spacing "a" is a function of the total deceleration $c_m/c_2$ and total deflection angle $\alpha^\circ_2$ as well as the forward row deceleration $c^x_2/c_2$, forward row deflection angle $\Delta\alpha_2$ and forward row solidity $\sigma_1$. For those values of total deceleration $c_m/c_2$, where the number of blades in the forward and aft row is equal or where a symmetric forward blade system is selected, the axial spacing a can remain relatively smaller. In this case, nonuniform values of discharge velocity $c^x_2$ can be accepted at the discharge of the forward row of blades and between blades in the circumferential direction.

Where two or more rows are included in the guide vanes, it has been found that a predetermined relationship between the axial separation of one row relative to the other and the circumferential spacing of the blades in each preceding or upstream row must be observed. Where the number of blades in the forward row equals the number of blades in the aft row ($z_1=z_2$), see FIG. 10, it has been found that the following relationship exists for the axial separation a between the trailing edges of the blades in the forward row and the leading edges of the blades in the aft row:

$$\pm 0.12\ ch2 \geqq a \geqq 0\ (\text{for } z_1=z_2) \tag{20}$$

Where the number of blades in the forward row is equal to or greater than 1.5 times the number of blades in the aft row ($z_1 \geqq 1.5\ z_2$), then the following relationship exists:

$$+0.12\ ch2 \geqq a \geqq 0\ (\text{for } Z_1 \geqq 1.5\ z_2) \tag{21}$$

Where the forward row has more blades than the aft row, negative values for "a" should not be used.

Variations in Forward Row Pitch

Were the number of blades in the forward row equals twice the number of blades in the aft row ($z_1=2z_2$) it has been found that there should be equal flow through both flow channels of the forward row. As shown in FIG. 6, the forward flow channel O is upstream of the leading edge of the aft blade 81. Forward flow channel P discharges into space between two adjacent aft blades. The discharge from forward channel O encounters more resistance than does the discharge from forward channel P. To overcome this difference, it has been found that an unequal pitch should be used with respect to alternating forward blades 80*b* in the forward row:

$$t_{10}=(1.1 \text{ to } 1.0)\ t_{1P} \text{ and} \tag{22a}$$

$$t_{10}+t_{1P}=t_2 \tag{22b}$$

Variations in Forward Row Angle of Attack

Where the number of blades in the forward row is equal to twice the number of blades in the aft row ($z_1=2z_2$), the same flow of equal quantity through both flow channels O and P, as set forth in equations (22*a*) and (22*b*) above, can be accomplished by having at the entrance of the forward row equal pitch in both forward flow channels O and P. However, at the aft end of the forward row, the pitch equals the formula stated in equations 22*a* and 22*b* above. This means there is a cyclic change in aft pitch and every second forward blade 80*b* has a slightly larger angle of attack as well as change in pitch so that the discharged amount of fluid from channels O and P and the distance "d" circumferentially between guide vanes rows velocity are approximately equal.

Referring again to FIG. 6, care must be taken to space the lower surface of the trailing edge of each alternate forward blade 80*a*, circumferentially with respect to the upper surface of each corresponding aft blade 81. Where the number of blades in the forward row is equal to the number of blades in the aft row ($z_1=z_2$), as exists in FIG. 10, this circumferential distance d is equal to or less than 0.33 times the pitch $t_2$ of the aft blades 83. Where the number of blades in the forward row is equal to twice the number of blades in the aft row ($z_1=2z_2$) as exists in FIG. 6, the circumferential distance d is the same for each alternate forward row blade 80*a*. Where the number of blades in the forward row is less than twice the number of blades in the aft row, the amount of circumferential distance d is the same for at least one circumferential distance d between each aft blade and the lower flow surface of a corresponding forward blade.

Number of Blades in Guide Vane Rows

In order to obtain optimum efficiency, the number of blades used in each row of the guide vanes cannot be arbitrary. In each case, it is possible to have the number of blades in the forward row ($z_1$) equal to twice the number of blades in the aft row ($z_2$). This has been found to be a desirable blade number because it reduces the distance 1-1B (1C-1B, see FIG. 6) by a substantial amount as compared to distance 1-1b found where $z_1=z_2$, see FIG. 10. It also leads to relatively more blades in the forward row and corresponding short blade chords for the blades in the forward row. In addition, blade numbers in the forward row of less than two but more than one have been examined. The results of this examination is shown in Table 1, Blade Number Analysis Number Matrix, which shows a number matrix which can be used to develop a formula and possible blade numbers for the forward row $z_1$ for a limited number of aft row blade numbers $z_2$. Based upon this examination, if the forward row needs a blade number of at least one more than contained in the aft row, but less than twice the number of blades in the aft row, it has been found that prime numbers are not to be used for the aft row blade number $z_2$:

$z_2 \neq$ prime number

TABLE 1

BLADE NUMBER ANALYSIS
NUMBER MATRIX

| | | | | | | | | | | | |
|---|---|---|---|---|---|---|---|---|---|---|---|
| | | | | | | FRACTIONS | | | | | |
| 2 | | | | | | $\frac{3}{2}$ | | | | | |
| 3 | | | | $\frac{4}{3}$ | | | | $\frac{5}{3}$ | | | |
| 4 | | | $\frac{5}{4}$ | | | $\frac{6}{4}$ | | | $\frac{7}{4}$ | | |
| 5 | | $\frac{6}{5}$ | | | $\frac{7}{5}$ | | $\frac{8}{5}$ | | | $\frac{9}{5}$ | |
| 6 | $\frac{7}{6}$ | | | $\frac{8}{6}$ | | $\frac{9}{6}$ | | $\frac{10}{6}$ | | | $\frac{11}{6}$ |
| 2 | | | | | | 1.50 | | | | | |
| 3 | | | | 1.333 | | | | 1.667 | | | |
| 4 | | | 1.250 | | | 1.50 | | | 1.750 | | |
| 5 | | 1.200 | | | 1.400 | | 1.600 | | | 1.800 | |
| 6 | 1.167 | | | 1.333 | | 1.50 | | 1.667 | | | 1.833 |
| | | | | | | BLADE NUMBER | | | | | |

TABLE 1-continued

BLADE NUMBER ANALYSIS NUMBER MATRIX

| $z_2$ | | | | | | $z_1$ | | | | | | $z_1 = 2z_2$ |
|---|---|---|---|---|---|---|---|---|---|---|---|---|
| 2 | | | | | | 3 | | | | | | 4 |
| 3 | | | | 4 | | | | 5 | | | | 6 |
| 4 | | | 5 | | | 6 | | | 7 | | | 8 |
| 5 | | 6 | | | 7 | | 8 | | | 9 | | 10 |
| 6 | 7 | | | 8 | | 9 | | 10 | | | 11 | 12 |
| 7 | | | | | | | | | | | | 14 |
| 8 | | | 10 | | | 12 | | | 14 | | | 16 |
| 9 | | | | 12 | | | | 15 | | | | 18 |
| 10 | | 12 | | | 14 | 15 | 16 | | | 18 | | 20 |
| 11 | | | | | | | | | | | | 22 |
| 12 | 14 | | | 16 | | 18 | | 20 | | | 22 | 24 |

Figure 11:
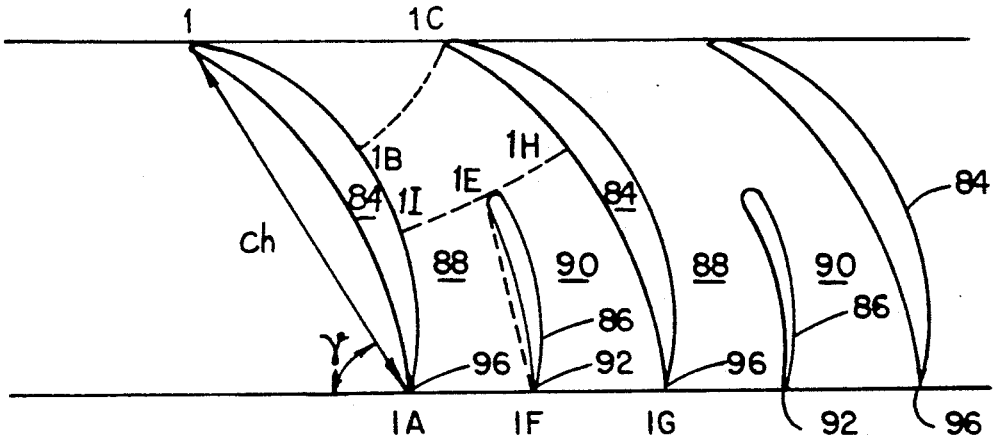
FIG. 11 shows guide vanes constructed in accordance with the present invention, said guide vanes including a plurality of half or part blades.
Figure 14:
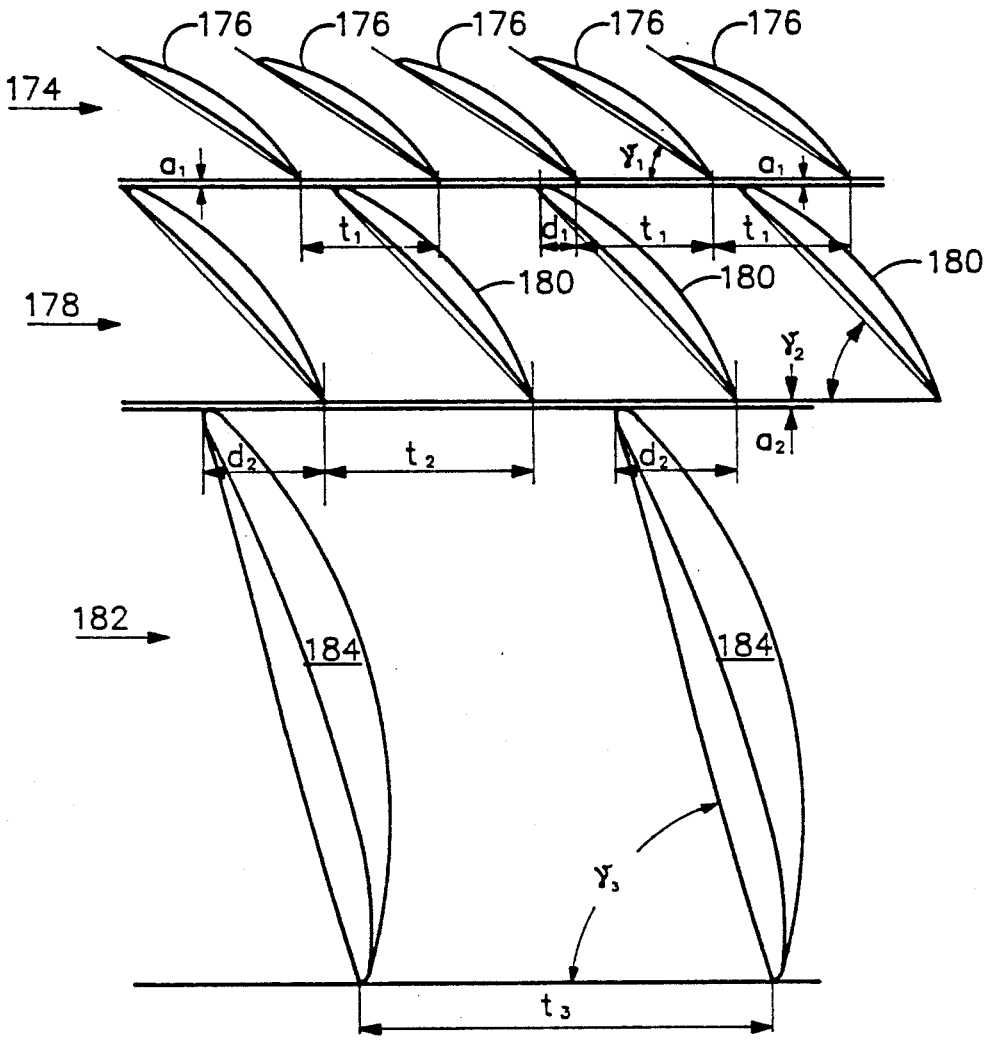
FIG. 14 shows a three row guide vane containing three rows of blades constructed in accordance with the present invention in which the number of blades in the first or forward row is equal to one and a half times the number of blades in the second or aft row and the number of blades in the first or forward row is equal to three times the number of blades in the third row.

Guide Vane Flow Deflection Angles and Numbers of Rows Used In the Guide Vanes As previously indicated, for flow deflection angles, in which $\alpha_2$ is less than 49°, a single row of solid blades in he guide vanes will perform the needed flow deflection and deceleration. For flow deflection angles $\alpha^{\circ}_2$ greater than 49° to about 70°, either two rows of guide vanes must be selected or a row of solid guide vanes having part or half blades disposed intermediate adjacent aft blades must be used, as shown in FIG. 11, disposed intermediate adjacent aft blades. Between 70° and 80° of guide vane deflection, three rows of guide vanes as shown in FIG. 14 must be selected; alternatively, two rows of guide vanes with part blades, as shown in FIG. 12 must be used.

In FIG. 11 is shown a set of guide vanes comprising a plurality of solid blades 84. Included within the guide vanes is a plurality of part or half blades 86. By positioning each part of half blade 86 intermediate adjacent solid blades 84, flow channels 88 and 90 having approximate equal amounts of flow and approximately equal rates of flow diffusion are formed between the aft part of adjacent solid blades 84. Each part blade 86 has a chord $ch_2$ equal to approximately one half times the chord of the solid blades 84. Each part blade 86 has a trailing edge 92 located on approximately the same axial line 94 as the trailing edge 96 of each adjacent solid blade 84. Each part blade 86 has a solidity equal to approximately $1.1 \pm 0.6$.

As shown in FIG. 11, the flow has good guidance from the line or location 1c1b to the guide vane exit at 1A—1G. Through use of the part blades 86, the tangential spacing between adjacent solid blades 84 is reduced by one half; thus, the use of part blades 86 increases the solidity $\sigma$ of the flow channels 88 and 90. For the guide vanes shown in FIG. 11, the part blades 86 have a solidity $\sigma_p = 1.67$ and the solidity $\sigma$ of the solid blade 84 equals 1.67 without the part blades. On the upper surface of one solid blade 84 from location 1—1B, the flow is guided only by the upper surface of the solid blade 84. The distance 1—1B becomes larger with guide vanes used for large deflection angles $\alpha^{\circ}_2$ which require blades of large camber. Since the part blades 86 form channels 88 and 90 that carry equal amounts of flow and have about equal rates of flow diffusion or flow deceleration, the part blades 86 avoid flow stalling and associated losses in efficiency in the aft part of the flow channel through the solid blades 84 as shown in FIG. 11.

Figure 12:
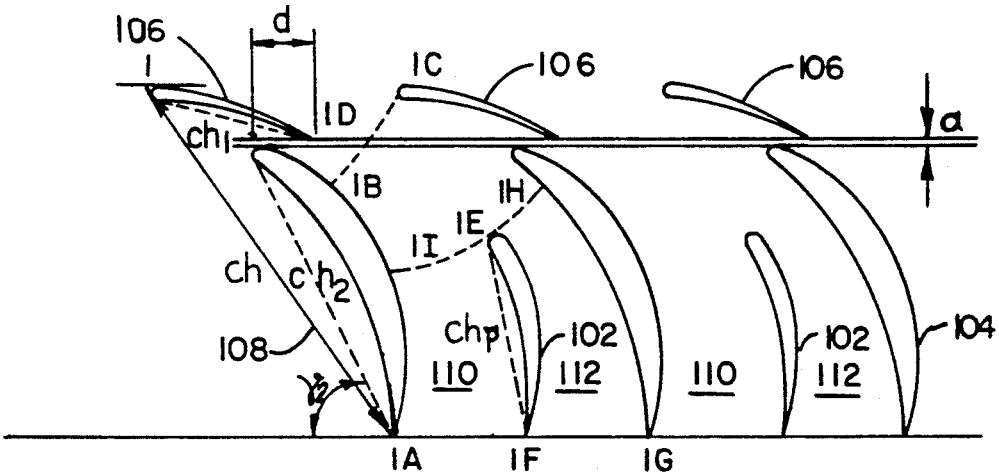
FIG. 12 shows a two row guide vane constructed in accordance with the present invention including a plurality of half or part blades.

For larger values of guide vane flow deflection and related flow deceleration, it is necessary to use guide vanes having forward and aft rows as well as part blades, see FIG. 12. The guide vanes in FIG. 12 include two rows of blades, a forward row 98 and aft row 100. Part blades 102 are disposed intermediate the aft part of adjacent aft blades 104. In FIG. 12, the number of blades 106 in the forward row is equal to the number of blades 104 in the aft row. In accordance with formula (20) the forward row of blades 98 is axially separated from the aft row of blades 100 by an amount "a", i.e., in which $\pm 0.12\ ch_2 \geqq a \geqq \theta$. The solidity and chord of the part blades 102 have the same relationship to the aft blades 104 as does the solidity and the chord of the part blades 86 to the solid blades 84 shown in FIG. 11. The circumferential distance d between the leading edge of each aft blade 104 and the trailing edge of the forward blade 106 nearest the upper surface of said aft blade 104 is equal to or less than approximately one-third times the pitch ($t_2$) of the aft blades 104. In FIG. 12 is shown a line 108 which would be representative of the combined chord for an aft blade 104 and a corresponding forward blade 106. With the chord length of the blades 106 in the forward row 98 substantially smaller than the chord length of the blades 104 in the aft row 100, as shown in FIG. 12, the leading edge of each aft blade 104 is located approximately one-third the length of the chord line 108 downstream of the "leading edge" of said chord line 108. The part blades 102 form flow channels 110 and 112 between adjacent aft blades 104. The flow channels 110 and 112 have similar characteristics to the flow channels 88 and 90 of FIG. 11.

Turbomachine Design and Performance Data

Figure 16:
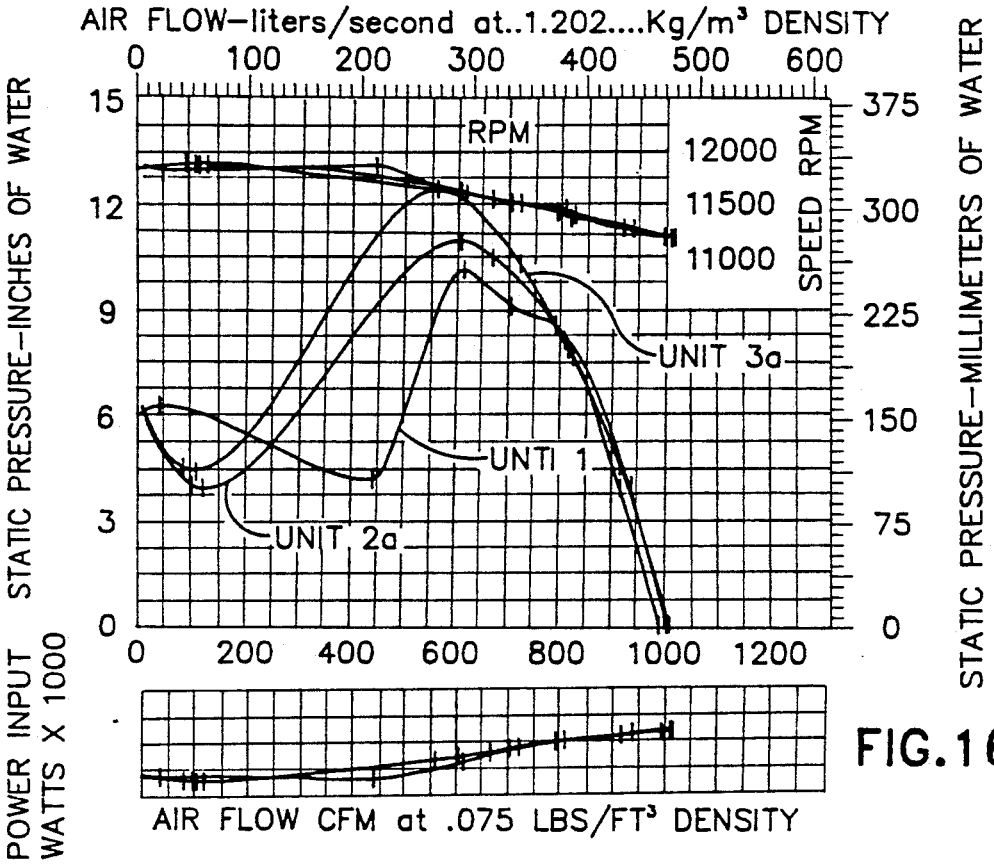
FIG. 16 shows static pressure versus flow volume for three different blowers two of which are constructed in accordance with this invention.
Figure 17:
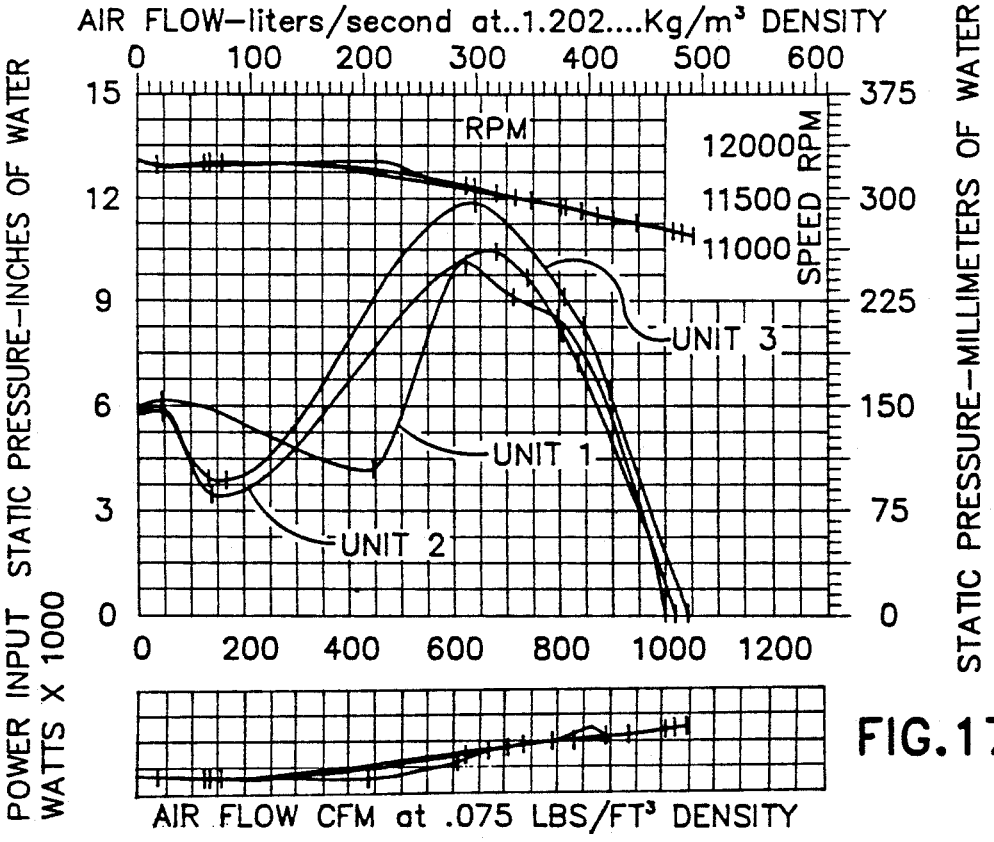
FIG. 17 shows the performance data of static pressure versus flow volume for the same three blowers shown in FIG. 16 except that the stagger angle in the forward row of blades for the two blowers constructed in accordance with this invention has been decreased by 10°.

Test results made on a blower constructed in accordance with this invention are shown in FIGS. 16 and 17. A two row guide vane configuration was used in the blower. The blower was driven by 400 cycle electric motor operating at about 11,500 rpm. The blower impeller had a tip diameter of 4.9 inches and a hub diameter of 3.5 inches. In the guide vanes, the required flow deflection $\alpha^{\circ}_2$ varied from 50.9° at the hub to 45.1° at the tip. These guide vane deflection requirements permitted the use of sold guide vanes since the maximum deflection is near the upper limit for solid blades. Thus, tests were made with a plurality of single solid blades, with two rows of blades having the same number of blades in each row and with two rows of blades having twice the number of blades in the forward row as compared to the aft row. The high camber single blade was NACA 652710 from the 65 series. The blade used in the forward row for the two row guide vane configuration in which the number of blades in the forward row was the same as the number of blades in the aft row, was NACA 651812 from the 65 series. The forward blade used in the two row guide vane configuration having twice the number of blades in the forward row as in the aft row, was NACA 650912 from the 65 series. The aft blade used in the two row guide vane configuration in each case was NACA 651710 from the 65 series. Tests were also made for each two row guide vane configuration in which the stagger angle $\gamma$ of each forward blade was changed to a $\pm 5°$. In order to reduce manufacturing costs, all guide vanes were of constant chord length and straight from hub to tip. The blower utilizing a plurality of single, solid blades is identified in FIGS. 16 and 17 as Unit 1. The blower using the two row guide vane configuration in which the number of blades in the forward row and the aft row are the same is shown in FIG. 16 as Unit 2*a* and in FIG. 17 as Unit 2. The two row guide vane configuration in which the number of blades in the forward row is equal to twice the number of blades in the aft row is shown in FIG. 16 as Unit 3*a* and in FIG. 17 as Unit 3. Units 2*a* and 3*a* have the stagger angle of the forward air foil increased by 10° as compared to the stagger angle of the forward blade in Units 2 and 3. All tests were made with the same impeller. All three sets of guide vanes had the same free flow capacity of about 1000 CFM. Details of the design of the three systems and basic test data are presented in Table 2.

lowest solidity in the forward row, intermediate solidity in the aft row and intermediate air foil camber in both rows. The two row guide vane configuration (Unit 3) having twice the number of blades in the forward row as in the aft row, shows by far the best performance of all Units 1 to 3. Unit 3 shows the highest values of static and total pressure with essentially the same volume flow as Units 1 and 2. Unit 3 has the largest total blade length, the largest total blade area, intermediate solidity in the two rows of blades and the lowest cambered blade in the front row.

Due to the high pressure coefficient for the blower of this invention, the pressure-flow characteristics, see FIGS. 16 and 17, show the typical dip in the pressure flow curve. However, it will be noted that Units 2 and 3 show a much improved pressure-flow characteristic in the range below the maximum pressure over Unit 1. Unit 3 shows not only higher pressure values but it also has a much improved operating range. Since Unit 3 requires the same power input as Unit 2, Unit 3 has a substantially better efficiency due to its higher pressure performance.

As previously indicated, Units 2*a* and 3*a*, as shown in FIG. 16, are similar to Units 2 and 3 except that the

TABLE 2

PERFORMANCE DATA - UNITS 1-3
TEST SUMMARY

| UNIT NUMBER | NUMBER OF GUIDE VANE ROWS | FORWARD CHORD LENGTH $CH_1$ INCH | AFT CHORD LENGTH $CH_2$ INCH | TOTAL CHORD LENGTH CH INCH | FORWARD AIRFOIL NUMBER | AFT AIRFOIL NUMBER | FORWARD SOLIDITY AT HUB $\sigma_1$ |
|---|---|---|---|---|---|---|---|
| 1 | 1 | 4.125 | — | 4.125 | 4 | — | 1.50 |
| 2 | 2 | 1.375 | 2.750 | 4.125 | 5 | 5 | 0.625 |
| 3 | 2 | 1.375 | 2.750 | 4.125 | 10 | 5 | 1.250 |

| UNIT NUMBER | AFT SOLIDITY OF HUB $\sigma_2$ | BLADE HEIGHT INCH | FORWARD TOTAL BLADE LENGTH INCH | AFT TOTAL BLADE LENGTH INCH | TOTAL BLADE LENGTH INCH | BLADE AREA TOTAL $INCH^2$ | FORWARD BLADE PROFILE |
|---|---|---|---|---|---|---|---|
| 1 | — | 0.700 | 16.50 | — | 16.50 | 11.550 | 652710 |
| 2 | 1.25 | 0.700 | 6.875 | 13.750 | 20.625 | 14.438 | 651812 |
| 3 | 1.25 | 0.700 | 13.750 | 13.750 | 27.500 | 19.250 | 650912 |

| UNIT NUMBER | AFT BLADE PROFILE | MAXIMUM STATIC PRESSURE $P_s$ INCH W.C. | MAXIMUM FLOW Q CFM | TOTAL PRESSURE AT MAXIMUM EFFICIENCY $P_t$ INCH W.C. | MAXIMUM EFFICIENCY Q CFM |
|---|---|---|---|---|---|
| 1 | — | 10.1 | 1010 | 10.38 | 650 |
| 2 | 651710 | 10.45 | 1026 | 10.94 | 700 |
| 3 | 651710 | 11.88 | 1043 | 12.27 | 670 |
| | | Same as Above - Have Stagger Angle of Forward Airfoil Increased + 10 Degrees | | | |
| 1 | | 10.10 | 1010 | 10.38 | 650 |
| 2A | | 11.0 | 1013 | 11.28 | 650 |
| 3A | | 12.4 | 995 | 12.63 | 625 |

From the data in Table 2, it will be noted that the blower using a plurality of single, solid blades has the smallest number of blades, the shortest length of all blades combined in the smallest total blade area. This blower also has the highest blade solidity and it is the blade with the highest camber. However, the performance of Unit 1 was well below the other two blowers as shown in FIGS. 16 and 17. The two row guide vane configuration (Unit 2) having the same number of blades in the forward and aft rows, shows substantial improvement in static and total pressure over the blower using a plurality of single, solid blades (Unit 1). Unit 2 has increased total blade length and increased blade area when compared with Unit 1. Unit 2 has the stagger angle of the front row of blades is increased by 10° for Unit 3*a* in FIG. 16 as compared to Unit 3 in FIG. 17. The data shown for Unit 1 in FIG. 17 is the same data as shown for Unit 1 in FIG. 16. As shown in FIGS. 16 and 17, Unit 1 has a very narrow operating range near its maximum static pressure and shows irregular pressure characteristics outside its narrow operating range. Unit 2 shows a greatly improved operating range compared to Unit 1 and a higher maximum static pressure. Unit 2 shows that the location of the maximum static pressure and of the maximum efficiency occur at an 8% larger flow as compared to Unit 2*a*. Unit 3*a* shows the best performance. Unit 3*a* has the largest static pressure, the largest operating range and best efficiency since its power input is identical or slightly below the power input for Unit 2a. Unit 3a shows improved performance compared to Units 1 and 2a over most of the flow range. Both Units 2a and 3a indicate a small decrease in flow capacity over the entire range of performance as compared to Units 1-3 as shown in FIG. 17. Based upon the tests of Units 1-3, it is clear that Unit 3 is superior to Units 1 and 2 because it generates more pressure and shows improved performance over most of the pressure-flow characteristics. Also, by changing the angle of the forward blades, minor modifications in pressure-flow characteristics can be made. Unit 3 has the largest blade area of the three systems, the lowest cambered blade in the forward row and medium solidity in both rows.

Automatic Adjustment of Pressure and Flow Velocity

An automatic control system, using adjustable guide vanes, applies to the turbomachine of this invention, including both axial and centrifugal blowers. The axial flow machine includes mixed flow blowers discharging into guide vanes essentially in an axial direction. The centrifugal blowers include mixed flow blowers discharging into vaned diffusers essentially in a radial direction.

The performance of the axial flow blower constructed in accordance with this invention and its control are substantially different from conventional axial flow blowers. The difference in performance is due to the fact that the impeller blades are forwardly curved and provide a substantial flow deflection within the impeller blades. Thus, the axial flow blower of this invention is able to provide substantial performance changes by adjusting the impeller blades. A small rotation of the impeller blades will substantially increase or decrease the generated pressure. The axial flow blower of this invention has within the impeller blades essentially constant pressure. In designing an axial flow blower of this invention, the flow field is selected and the flow velocity is maintained substantially constant or with small amounts of flow acceleration or deceleration in part of the impeller blades. As a result of using essentially constant velocity, the impeller blades can be turned over a certain range and the flow will not stall since the impeller blades can operate over a wide range of angle of attack particularly with a slightly accelerating flow within the impeller blades. The turned impeller blades will no longer provide a symmetric flow vector diagram; however, the same impeller blades, operating with a nonsymmetric flow vector diagram, can provide more pressure when turning the blade trailing edge in the direction of the impeller rotation and they can provide less pressure when turning the blade trailing edge against the direction of the impeller rotation. Large blade rotation can be achieved without flow stalling provided there is substantially no flow deceleration in the impeller blades. Thus, large changes in pressure can be generated when compared to conventional blowers. However, adjusted impeller blades require associated changes in the guide vanes depending on the required deflection angle $\alpha_2$. The guide vanes must match the requirements of the deflection angle $\alpha_2$. This can be done by providing a separate set of guide vanes or by adjusting the guide vanes by turning the forward row of blades of the multiple blade guide configuration. Since the blower of this invention generates practically all of the pressure in the guide vanes while the impeller blades generate substantial changes in velocity, the use of this guide vane adjustment feature is of great advantage to a turbomachine constructed in accordance with this invention.

The design of a turbomachine constructed in accordance with this invention is characterized by the fact that a small change in flow deflection angle of the guide vanes covers a large range of pressure flow characteristic of the turbomachine. For example, for a flow coefficient 1.0, the guide vane flow deflection angle $\alpha\Phi = {}_2 = 63.4°$ and for a flow coefficient $\Phi = 0.5$, the guide vane flow deflection angle $\alpha_2 = 76.0°$. Thus, for a blower flow change of 50%, i.e., reducing the flow coefficient from 1.0 to 0.5, the guide vane flow deflection angle $\alpha_2$ changes only 12.6°, i.e., from 63.4° to 76.0°. Since the dischargefrom the guide vanes is always in the direction of the axial through-flow, $c_m$, a change in flow direction requires only a change in guide vane inlet angle since the flow exit angle remains constant. Thus, small changes in guide vane blade inlet angle will cover the entire range of flow for the turbomachine of this invention.

The change in guide vane inlet angle is accomplished by turning all forward blades of the first row of blades of the multiple blades. The forward blades are turned about a point located closely adjacent their trailing edge. This turning movement can be done manually or automatically. The automatic control is accomplished by providing a sensor, measuring the flow, a servomechanism providing the power to turn the blades and the turnable blades. The sensor can be a pitot tube or similar measuring device. The sensor can also be a measuring system on the forward blade itself, such as two static holes. They can measure a pressure difference if the flow entering the forward blade has an incorrect flow entrance angle and they can call for an adjustment. The servomechanism can be an electric motor or similar device controlled by the sensor. The servomechanism will move the structure which initiates the turning of all the forward blades. The servomechanism can also be a hydraulic or pneumatic device which uses the pressure energy generated by the turbomachine to move the structure which initiates the turning of all forward blades. There is a control valve, energized by the sensor, which can adjust the turning of the forward blade automatically to the correct amount. In this turbomachine, the changes of flow in the impeller blades occur at essentially constant pressure and nearly constant velocity. Therefore, the flow will adjust easily to changes in deflection angle because the turning movement of the blade occurs essentially at constant pressure. Large decelerations of flow and large deflecting angles occur in the guide vanes. Thus, one means to adjust guide vane performance to changes in impeller discharge flow and to avoid large losses in efficiency is to effect blade adjustments by turning the forward blade and regulating the blade inlet angle. These needed changes in inlet angle and deflection angle are accomplished automatically as described above.

Figure 13A:
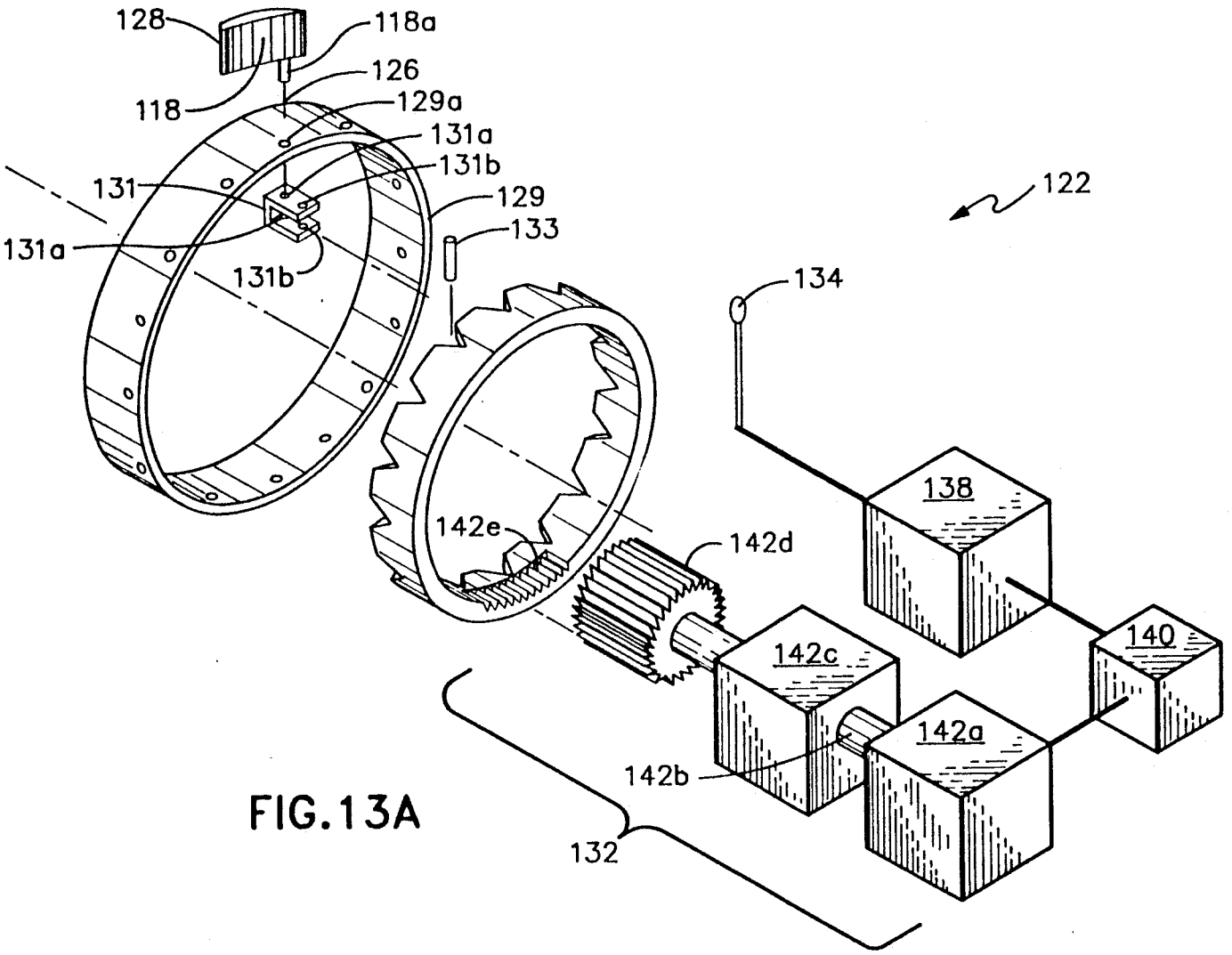
FIG. 13A is a schematic view, in partial cross section, showing a means for adjusting pressure and flow velocity through a blower or pump.

FIGS. 13 and 13a show a two-row guide vane having a forward row 114 and aft row 116 of blades. The number of blades 118 in the forward row equals twice the number of blades 120 in the aft row ($z_1 = z_2$). The relationships between the blades 118 in the forward row with respect to the blades 120 in the aft row is similar to the relationships between corresponding blades as discussed above with respect to FIG. 6. However, it will be noted that each of the blades 118 in the forward row of stationary guide vanes includes means 122 for adjusting pressure and flow velocity through the blower or pump during operation thereof at a predetermined speed of rotation. The means 122 includes means for mounting each of the forward blades 118 for pivotal movement about a point 126 located closely adjacent the trailing edge 128 of each blade 118 of the forward row 114. The means 122 also includes means for pivoting each forward blade 118 about said point 126 thereby changing the angle of attack of the forward row of blades 114 and changing the flow deflection of the forward blade and its corresponding aft blade. The means 130 for pivoting each forward blade 118 includes a servomechanism 132 mounted to effect, upon activation thereof, pivotal movement of each forward blade 118 about said point 126, means 134 for sensing, during operation of the blower or pump, a condition of flow (such as velocity and/or pressure) produced by the blower or pump and generating a signal in response thereto, means 138 for comparing the generated signal with a predetermined signal and generating a signal proportional to the differential thereof, means 140 for using the differential signal to actuate the servomechanism 132, and means 142 for causing the servomechanism 132 to rotate each blade 118 in the forward row by an amount proportional to the differential signal so generated thereby changing the angle of attack of each forward blade, said servo mechanism actuating means including a motor 142*a*, a drive shaft 142*b*, a gear box 142*c*, a pinion gear 142*d* and a spur gear 142*e*. As shown in FIG. 13A, the blade 118 has a shaft portion 118*a* that extends through an opening 129*a* formed in the annular or hub member 129 and through a pair of openings 131*a* formed in the clevis 131. The shaft portion 128*a* is suitably splined or keyed (not shown) so as to rotate when the clevis 131 is rotated by the ring gear 142*e*. A pin 133 extends through the pair of openings 131*b* formed in the clevis 131 and a corresponding v-shaped slot formed in the ring gear 142*e*. As shown in FIG. 13A, rotation of the ring gear 142*e* clockwise will cause the blade 118 to rotate counterclockwise. Thus, FIGS. 13 and 13*a* show adjustable guide vanes designed as a multiple blade with symmetric forward blade arrangement for an axial flow blower.

In FIG. 13, the forward blades 118 are shown in their standard or normal position x which corresponds to the blower performance at the design point. When the forward blades 118 are moved to position y, this corresponds to a condition of lower-than-normal capacity. When the forward blades 118 are moved to a position z, this corresponds to a condition for a larger-than-normal flow capacity. It will be understood that positions y and z for forward blades 118 are two extreme positions of such blades and indicates the relatively small turning angle of the forward blades 118. As previously mentioned, FIG. 13 shows that the forward blades 118 are turned about an axis or point 126 located closely adjacent the trailing edge 128 of each blade 118 of said forward row 114. Pivoting each forward blade 118 about its respective point 126 is done to provide proper dimensioning of the transition from the forward to the aft blade row at locations yK—yD and zK—zD. It will be noted that the chord $ch_x$ of each aft blade 120 and a corresponding forward blade 118 becomes shorter, namely $ch_y$, with the forward blade 118 in position y for small capacity, and becomes longer, namely $ch_z$, with the forward blade in position z for very large capacity when compared with the chord ch for the standard position as shown in FIG. 13. Similarly, the distance, yC—yB, between adjacent forward blades becomes smaller when the forward blade is in position y for smaller-than-normal capacity. The distance separating adjacent forward blades becomes larger, zC—zB, for the forward blades in position z for larger-than-normal capacity. It will be noted that the multiple blade with the forward blade in position y has a larger camber for the "combined" blade, i.e., each aft blade 120 and its corresponding forward blade 118. In addition, the multiple blade with the forward blade in position z has a smaller camber for the "combined" blade, i.e., each aft blade 120 and its corresponding forward blade 118, when the forward blade is in position x. The solidities of the multiple blade shown in FIG. 13 are as follows:

Forward Row $\sigma_1 = 1.33$

Aft Row $\sigma_2 = 1.33$

Combined Blade Solidity $\sigma = 1.67$ (in position x)

It will be noted that, with the adjustment of the forward blades 118 as shown in FIG. 13, the solidities of forward row and aft row do not change. However, the solidity of the "combined" blade of each aft blade and its corresponding forward blade will change with adjustments of the forward blade because the "combined" chord changes with adjustments of the forward blade. For the forward blade adjustment shown in FIG. 13, the solidities of the aft blade and its corresponding forward blade are as follows:

Position x: Combined Blade Solidity = 1.67

Position y: Combined Blade Solidity = 1.60

Position z: Combined Blade Solidity = 1.74

The blower of this invention with its capability to operate with very high pressure coefficients will have small diameters for a fixed pressure and consequently can be manufactured at low cost. The ability to adjust the stationary guide vanes will permit operation at high efficiency over a wide range of flow capacity. This feature cannot be achieved with conventional technology. In addition, the blower will operate at a very low noise level. The low noise level is due to the special impeller blades and guide vanes both of which have a very large flow deflection angle. Thus, the sources of noise are prevented from leaving the casing of the blower. In addition, by adjusting the guide vanes, the noise level can be kept at its low amount over a very wide range of flow and pressure.

The low shaft speed together with the low specific speed permit this blower to operate in performance ranges where axial flow machines cannot now operate. The blower can use a diffuser 74, see FIG. 1, at the discharge from the guide vanes in order to transform the remaining kinetic flow energy into pressure. The above-described combination of new concepts offer opportunities to use low-cost axial flow blowers in areas where same could not be previously used.

The adjustment of the multiple blade system by rotating the forward blades about an axis or point near their trailing edges is also applicable for centrifugal blowers. It will be understood that centrifugal blowers can have impeller blades with backwardly curved, radially ending or forwardly curved blades and their guide vanes provide flow deceleration with corresponding pressure increase. Thus, the adjustability of the multiple blade system or changes in flow inlet angle and combined blade camber offer entirely new performance characteristics for both axial and centrifugal blowers and these new performance characteristics can be achieved automatically.

Guide Vane Solidity and Maximum Deceleration Through Said Guide Vanes

Figure 18:
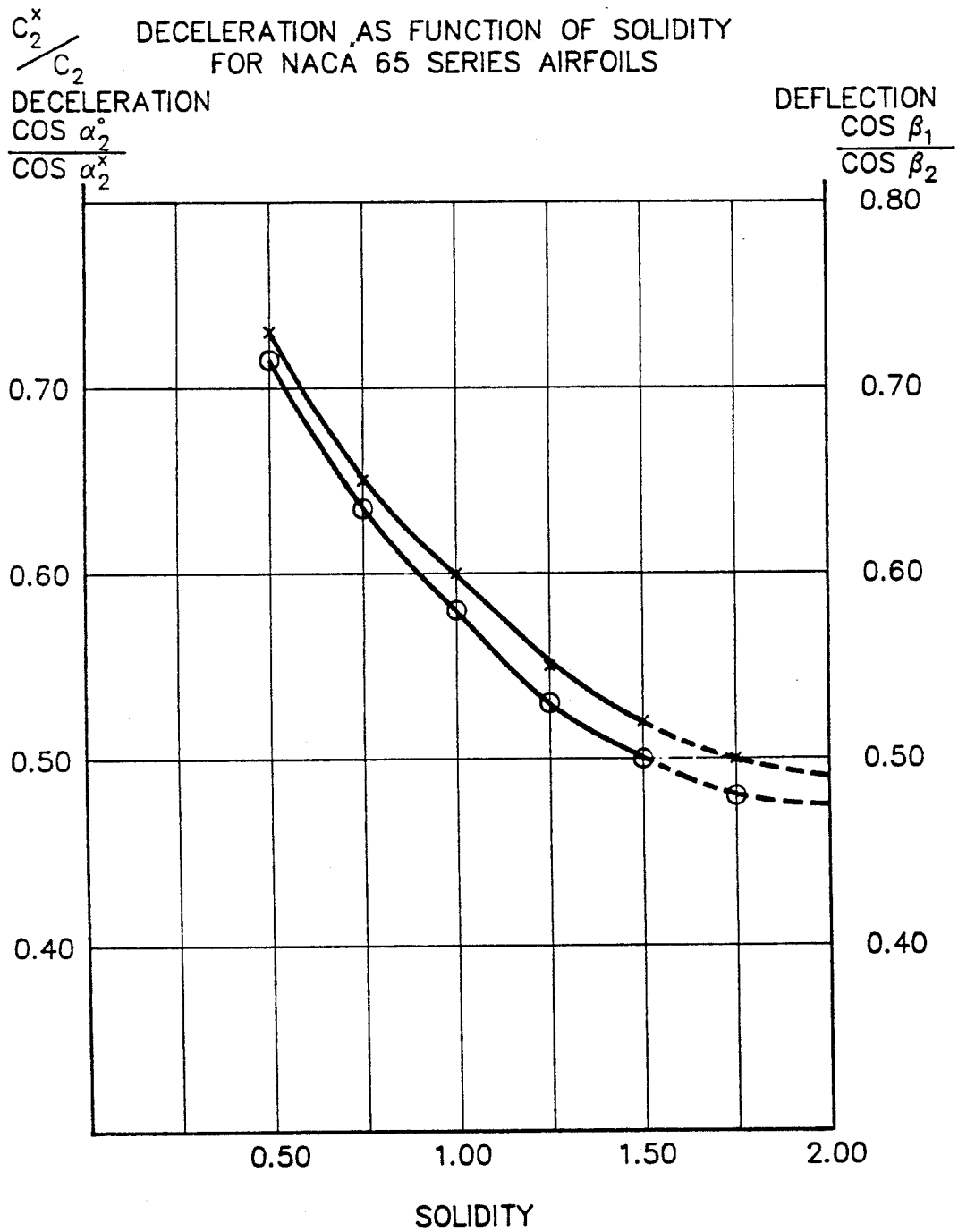
FIG. 18 is a graph showing the maximum deceleration of flow obtainable from guide vanes expressed as a function of the solidity of the blades.

In designing guide vanes to be used in a blower constructed in accordance with this invention, it is important to know the limits of flow deflection and deceleration for various blades. An analysis of a large number of axial flow blower blades, showed that the limits of flow deflection in the terms of flow angles as functions of entrance angle $\alpha_2$, solidity $\sigma$ and blade profile configuration are quite complex as indicated in the many diagrams contained in the publication by Herrig, L. J., Emery, J. C., Erwin, J. A., NACA Technical Note 3916, "Systematic Two-Dimensional Cascade Tests of NACA 65-Series Compressor Blades at Low Speeds", Feb., 1957. It has been found, however, that the maximum flow deceleration in the guide vanes is essentially a function of blade solidity and it is nearly independent of flow inlet angle and blade configuration. In this connection, it is important to consider the fact that with increasing flow inlet angle, the guide vane camber must be reduced and the flow deflection angle decreases. FIG. 18 shows the maximum amount of flow deceleration as a function of solidity for guide vanes. It shows the limit of flow deceleration which can be achieved without stalling. On the left hand ordinate of FIG. 18 is shown the nomenclature which is used in this specification. On the right hand ordinate is shown the nomenclature for flow deceleration which is used in prior art literature. It is noted that the values of deceleration are indicated in FIG. 18 as narrow band and not as a single line.

The values of deceleration as a function of solidity can be applied to each part of the multiple blade rows used in the guide vanes. Thus, FIG. 18 forms the basis for design of such guide vanes. It also forms the basis of gap width and chord length within the multiple blade configuration or the relative position of forward and aft blades as a part of the multiple blade rows.

Referring again to FIG. 18, it will be noted that for flow entrance angles less than 49°, the data of FIG. 18 does not apply. The reason for this is the fact that the limit of deceleration will not be reached, particularly for high solidity, i.e., values on the order of $\sigma=1.0$–$1.5$.

For a guide vane blade configuration in which the same number of blades are used in the forward and aft rows, the blade chord of the forward blade is preferably shorter than the chord of the aft blade, for example, with a guide vane blade configuration like that shown in FIG. 12, excluding the part blades 102, the solidity of the forward blades may equal 0.665 and the solidity of the aft blades may equal 1.33. The methodology of guide vane designs consist in determining the maximum inlet angle and deflection that the multiple blade can achieve with the above solidities. It is always possible by reducing blade camber and/or solidity to design for less inlet angle and deflection. The total inlet angle is determined by analyzing separately the forward blade and the aft blade performance and then combining both. In the above case, with an aft blade solidity of 1.33, the maximum deceleration, from FIG. 18, equals approximately 0.530 and the corresponding deflection equals 58.0°. For a forward blade solidity of 0.665, the maximum deceleration equals approximately 0.680. The corresponding deflection $\Delta\alpha_2=11.4°$. Accordingly, the total deflection equals $\alpha_2=69.4°$. This is the maximum deflection for the solidities of forward and aft blade shown in FIG. 12 (excluding the part blades 102). In this specific case, if more total deflection is required, it will be necessary to increase the chord of the forward blade with changes in the gap location of the multiple blade or the relative position of forward and aft blade. This will result in increased solidity and chord of the forward blade. Due to the characteristics of deflection as a function of solidity, as shown in FIG. 18, increased deceleration and associated increased deflection will result. Thus, the final axial space a and chord of the forward and aft blade is determined by using FIG. 18 for analysis of combined deceleration and associated flow deflection.

For the blade configuration shown in FIG. 13, there are twice as many blades in the forward row 114 as in the aft row 116. For the forward blades 118, solidity equals the solidity of the aft blades 120, i.e., $\sigma_1=\sigma_2=1.33$, the maximum deceleration in the aft blades 120 equals 0.530 and the corresponding deflection equals $\alpha^x_2=58.0°$. The forward blade 118 permits a maximum deceleration of 0.530 with a corresponding deflection of $\Delta\alpha_2=15.7°$. Accordingly, the total deflection $\alpha^\circ_2$ equals 73.7°. This is the maximum deflection for the solidity in the forward and aft blade shown in FIG. 13.

The data for FIG. 18 were taken from cascade tests with uniform velocity of blade entrance. As previously indicated, for a blower there is three dimensional flow at the impeller blade discharge and the entrance velocity into the guide vanes is not constant. Thus, the maximum deceleration (and associated deflection values) will be up to 5% below the maximum values as shown in FIG. 18. This reduction factor of 5% or less, can be estimated on the basis of the degree of flow uniformity at the guide vane entrance, as discussed above.

It will be noted that the data of FIGS. 18 directly effects the guide vane performance of the multiple blade system. By increasing or decreasing the axial space "a", variations in the flow discharge velocity at the forward row an be accommodated. This, together with selecting the proper blade solidity, permits optimizing the performance of the multiple blade guide vane for maximum efficiency according to FIG. 18. Thus, the location of the forward and aft blade rows represents only a first approximation for this location and the final location will be determined by the methods discussed herein.

It will be noted that relatively low deflection angles $\alpha_2$ are associated with high values of flow coefficient ($\Phi$) and thus have higher flow velocities going through the impeller and entering the guide vanes. This requires fewer blades and lower solidity in the forward row of the multiple blade to reduce flow friction. On the other hand, high deflection angles $\alpha_2$ are usually associated with low values of flow coefficient ($\Phi$) and thus have lower flow velocities going through the impeller and entering the guide vanes. Thus, a larger number of blades and associated higher solidity in both forward and aft rows of the multiple blade is justified because of the lower values of flow friction.

Centrifugal Blowers

Figure 21:
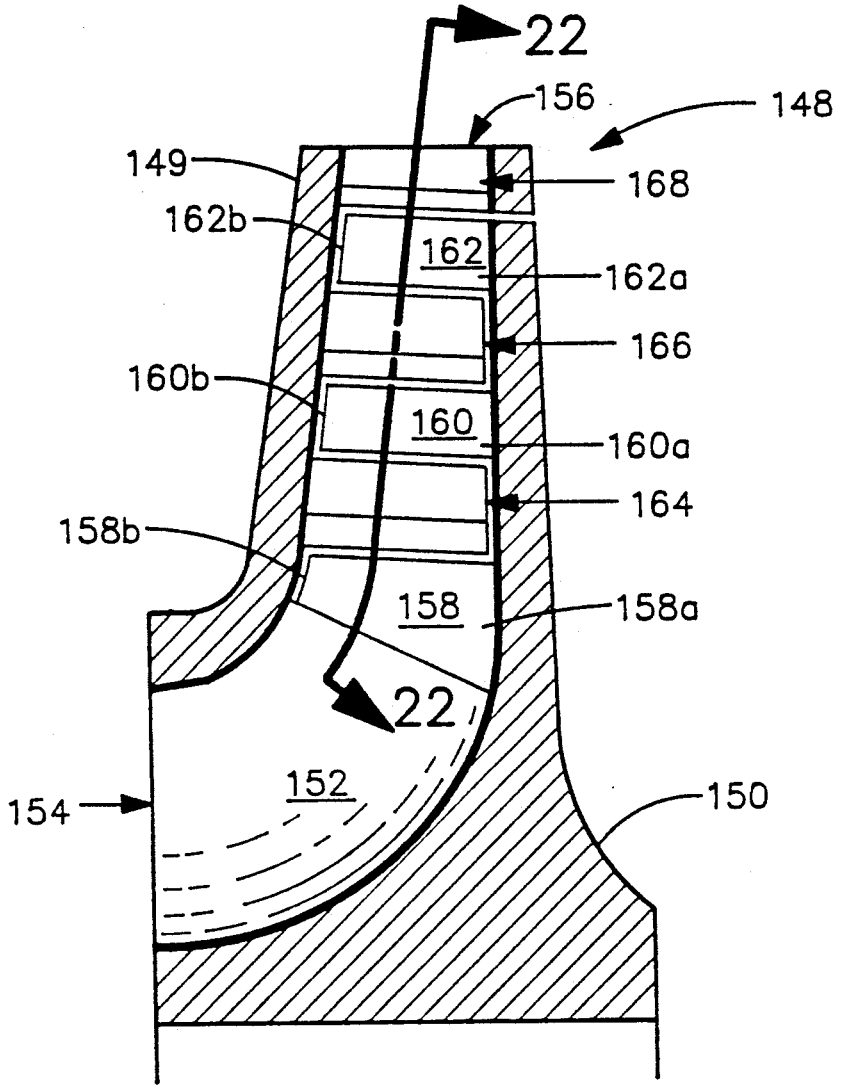
FIG. 21 is a sectional view of a portion of a centrifugal turbomachine constructed in accordance with the present invention.
Figure 22:
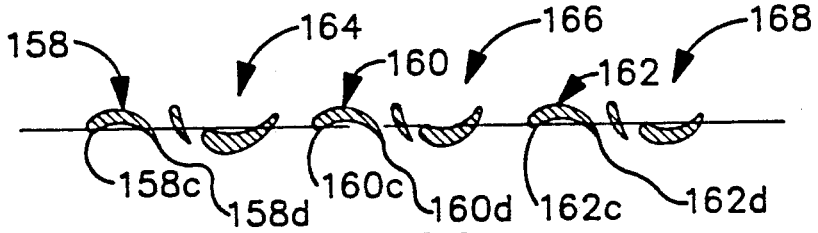
FIG. 22 is a view taken along the curved line 22—23 of FIG. 21 illustrating the configuration and relative inclination of three sets of impeller blades and three sets of guide vanes.

As previously indicated, this invention also applies to centrifugal blowers. More specifically, this invention relates to the guide vanes or vaned diffuser used in centrifugal blowers. The vaned diffuser is located downstream by the impeller. The impeller can have airfoil type blades as shown in FIGS. 2 and 3, and it can have blade arrangements as shown in FIGS. 21 and 22. The impellers of centrifugal blowers can have blades which are backwardly curved, radially ending or forwardly curved. Each of these impellers can have a vaned or vaneless diffusing system following the impeller.

In centrifugal blowers with forwardly curved impeller blades, the absolute velocity leaving the impeller is relatively large, just as in axial flow blowers. Thus, centrifugal blowers with forwardly curved impeller blades have a higher pressure coefficient $\psi$ and a smaller impeller diameter than centrifugal blowers with backwardly curved blades. Under these circumstances, it is undesirable to discharge directly from the impeller into a scroll because the absolute velocity is high and the impeller diameter is small such that the volute length is relatively short. For the high absolute exit velocity, it is desirable to have a scroll volute of large length. This means a much larger diameter. As an alternate, the high velocity leaving the impeller must be reduced and this can be done in a vaned diffuser. However, the principles of this invention can be applied to any centrifugal blower.

Figure 19A:
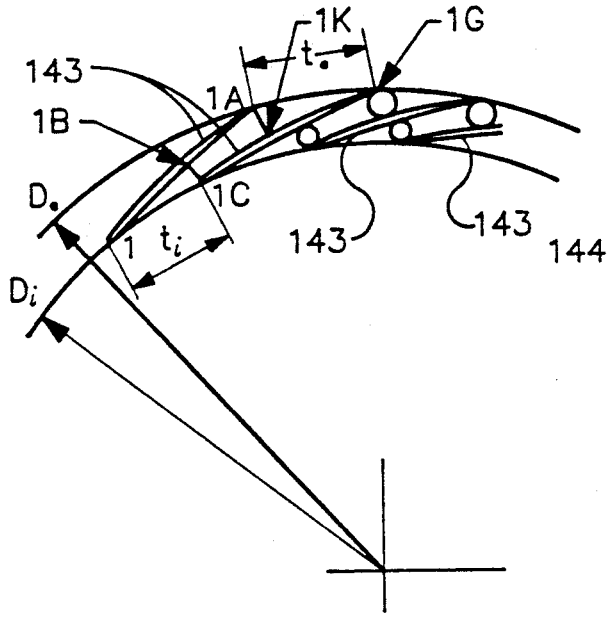
FIG. 19A illustrates a conventional vaned diffuser for a centrifugal blower.
Figure 19B:
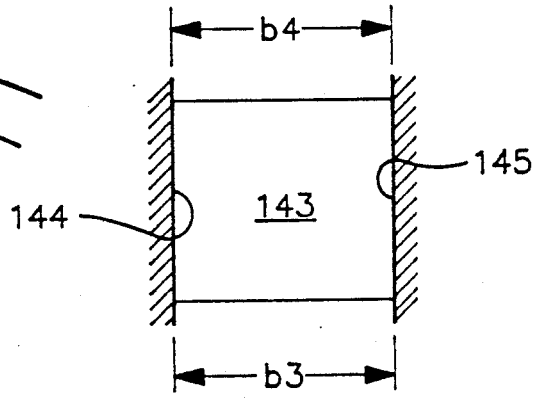
FIG. 19B is an enlarged view of the side walls of the vaned diffuser of the centrifugal blower depicted in FIG. 19A.

A typical vaned diffuser for a centrifugal blower is shown in FIG. 19A which is a sketch of diffuser of section 13.14 from the book by Church, A. H., CENTRIFUGAL PUMPS AND BLOWERS, published by John Wiley & Sons, 1945. In this case, the vaned diffuser entrance diameter $D_i=46''$ and the diffuser exit diameter $D_e=54''$. The number of equally spaced guide vane blades 143 are $z=20$. The entrance pitch equals $t_i=7.23''$ and the exit pitch equals $t_e=8.48''$. The blade chord length ch is 13.0" so that the entrance solidity $\sigma_i=1.80$ and the exit solidity $\sigma_e=1.53$. It is noted that the solidities of the guide vanes are quite similar to those of axial flow blowers. In FIG. 19A, as is the case in FIGS. 11 and 12 for axial flow guide vanes, the flow has good guidance from location or line 1C—1B to the guide vane location at 1A—1K because the guide vanes guide the flow on both sides. However, from location 1 to 1B, the flow is guided only by one side of the blade 143. The distance 1—1B becomes larger for large deflection angles $\alpha_2$ or low flow capacity and becomes smaller for small deflection angles $\alpha_2$ or larger flow capacity. It is known in the prior art that the contour 1—1B should conform to a logarithmic spiral or equivalent because such a contour conforms to a natural flow line without deceleration and therefore does not stall the flow and cause losses. This means that in the distance 1—1B there occurs no deceleration and no corresponding transformation from flow velocity into pressure. It will be noted in FIG. 19A that the distance 1—1B equals about 7.0" and exceeds 50% of the guide vanes chord. In the centrifugal blower shown in FIG. 19A, there is at the guide vane exit the distance 1K—1G which equals 6.87" where the flow is guided on one side by the blade 143 and on the other side by the scroll (not shown). In addition, the flow velocity is relative low at the guide vane exit when compared to the flow velocity at the guide vane entrance; thus, flow losses, if any, are very small at the guide vane exit. As indicated in FIG. 19B, the guide vanes have parallel side walls 144 and 145 and constant width entrance ($b_3$) to exit ($b_4$).

Figure 20A:
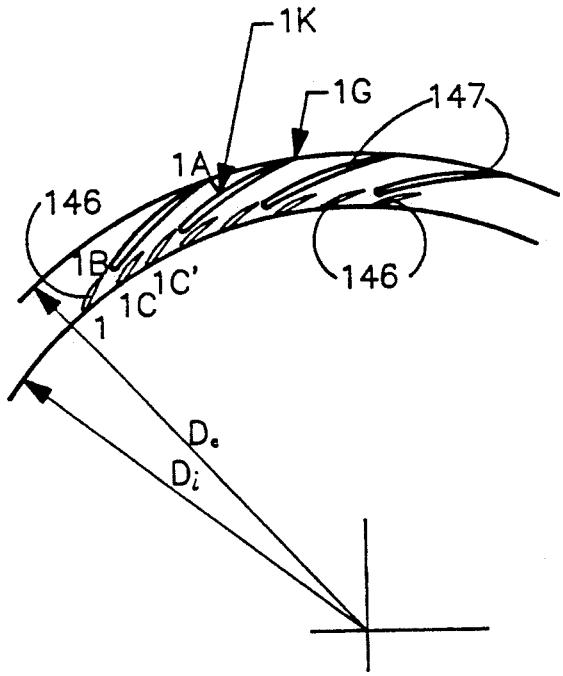
FIG. 20A shows multiple blade guide vanes for a centrifugal blower constructed in accordance with this invention.

Using the principles disclosed above, it will now be evident that there is substantial benefit in using multiple blades in the guide vane-diffuser for the centrifugal blower. It will be particularly advantageous to have a larger number of forward blades than aft blades for the multiple blade of the guide vanes for the centrifugal blower. FIG. 20A illustrates the guide vanes for a centrifugal blower with multiple blades in which the number of blades 146 in the forward row is equal to twice the number of blades 147 in the aft row.

The centrifugal blower of FIG. 20A and the axial blower of FIG. 13 has twice as many forward blades as aft blades. It will be noted that the flow is guided on both sides from the line 1B—1C to the line 1A—1K and the length of this flow channel is substantially longer than the length of the flow channel from the line 1B—1C to 1A—1K in FIG. 19A. The distance 1—1B in FIG. 20A where the flow is guided on only one side of the blade 146 is only 2.80" long as compared to 7.0" in FIG. 19A. This is due to the larger number of forward blades 146 used in the guide vane system of FIG. 20A. In FIG. 20A, the distance 1K—1G equals 6.25" as compared to 6.87" for the distance 1K—1G in FIG. 19A. This is due to the use of a slightly larger number of aft blades 147 in FIG. 20A as compared to the number of blades used in FIG. 19A because the aft blades 147 of the multiple blade has a smaller chord of 9" than the single blade 143 of 13.0" of FIG. 19A and therefore the solidity, namely $\sigma_e=1.27$, of the aft blades 147 of FIG. 20A remains in a favorable range of solidity with a larger number of aft blades 147. Through use of the streamline-type of blades 146 and 147, the amount of deceleration $c_{2e}/c_{2i}$ as a function of the solidity of the blades is governed by the value shown in FIG. 18. The value $c_{2e}$ is the exit velocity of a set of blades and the value $c_{2i}$ is the corresponding inlet velocity of the same set of blades.

In FIG. 20A, the vaned diffuser entrance diameter $D_i$ equals 46" and the diffuser exit diameter $D_e$ equals 48". The number of forward blades ($z_1$) is 48 and the number of aft blades ($z_2$) is 24. The entrance pitch of the forward blades ($t_{1i}$) equals 3.01" and the exit pitch of the forward blades ($t_{1e}$) equals 3.14". The chord of each forward blade 146 equals 4.0". The entrance solidity cf a forward blade $\sigma_{1i}$ is equal to 1.33 and the exit solidity $\sigma_{1e}$ is equal to 1.27. The entrance diameter of the aft blade $D_{2i}$ is equal to 48" and the exit diameter $D_{2e}$ is equal to 54". The chord of the aft blade $ch_2$ is equal to 9.0". The entrance pitch of the aft blade ($t_{2i}$) is equal to 6.28" and the exit pitch of the aft blade ($t_{2e}$) is equal to 7.07". The entrance solidity of the aft blade $\sigma_{2i}$ is equal to 1.43 and the exit solidity of the aft blade $\sigma_{2e}$ is equal to 1.27.

In centrifugal blowers, the amount of deflection in the vaned diffuser-guide vanes is controlled by the impeller blade discharge flow angle $\alpha_2$ and by the entrance angle into the spiral casing. This change in flow deflection is quite moderate when compared to the flow deflections which are required in axial flow guide vanes. Using the multiple blades in a centrifugal blower as illustrated in FIG. 20A, will result in more and better flow diffusion or flow deceleration than with the conventional single blade guide vaned diffuser. In the case where the blade angles at guide vane inlet and exit are fixed and the radial extension of the guide vanes is also fixed, this will permit the guide vanes with the multiple blades to increase the width of the diffuser section because of the improved performance of the multiple blade diffuser. This means that more pressure is generated by the blower from the dynamic energy provided from the blower impeller.

Another example of the application of multiple blade to centrifugal blowers is shown in FIGS. 21 and 22. FIGS. 21 and 22 show the present preferred embodiment for a blower of a centrifugal turbomachine type constructed in accordance with the present invention. A portion of a centrifugal blower 148 is shown in FIG. 21. Centrifugal blower 148 includes a stationary annular member 149, an impeller 150 positioned for rotation in said stationary annular member 149 and being radially spaced therefrom by an annular fluid path 152 which has a fluid inlet end 154 and a fluid outlet end 156 of larger diameter and which has a curved flow channel of progressively increasing area which extends from said fluid inlet 154 to said fluid outlet end 156. The impeller 150 has a series of impeller blade rows 158, 160 and 162 located in said fluid path 152 and being securely attached to the impeller 150. The centrifugal blower 148 also includes a series of guide vane rows 164, 166 and 168 located in said fluid path 152 and being securely attached to the annular stationary member 149. As shown in FIGS. 21 and 22, the guide vane rows are alternated with the impeller blade rows along the flow path 152. Moreover, as shown in FIGS. 21 and 22, impeller blade row 158 and guide vane row 164 constitute a first pressure generating stage, impeller blade row 160 and guide vane row 166 constitutes a second pressure generation stage and impeller blade row 162 and guide vane row 168 constitutes a third pressure generation stage.

Each impeller blade has an inner blade or hub portion 158*a*, 160*a* and 162*a*, an outer blade or tip portion 158*b*, 160*b* and 162*b*, a rounded leading edge 158*c*, 160*c* and 162*c*, and a relatively sharp trailing edge 158*d*, 160*d* and 162*d*. Each impeller blade has a combination of camber and solidity wherein, during operation of said impeller blades at the design point, the average outlet relative velocity $w_2$ is equal to or greater than 0.6 times the average inlet relative velocity $w_1$ at the impeller portion of said blades. The ratio of the average outlet relative velocity $w_2$ to the inlet relative velocity $w_1$ at the impeller portion is essentially constant from the hub portion to the tip portion. The angle of flow deflection O within the impeller blades is at least equal to approximately 50° or more.

Each of the guide vane rows includes at least a forward row of blades and an aft row of blades. The chord of each of the blades in the aft row is greater than the chord of each of the blades in the forward row. Each blade in the aft row cooperates with a corresponding blade in the forward row to form, during operation of the blower, multiple rows of blades. The axial distance "a" between the trailing edge of the forward blade and the leading edge of the aft blade and the circumferential distance d between the leading edge of the aft blade and the edge of the forward blade nearest the aft blade are within the limits described above and in equations 20 and 21 with respect to the axial flow blower.

Each row of blades of the guide vane rows have a combination of camber and blade solidity wherein during operation of the blower the direction of the discharge from the impeller blades is turned by said guide vane rows back to a reduced direction of flow angle or to the direction of the entry of the said row into said impeller blades and the deceleration of flow is approximately 0.66 or more, the value of 0.66 is equivalent to the deflection angle of 49° in an axial flow machine.

The pressure coefficient $\psi$ for each of said centrifugal blower stages is equal to at least approximately 1.5.

Each of the blades in the forward row have a blade solidity equal to approximately $1.3 \pm 0.6$; each of the blades in the aft row have a blade solidity equal to approximately $1.1 \pm 0.6$.

The absolute blade exit velocity of the impeller blades at the outlet $c_2$ is greater than both the circumferential velocity u and the inlet relative velocity $w_1$. The flow vector of the circumferential component of the relative velocity $w_{u1}$ of said impeller blades at the inlet is in a direction opposite to the direction of circumferential velocity u and the flow vector of the circumferential component of the relative velocity $w_{u2}$ of said impeller blades at the outlet is in the same direction as the circumferential impeller velocity u at least at one location between the hub and the tip of the impeller blade.

It will be understood that the aft row of blades may include a plurality of part blades. The part blades will be positioned and have the same relationship as described with respect to axial flow blowers in FIG. 11.

It will also be understood that each of the blades in the forward row of said guide vane rows may include means for adjusting pressure and flow velocity through the impeller blades during the operation of the blower at a predetermined speed of rotation. The pressure and flow velocity adjusting means includes means for mounting each of the forward blades for pivotal movement about a point located closely adjacent the trailing edge of each blade in the forward row and means for pivoting each forward blade about said point thereby changing the angle of attack of each blade of the forward row. For centrifugal blowers, attention must be given to the ratio of the solidity of the forward blades to the solidity of the aft blades of the multiple blade. This ratio can have values as presently used as long as the number of blades in the forward row is larger than the number of blades in the aft row. This ratio depends on the values of flow deceleration and their relation to solidity, as shown in FIG. 18, and the related changes in channel width. Considering the basic requirements of vaned diffusers for centrifugal blowers, it is evident that the vaned diffuser with multiple blades also has applications for centrifugal blowers with radially or backwardly ending impeller blades. The operation of the guide vane rows with multiple blades are a function of the diffuser requirements for transforming velocity energy into pressure energy. With the multiple blade guide vanes, a shorter diffuser of high efficiency is possible.

For centrifugal blowers, it is recognized that a vaned diffuser or guide vanes result in a higher efficiency for a narrow range of flow capacity when compared to a vaneless diffusing system. Frequently, the vaneless diffusing system has a higher efficiency outside the narrow range of flow capacity where the peak efficiency of the vaned diffuser is located. As previously described, with a multiple blade, it is possible to design an adjustable forward blade row. Thus, the multiple blade can have an adjustable camber and adjustable inlet angle when used in a vaned diffuser. This will permit an extension of the high efficiency range for much of the flow capacity when using the vaned diffuser. Thus, the adjustable multiple blade diffuser can be expected to provide the vaned diffuser of a centrifugal blower with a wide range of high efficiency so that its efficiency is higher than that of a vaneless diffusing system over the entire range of flow capacity. The adjustment of the forward row of the multiple blade can, as previously described, be made manually or automatically.

Turbomachine Having Solid Guide Vanes

As previously indicated, impeller blades for conventional turbomachines can be used to deflect the flow of fluid by approximately 45°–49° without stalling. It will also be recalled that conventional pressure generating turbomachinery generates about 50% or more of the pressure in the impeller blades. It is also known that the remaining amount of pressure from conventional turbomachines is generated within outlet guide vanes. It has been found, however, that turbomachines of improved performance can be obtained by using impeller blades to deflect the flow of fluid without generating pressure therein and using outlet guide vanes to generate all or substantially all the pressure output of the turbomachine. Consequently, a turbomachine having nearly reactionless impeller blades and outlet guide vanes which develop all or substantially all of the pressure produced has the above-described advantages and benefits. Thus, a turbomachine constructed in accordance with this invention and utilizing one row of guide vanes comprises a plurality of impeller blades mounted on a hub member for rotation, a plurality of stationary guide vanes mounted on the hub member, said guide vanes being located downstream from said impeller blades and through which flows the entire flow discharged by the impeller blades, and has a pressure coefficient equal to at least 1.0 or more. Each of the impeller blades has a hub portion, a tip portion, a rounded leading edge and a relatively sharp trailing edge. Each of the impeller blades has a combination of camber and blade solidity wherein, during operation of the blades at the design point, the outlet relative velocity ($w_2$) is equal to or greater than approximately 0.6 times the inlet relative velocity ($w_1$) at the hub of the impeller, the ratio of the outlet relative velocity ($w_2$) to the inlet relative velocity ($w_1$) at the hub is greater than at the tip, and the angle of flow deflection within the impeller blades is more than approximately 50°. Each of the guide vanes has a hub portion and a tip portion. Each of the guide vanes has a combination of camber and blade solidity wherein the direction of discharge from said impeller blades is turned by said guide vanes back to the direction of entry of said flow into said impeller blades while the absolute flow through said stationary guide vanes undergoes a substantial flow deceleration of approximately 0.66 or more at the hub location.

Such a turbomachine is also characterized by the fact that the absolute value of the angle ($\alpha_1$) between the inlet relative velocity ($w_1$) and the axial through flow velocity ($c_m$) is approximately equal to the absolute value of the angle ($\alpha_2$) between the outlet relative velocity ($w_2$) and the axial through flow velocity ($c_m$). The average value of relative velocity through the impeller blades between the hub and the tip is maintained substantially constant. In fact, the absolute value of the relative velocity through the impeller blades could be substantially constant only at one location of the impeller blades between the hub and the tip; at other locations the values are nonconstant. Additionally, the pressure generated by such a turbomachine is constant from the hub to the tip and the axial through flow velocity ($c_m$) is constant at the design point of the blower or pump. The turbomachine with solid guide vanes or relatively low deflecting angles $\alpha_2$ is characterized by operating with high flow coefficient $\Phi \geqq 1.0$.

Another model of such a turbomachine is characterized in that the flow area at the hub of the impeller blade is substantially constant from the inlet to the outlet while the flow area at the inlet of the impeller blades is smaller than the flow area at the outlet of the impeller blades between the mean and the tip whereby the flow velocity through the impeller blades at the mean and the tip decelerates as the flow passes from the inlet to the outlet.

Another model of such a turbomachine is also characterized in that it includes means to reduce high inlet velocities at the impeller blades at the inlet of said blades in which said means includes a hub member having an inlet diameter smaller than the outlet diameter whereby the axial flow area decreases from the inlet to the exit and the through flow velocity increases from the inlet to the exit of said impeller blades.

Part blades may be used in the guide vanes of this turbomachine.

A turbomachine having these characteristics may also be used with stationary inlet guide vanes located upstream of said impeller blades wherein each of the inlet guide vanes has a combination of camber and blade solidity which, during operation of the blower or pump, turn the circumferential component of the flow at the exit of said inlet guide vanes in a direction opposite to the direction of the circumferential impeller velocity (u).

Design of a Turbomachine

The dimensionless flow coefficient $\Phi$, pressure coefficient $\psi$, specific speed $\eta_s$, and hub ratio v are used to design a pump or blower of the turbomachine type of this invention. The complete formulas for these dimensionless coefficients are set forth above.

An experimental blower was designed to meet the following specifications:

| | |
|---|---|
| Q = | 625 cfm |
| $p_2$ = | 12" W.C. |
| $p_t$ = | 12.63" W.C. |
| n = | 11,500 rpm |
| v = | 0.714 |

From the above specifications, the specific speed $\eta_s$ is determined. According to the specific speed $\eta_s$ value, the flow coefficient $\Phi$, pressure coefficient $\psi$ and efficiency $\eta$ are, based upon past experience and test data, selected. From the values selected, calculations are made to determine the required power, the impeller tip diameter $D_T$, hub diameter $D_H$, hub/tip ratio v, impeller tip speed $u_T$, flow area A and through-flow velocity $C_m$. From these calculations, it was determined that the impeller tip diameter $D_T$ of 4.9" and the hub diameter $D_H$ of 3.5" would be required. After the foregoing calculations has been made, further calculations are required to determine the flow deflection angles O at the impeller hub, mean and tip locations, impeller relative velocity changes $w_w/w_1$, guide vane entrance velocity $c_2$, guide vane deceleration $c_m/c_2$ and guide vane deflection angle $\alpha^\circ_2$. A flow vector diagram similar to that shown in FIG. 9 is drawn.

From the above information, the following are selected: impeller blade number $z_1$, blade chord $ch_1$, blade solidity $\sigma_1 = ch_1/t_1$ and the pitch $t_1 = (D_1/z_1)$. This information is used to select blades from published data to achieve the desired impeller flow deflection angles $\theta$. This is an iterative process to find the best blades and good efficiency.

Guide vane selection is similar to impeller blade selection. Based on the above information, by using past experience the following are selected: guide vane blade number $z_{GV}$, blade chord $ch_{GV}$ and blade solidity $\sigma_{GV}=(ch_{GV})/t_{GV}$. This information is used to select blades from published data to achieve the desired guide vane flow deflection $\alpha°$. However, if the flow deceleration $c_m/c_2$ is smaller than 0.66, a two row guide vane is needed. The above process must then be followed first for the forward row flow deflection $\alpha°_2-\alpha^X_2$ and subsequently for the aft row resulting in the flow deflection of $\alpha^x_2$. A flow vector diagram similar to that shown in FIG. 9 is then made.

Based upon the foregoing, two blower designs were selected for further evaluation; these blower designs are identified as Unit 2 with two row guide vanes and 5-5 blades (i.e., five blades in the forward row and five blades in the aft row) and Unit 3 with two row guide vanes and 10-5 blades in Table 2 and FIGS. 16 and 17. In FIG. 16, the forward row of guide vanes has a larger angle of attack and the performance of both units has slightly more pressure and lower values of flow capacity than FIG. 17. In either case, the Unit 3 with two row guide vanes and 10-5 blades outperforms Unit 2 with two row guide vanes and 5-5 blades.

Method for Generating Pressurized Fluid

This invention also relates to a method for producing pressurized fluid. The method comprises the steps of forming a fluid flow path, generating a flow of fluid through said fluid flow path, deflecting the flow of fluid as same flows through said fluid flow path while simultaneously maintaining the average outlet relative velocity ($w_2$) approximately equal to the inlet relative velocity ($w_1$) prior to said deflection at least at one point in the fluid flow path, and generating pressure by turning back the flow of fluid discharged from the impeller by an amount approximately equal to the amount of deflection of the fluid by maintaining the rates of the axial through flow velocity through flow velocity to the deflected outlet velocity before the generation of said pressure equal to 0.66 or less.

The invention also relates to a method producing pressurized fluid comprising the steps of forming a fluid flow path, generating a flow of fluid through said fluid flow path, deflecting the flow of fluid by approximately 50° or more while simultaneously maintaining the average outlet relative velocity ($w_2$) following said deflection approximately equal to or less than relative velocity ($w_1$) prior to said deflection at least at one point in its fluid flow path, and generating substantial pressure by turning back the flow of absolute fluid velocity by at least approximately 49° or more while simultaneously decelerating the flow of fluid by maintaining the ratio of the axial through the fluid flow path to the outlet velocity before the generation of said pressure equal to approximately 0.66 or less.

Three Row Guide Vanes

FIG. 14 shows a blower having three rows in the guide vanes. The first row 174 contains 24 NACA 650912 blades 176 from the 65 series. The second row 178 contains 16 NACA 651210 blades 180 from the 65 series. Each of these blades in the second row has a chord of 3½" and a stagger angle $\gamma_2$ of 46.9°. The third row 182 contains eight NACA 652110 blades from the 65 series. Each of these blades has a chord of 7¼" and a stagger angle $\gamma_3$ of 74°.

The axial distance $a_2$ separating the second row 178 from the third row 182 of blades is 0.06". The pitch $t_2$ at the hub for the second row 178 is 1.963". The circumferential distance $d_2$ is 0.85". The pitch $t_3$ at the hub for the blades 184 in the third row 182 is 3.926". The stagger angle $\gamma_3$ is 74°.

As previously indicated, a blower having three rows in the guide vanes is required for large flow deflection angles $\alpha°_2$ in the guide vane blades, i.e., greater than approximately 70°. The design of a blower having three rows of blades in the guide vane is similar to the design of a blower having two rows of blades in a guide vane, except, of course, that consideration must be given to the blade to be used in the third row, the axial spacing "a" between the blades in the second and third rows and the circumferential distance d between each two pairs of rows, particularly in the third row and a corresponding blade in the second row. The information set forth above with respect to a blower having two rows of blades in the guide vane is applicable with respect to the relationship between the second and third rows of blades in the guide vanes.

FIG. 14 shows the present preferred embodiment for a three row pump or blower of the turbomachine type constructed in accordance with the subject invention in which the guide vanes turn back the flow of fluid between 70° to 80° providing that the three row guide vane configuration contains four forward blades to two aft blades to one third row blade (rather than three forward row blades to two aft blades to one third row blade). Where the axial length of the pump or blower is limited, four forward blades to two aft blades to one third row blade can be used; when fewer blades in the first row are preferred, the three row guide vane configuration will use three forward blades to two aft row blades to one third row blade.

BOUNDARY LAYER CONTROL

Figure 23:
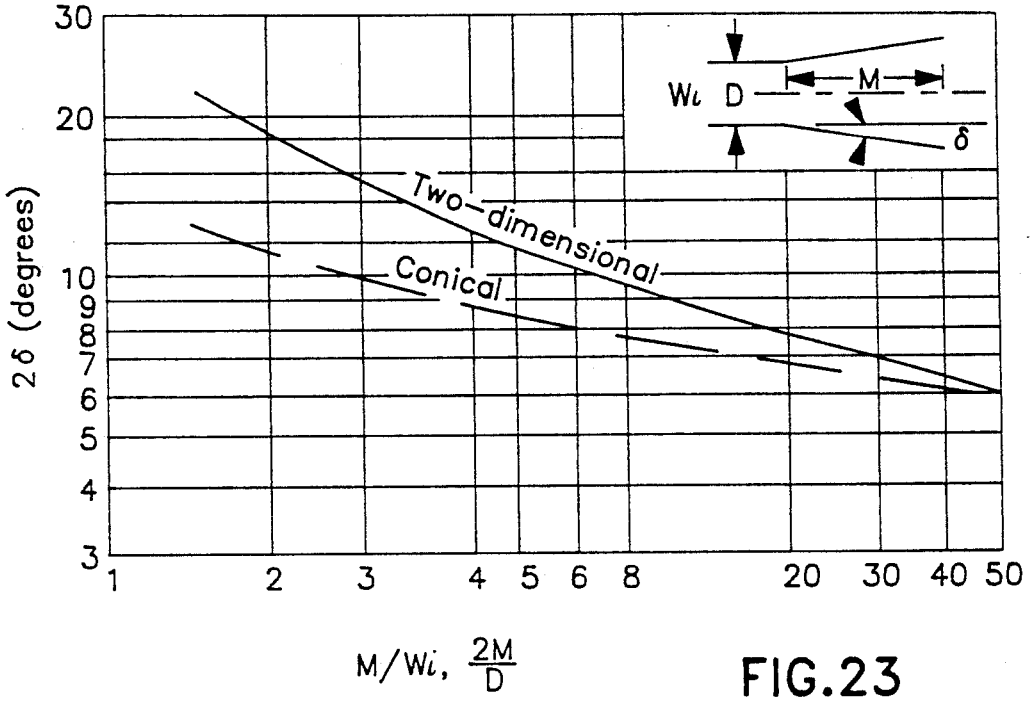
FIG. 23 shows the recommended diffuser included angle for two dimensional and conical diffusers.
Figure 24:
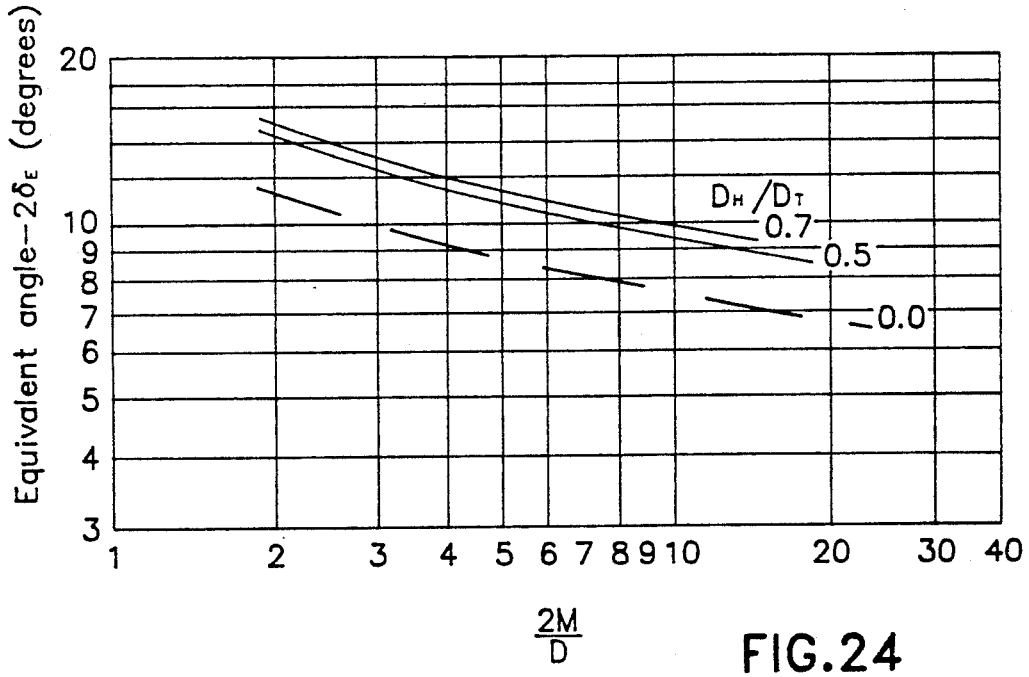
FIG. 24 shows a recommended equivalent angle for annular diffusers with convergent center bodies.

This invention also relates to the design of diffusers incorporating a boundary layer removal system. The purpose of a diffuser is to reduce fluid velocity in an orderly manner and transform the reduction of fluid velocity into static pressure. A diffuser is generally identified by its included angle of the diffusing walls and the ratio of diffuser length M over the inlet radius D/2 or inlet diameter D. FIG. 23 shows a recommended included angle for two-dimensional and conical diffusers. FIG. 23 indicates that the included angle is not constant but varies with the ratio 2 M/D or the relative length of the diffuser. For a ratio of 2 M/D equals 10, the recommended included angle is 7.5 for the conical diffuser and for larger ratios of 2 M/D the recommended included angle is smaller whereas for lower values of 2 M/D the included angle can be larger. Additional information on the value of the included angle and diffusers is presented in FIG. 24 for annular diffusers with convergent center bodies. FIG. 24 shows recommended the "equivalent angle" ($2\delta_\epsilon$) as the ordinate. Equivalent angle is defined as the included angle of a conical diffuser with identical inlet and outlet areas, and length, relative to that of the diffuser in question.

FIG. 24 indicates that the equivalent angle 2 $\delta_\epsilon$ is not only a function of the ratio 2 M/D but it also varies of the value of the center body ratio $D_H/D_T$. FIGS. 23 and 24 indicate that for large diffusion ratios or large values of outlet to inlet area, diffusers of substantial length are needed because the included angle or equivalent angle is of a very low value and this angle reduces in value with increased diffuser length. It will be noted that diffuser performance is also affected by flow turbulence, Reynolds number and boundary layer thickness $\mu$ at the diffuser inlet. The information shown in FIGS. 23 and 24 is based on a Reynolds number of $2\times10^5$ or above, based at the diffuser inlet dimensions. The effect of flow turbulence and inlet boundary layer are much more difficult to assess and, thus, are frequently neglected.

A diffuser using means for controlling or removing the boundary layer constructed in accordance with this invention permits large increases in the value of the included angle or equivalent diffuser angle. In turn, this results in a substantial reduction in the length of the diffuser required. Consequently, space, weight and cost are saved as a result of the reduction in length. Since a diffuser constructed in accordance with this invention, must operate over a wide range of fluid velocities at the diffuser inlet and an associated range of fluid pressures, the range of performance will, in turn, cause a corresponding range of Reynolds numbers at the diffuser inlet. This range of Reynolds numbers will result in a related range of boundary layer thickness on the wall surface of the diffuser. The boundary layer removal system of this invention must operate efficiently under all these operating conditions. Diffusers are also used in a large variety of sizes to which the boundary layer removal system must be adopted. Since many fluids, e.g., air, contain varying amounts and sizes of solids, such as dust, in their fluid stream, due to the reduced flow velocity that exists in the boundary layer as compared to the flow velocity that exists in the main flow, such particles of solids are frequently deposited on the surface of the boundary layer. The boundary layer removal system of this invention is designed to take into account all of the above characteristics to operate successfully under the varying operating conditions.

Figure 25A:
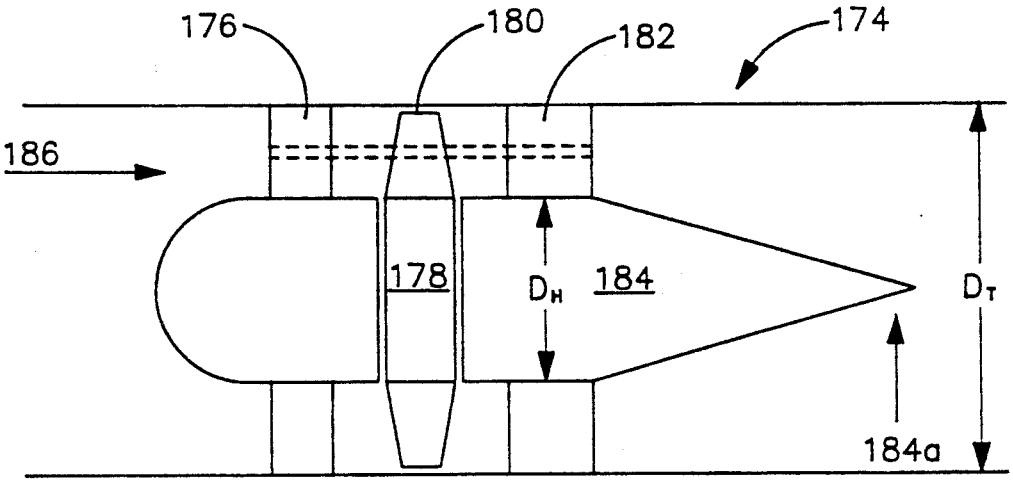
FIG. 25A shows an axial flow blower with inlet guide vanes, impeller blades, stationary guide vanes and a diffuser.
Figure 25B:
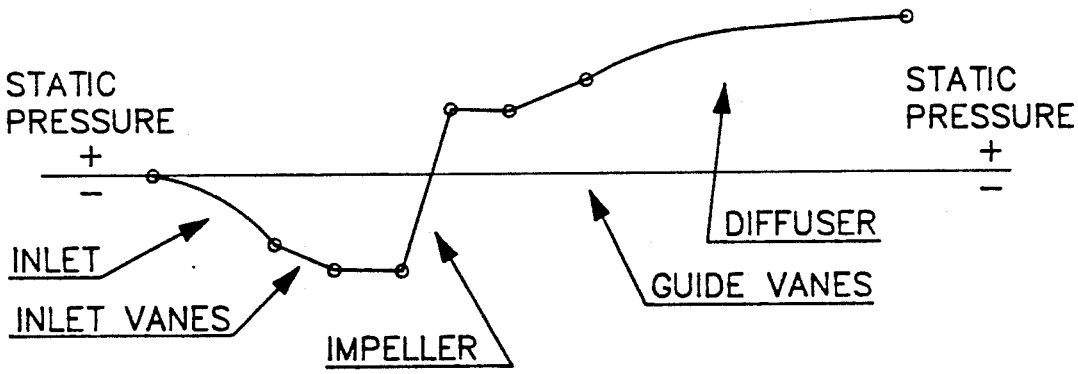
FIG. 25B shows the static pressure along the fluid flow path of the blower of FIG. 25A.

Diffusers are typically of two different configurations. FIG. 23 shows a typical configuration with expanding diffusion angle 2 $\delta$. An alternate diffuser configuration has a converging center body as shown in FIG. 24. In either case, the flow area increases in it value from diffuser inlet to diffuser exit. Thus, the flow velocity decreases from diffuser inlet to diffuser exit and the static pressure increases accordingly from diffuser inlet to diffuser exit. FIG. 25A shows a complete arrangement of an axial flow blower 174 having inlet vanes 176, a rotor 178, impeller blades 180, stationary outlet guide vanes 182 and a converging center body diffuser 184. FIG. 25B shows the static pressure that exists at each of various locations along the fluid flow path 186. As shown in FIG. 25B, the highest static pressure exists at the diffuser exit 184*a*. At the blower inlet, the static pressure is zero, i.e., atmospheric, while the lowest pressure (a negative pressure) is found at the impeller entrance. As is customary with conventional axial flow blowers, a substantial increase in pressure exists at the impeller exit and the static pressure increases continuously from the impeller exit through the guide vanes to the diffuser exit 184*a*. In view of the foregoing, it will now be evident that if a small boundary layer flow passage is provided from a location near the diffuser exit 184*a* to any location upstream of the diffuser exit or to the diffuser inlet itself, there will be a pressure difference and boundary layer flow will be maintained. However, in order to maintain this boundary layer flow, it will be necessary to design the discharge from such a flow passage properly in order that the boundary layer flow will be returned efficiently to the fluid flow path.

Figure 26:
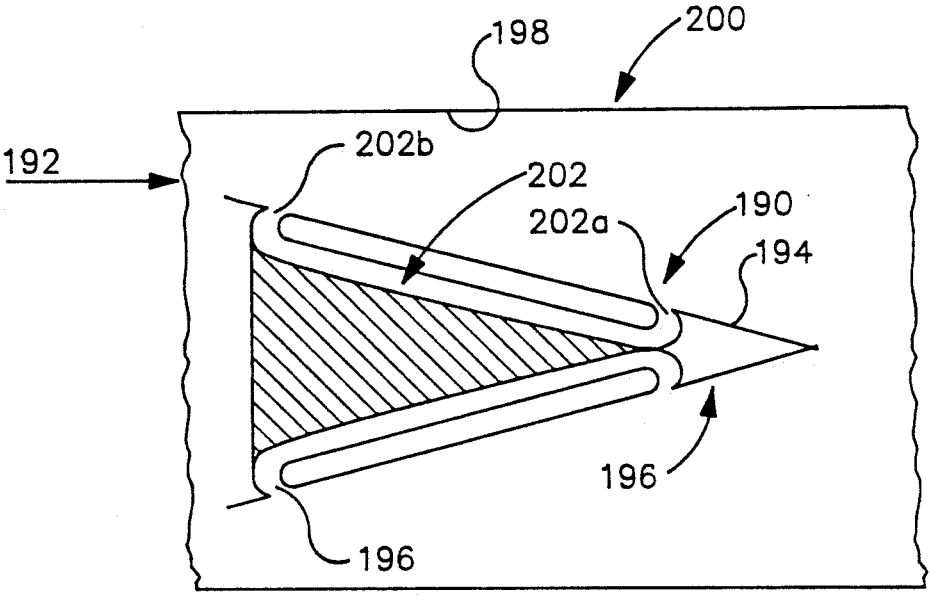
FIG. 26 shows one embodiment of a diffuser including means for controlling the boundary layer along the outer surface of a convergent center body.

It has been found that if the quantity of boundary layer flow is small, as occurs in a short diffuser operating at a high Reynolds number, only a relatively small pressure differential is required and the boundary layer flow can be returned to the fluid flow path at the diffuser inlet or, if desired, at the guide vane exit. FIG. 26 shows a portion of a blower containing means 190 for controlling the boundary layer which, during operation of the blower, forms on the flow directing surfaces of the fluid flow path through said blower. As shown in FIG. 26, the blower has a fluid flow path 192 defined in part, by the outer surface 194 of the diffuser 196 and the inner surface 198 of the tubular housing 200. The means 190 include an annular fluid passage 202 having an inlet or first predetermined part 202*a* for receiving within said fluid passage 202 a portion of the boundary layer to be removed from the surface 194 and an outlet or second predetermined portion 202*b* for returning the removed boundary layer to the fluid flow path 192.

Figure 27:
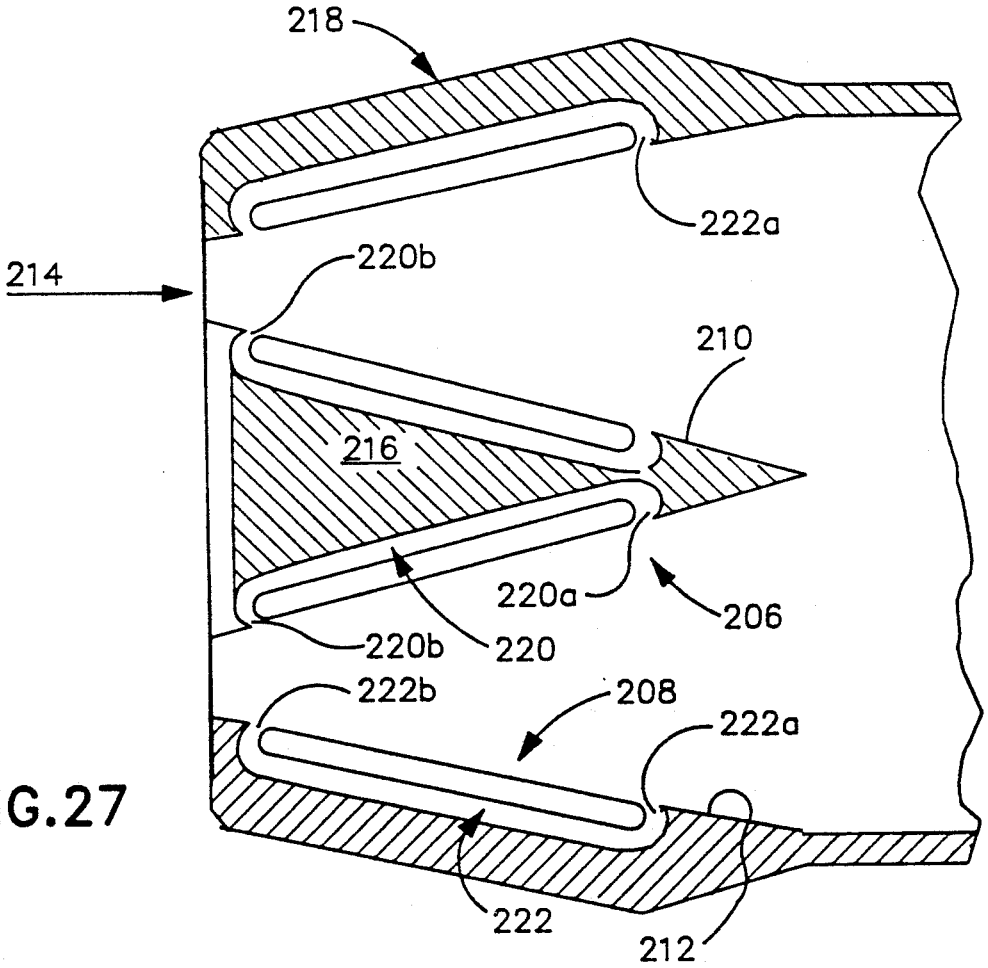
FIG. 27 shows an alternative embodiment of means for controlling the boundary layer along flow directing surfaces contained in the flow path of a blower or pump.

FIG. 27 shows a portion of a blower including means 206 and 208 for removing a portion of the boundary layer from flow directing surfaces 210 and 212 included in the fluid flow path 214 of said blower. As shown in FIG. 27, the diffuser 216 has a converging outer surface 210 while the housing 218 for the blower has, taken in the direction of flow of fluid, a diverging inner surface 212. The means 206 includes a fluid passage 220 having an inlet 220*a* and an outlet 220*b* located upstream of the inlet 220*a*. The means 208 includes a fluid flow passage 222 having an inlet 222*a* and an outlet 222*b* located upstream of said inlet 222*a*. Each of the means 206 and 208 will remove portions of the boundary layer formed, respectively, on the converging surface 210 and the diverging surface 212. Preferably, the fluid passages 220 and 222 are in fluid communication, at their inlets, with a substantial portion of the flow directing surfaces 210 and 212. It is preferred that a portion of the boundary layer be removed from a substantial portion of said surfaces; however, improved performance is obtained even when the fluid passages are not in fluid communication with a substantial portion of the boundary layer formed on said surfaces 210 and 212.

Figure 28:
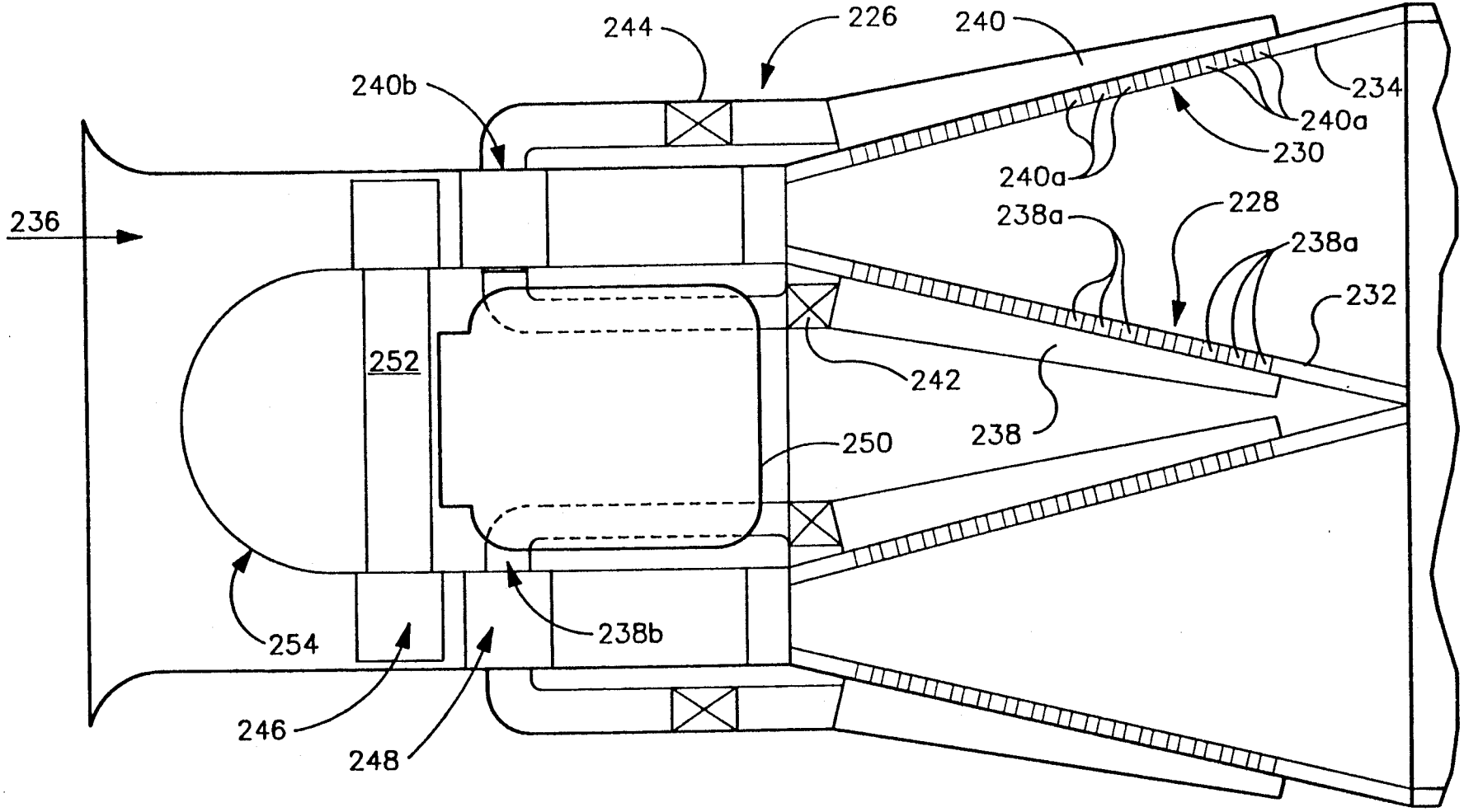
FIG. 28 shows an alternate embodiment for constructing the boundary layer flow diagram surfaces contained in the flow path of a blower or pump containing means for removing particulate matter from the fluid removal from the boundary layer and using the returned boundary layer to cool the motor used to drive the impeller blades.

FIG. 28 shows a blower 226 having means 228 and 230 for removing boundary layer from flow directing surfaces 232 and 234 contained in the fluid flow path 236 formed through said blower 226. The means 228 and 230 include, respectively, fluid flow passages 238 and 240 formed outside of the fluid flow path 236 but disposed in fluid communication therewith through a plurality of openings 238*a* and 240*a*. Preferably, the openings 238*a* and 240*a* constitute a plurality of perforations formed in an annular layer of material, said layer forming, respectively, a part of the outer surface 232 for the diffuser and the inner surface 234 of the housing for the blower.

As shown in FIG. 28, the fluid passages 238 and 240 have, respectively, outlets 238*b* and 240*b* for returning the removed boundary layer to the fluid flow path 236. Said fluid passages 238 and 240 also include means 242 and 244 for removing particulate matter from the portion of the boundary layer removed from said flow directing surfaces 232 and 234. Preferably, said means 242 and 244 include an electronic particulate removal means.

As shown in FIG. 28, the blower 226 includes impeller blades 246, guide vanes 248, a motor 250, a rotor 252, and an inlet portion covered with a hemispherically shaped cap 254. Where the impeller blades 246 are essentially reactionless and the guide vanes 248 are constructed in accordance with the invention described above, a blower may be constructed using a much smaller diameter than previously possible. In turn, this means that a smaller motor 250 will be required. However, where the power requirements of the motor are substantial, it may be necessary to cool the motor during operation of the blower. This may be done by using the removed boundary layer portion to cool the motor 250 as shown in FIG. 28.

It will be understood that blowers or pumps are frequently driven by electric motors. The electric motor driving the impeller blades is usually located inside the cylindrical shell carrying the guide vanes of the blower or pump. As shown in FIG. 28, the electric motor 250 is located upstream of the diffuser 233. In conventional blowers, the heat developed from operation of the electric motor 250 is conducted to the motor casing and from the motor casing to the outer cylindrical structure supporting the guide vanes. The air moving along the guide vane hub and the cylindrical structure removes excess heat by conduction. Some motors may use an interior fan to circulate the air inside the motor. Generally, this air is not connected to ambient air; the purpose of such a fan is to avoid hot spots inside the electric motor and assist in carrying the heat to the motor casing.

The basic relationship for a blower and pump defining the impeller diameter and therewith the diameter of the entire unit is as follows:

$$p = \frac{\tau \psi u^2}{2g} = \tau H$$

in which $\tau$ equals the specific gravity of fluid, u equals impeller tip speed which equals $D\pi n/60$ and D=impeller diameter $$\Delta p = \tau\psi \cdot \frac{D^2 n^2}{2g} \cdot \frac{\pi^2}{60^2}$$

$$D^2 = \frac{1}{\tau} \cdot \frac{\Delta p}{\psi \pi^2} \cdot \frac{2g60^2}{\pi^2}$$

$$D = \frac{1}{\sqrt{\tau}} \cdot \frac{1}{n} \sqrt{\Delta p/\psi} \cdot \frac{60}{\pi} \cdot \sqrt{2g}$$

Thus, for the same pressure, motor shaft speed and fluid specific gravity, the impeller diameter D is related to the inverse of the square root of the pressure coefficient.

As previously indicated, blowers and pumps constructed in accordance with this invention have pressure coefficients three to four times as large as those of conventional blowers and pump. Thus, the diameter of blowers and pumps constructed in accordance with this invention $D_H$ compared to the diameter of conventional blowers and pumps D equals:

$$D_N = \left(\frac{1}{\sqrt{3}} \text{ to } \frac{1}{\sqrt{4}}\right) \cdot D$$

$$D_N = (0/577 \text{ to } 0.500) \cdot D$$

Assuming that blowers or pumps constructed in accordance with this invention and conventional blowers and pumps have the same hub to tip ratio v, it will be noted that the diameter of blowers and pumps constructed in accordance with this invention $D_H$ will equal approximately 0.577 to 0.500 of the diameter of conventional blowers and pumps. Accordingly, the motor diameter of blowers and pumps constructed in accordance with this invention may be reduced to about one half the motor diameter of conventional blowers and pumps. It will be appreciated that with such a reduction in blower or pump size, a severe motor cooling problem arises. It has been found that this problem may be easily resolved by passing the removed boundary layer through the electric motor before it is returned to the fluid flow path. Within limits, the quantity and pressure difference of the boundary layer flow and thus the motor cooling air can be controlled by the location and design of the boundary layer return into the fluid flow path, e.g., at the guide vanes or upstream of the guide vanes, see FIG. 31.

The means 228 and 240 for controlling boundary layer within the blower 226 includes means for attenuating noise during operation of the blower. Said means includes two or more openings, each of which has a longitudinal axis disposed perpendicular to the flow directing surface in which said openings are formed, e.g., the openings 238A, 238B, 240A and 240B are circular in cross-section.

The determination of the boundary layer thickness in a diffuser requires the calculation of boundary layer thickness in an adverse pressure gradient. The growth of a turbulent boundary layer under the conditions of an adverse pressure gradient can only be approximately calculated, provided there is no flow separation. Prediction of boundary layer thickness is far from an exact science and various investigators have given substantially different formula even for the simple case of constant velocity and zero pressure gradient. The amount of boundary layer flow to be removed in a specific case can best be estimated by calculating the boundary layer thickness at the required Reynolds number and assuming constant velocity and zero pressure gradient. Subsequently, the effects of the boundary layer removal system and adverse pressure gradient can be estimated. The adverse pressure gradient is a direct function of the degree of diffusion in the diffuser.

Calculations relating to the boundary layer thickness at constant velocity and zero pressure gradient have been discussed in prior art literature and the following equations give an indication of the complexity of the subject and the limitation of boundary layer flow science. For a structure with a center body diffuser such as shown in FIGS. 28 and 1, the hydraulic diameter $C=\frac{1}{4}(C_T-C_H)$ when $C_{\frac{1}{4}}$=the outer diameter $C_H$=the diameter of the center body. The Reynolds number equals:

$$R = \frac{K}{V} C$$

in which K equals the velocity outside the boundary layer, V equals the kinematic viscosity and, for a flat plate, $$R_X = X(K/V)$$

where X equals the length of the flat plate. The formula for turbulent boundary layer thickness at a flat plate with constant velocity K are given by various investigators, in which $\mu$ equals boundary layer thickness, as follows:

R. Allan Wallis $\mu = 0.233 \times R^{-1/6}$ (23)

-continued

| | | |
|---|---|---|
| Von Karman | $\mu = 0.371 \times R^{-1/5}$ | (24) |
| Hoerner | $\mu = 0.154 \times R^{-1/7}$ | (25) |
| Schlichting | $\mu = 5.0 \times R^{1/2}$ | (26) |

It will be noted that variation of the calculated boundary layer thickness according to the above four formulae for a specific case of R=133000, K=250 ft/sec and X=1.00 inch, is as follows:

$\mu_{23}=0.0326''$ $\mu_{24}=0.0350''$ $\mu_{25}=0.0285''$ $\mu_{26}=0.0137''$

Using formula 23 and calculating the boundary layer thickness over a range of Reynolds numbers R and length dimension X gives values as shown in Table 3.

TABLE 3

BOUNDARY LAYER THICKNESS BY WALLIS FORMULA

| Reynolds Number R | 50000 | 100000 | 200000 | 1000000 | 10000000 |
|---|---|---|---|---|---|
| $R^{1/6}$ | 6.0696 | 6.8129 | 7.6472 | 10.0 | 14.6780 |
| for x = 0.1" | 0.00384 | 0.00342 | 0.00305 | 0.00233 | 0.00159 |
| for x = 1.0" | 0.03839 | 0103420 | 0.03047 | 0.02330 | 0.01587 |
| for x = 10.0" | 0.38390 | 0.34200 | 0.30470 | 0.23300 | 0.15870 |

Small values of X correspond to a short flat plate or a small annulus with a corresponding large center body. The difference in the values of $\mu_{23}$ to $\mu_{26}$ is caused by various assumptions which have been made by the different investigators regarding certain flow characteristics such as turbulence in the flow. The difference in the formula also expresses the fact that the knowledge of boundary layer flow is generally not as well known as the characteristics of the main flow. It will be noted that the boundary layer thickness varies substantially with the Reynolds number and with the factor X. Through use of the means for controlling boundary layer as constructed in accordance with this invention, the thickness of the boundary layer may be kept relatively small even for large Reynolds numbers.

Calculations of the quantity of the boundary layer flow are based on turbulent boundary layers because the value of the Reynolds number in diffusers used downstream of axial flow blowers is of such a quantity that laminar flow can be excluded. In addition, the impeller of a blower generates a high degree of turbulence which will prevent laminar flow. The velocity distribution within the boundary layer is a function of the shape parameter $F=\epsilon/\phi$ in which $\epsilon$ =displacement thickness of the boundary layer and $\phi$ =momentum thickness of the boundary layer.

Figure 29:
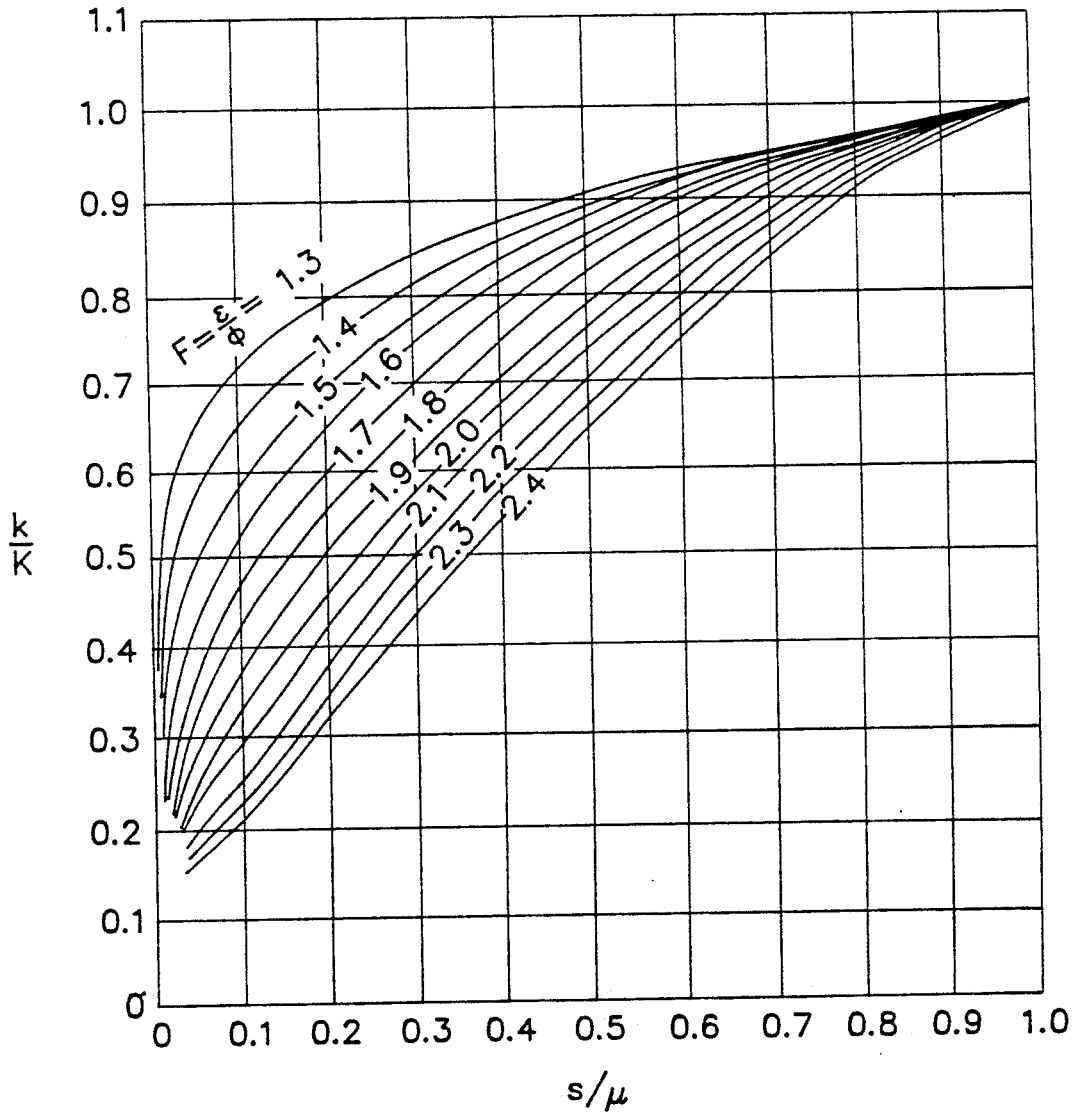
FIG. 29 shows turbulent boundary layer profiles and the velocity distribution within the boundary layer as a function of the shape parameter.

FIG. 29 shows turbulent boundary layer profiles and presents velocity distribution within the boundary layer as a function of the shape parameter F. In FIG. 29, $s/\mu$ is plotted on the abscissa and k/K is plotted as the ordinate. The nomenclature is identified in FIG. 29. The boundary layer profile is approximately unique for a given value of F and can be represented by the expression:

$$k/K=(s/\mu)^n$$

For zero velocity gradient and moderate Reynolds numbers, such as $R=10^5$, the respective numbers are n=1/7 and F=1.286. At high Reynolds numbers, such as $R=10^6$ or above, the Corresponding numbers are n=1/9 and F=1.22. The boundary layer thickness equals zero at the diffuser entrance. If the cylindrical duct has zero velocity gradient, the flow reaches the final velocity K (or flow velocity outside the boundary layer) along line 1—8, see FIG. 30, with a shape parameter F=1.3, the boundary layer thickness has the value 7-8.

Figure 30:
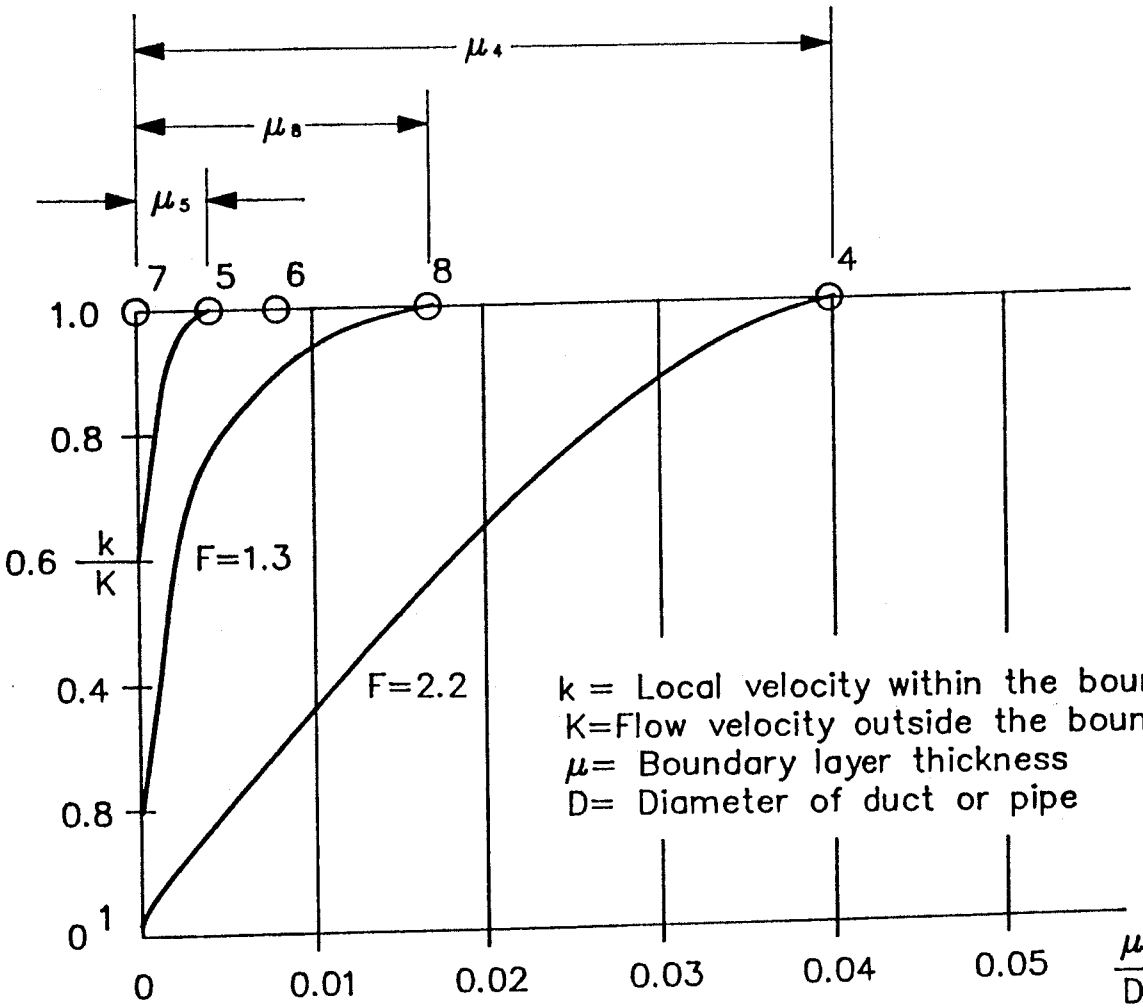
FIG. 30 shows turbulent boundary layer profiles and boundary layer thickness.

If the flow enters a diffuser with adverse pressure gradient, the flow reaches the final velocity K along the line 1—4 with a shape parameter of F=2.2. The boundary layer thickness has the value 7-4. Through use of the means for controlling boundary layer thickness constructed in accordance with this invention, the boundary layer thickness will be less than the values of 7-4 or, 7-8 as shown in FIG. 30. With use of the means for controlling boundary layer constructed in accordance with this invention, the boundary layer thickness should approximate that of curve 1-5 shown in FIG. 30. It will be noted that the above boundary layer thicknesses and respective flow velocities are assumed to exist at the design point of the blower system. The means for controlling boundary layer contemplated by this invention must function over the entire range of flow and pressure. Based upon information currently available, the maximum boundary layer thickness to be removed will have a value of 7-6 as shown in FIG. 30 while the average boundary layer thickness to be removed at the design point will be considerably less, e.g., the boundary layer thickness represented by the values 7-5 as shown in FIG. 30.

As previously indicated, the above information was based upon the boundary layer thickness occurring at the end of a flat plate or a corresponding circular duct. The means for controlling boundary layer as contemplated by the herein invention will remove the boundary layer likely at a single location near the end of the duct or diffuser. With the means for controlling boundary layer as described herein, the difference in operation and corresponding flow losses between a cylindrical duct, which has a constant pressure gradient in the case of no friction, and a diffuser with adverse pressure gradient is substantially changed. Through use of the means for controlling boundary layer as described herein, the diffuser can be substantially shorter, flow losses can be reduced and the diffuser angle is no longer limited to small values as shown in FIGS. 23 and 24. Diffusers having large diffuser angles may be used without stalling or losses. In addition, boundary layer removal can be made continuous along the diffuser wall as shown in FIG. 28.

The boundary layer thickness represented by 7-6 in FIG. 30 equals approximately ½ the boundary layer thickness represented by 7-8. The boundary layer thickness of 7-6 has been determined on the basis of the above theoretical considerations and certain tests. The total boundary layer flow to be removed can be determined as follows:

$$Q=\tfrac{1}{2}(\mu\pi D_M V_M) \quad (27)$$

in which $\mu$=boundary layer thickness according to formula (23) although formulas (24)-(26) could be used; this is the thickness of the boundary layer at the place where the boundary layer is removed with zero pressure gradient along the boundary layer; and $D_M$=mean diameter at the point where the boundary layer is removed;

$V_M$=mean velocity within the boundary layer at the place where the boundary layer is removed;

$V_M = 0.9$ K at location $s/\mu = 0.5$ and $F = 1.3$ as shown in FIG. 29.

The factor "½" in formula (27) considers the substantial change of using a continuous boundary layer removal system and going from a constant to an adverse pressure coefficient, as described above. Several calculations have indicated that the maximum amount of boundary layer flow to be removed from a diffuser with boundary layer control means equals about 2% of the flow of the blower at its design point for a blower - diffuser system.

There are two basic configurations used for the means to control boundary layer in accordance with this invention. For relatively large amounts of boundary layer flow that is removed and returned to the fluid flow path, a structure extending from hub to tip will be used. For relatively smaller amounts of return flow, a small entry nozzle at the hub, tip or both locations will be used.

Figure 31A:
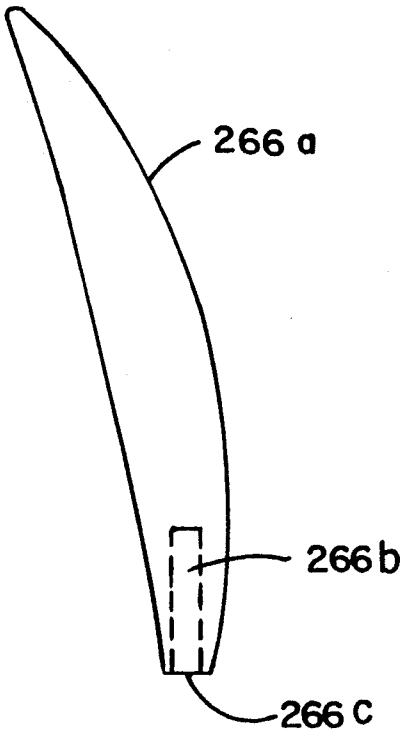
FIG. 31A shows a hollow aft blade which can be used in lieu of the aft blade shown in the guide vane arrangement of FIG. 31.
Figure 31:
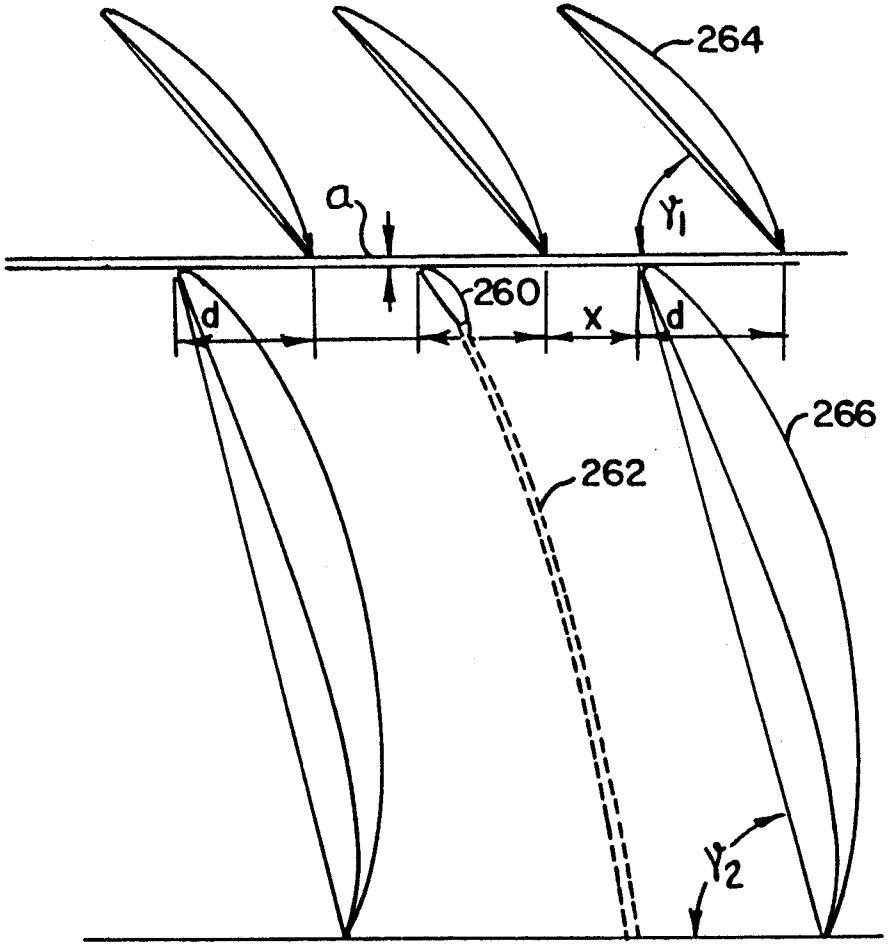
FIG. 31 shows a hollow air foil, mounted in a two row guide vane configuration, for discharging boundary layer flow into the fluid flow path.

FIG. 31 shows a hollow air foil 260 used to discharge back into the fluid flow path relatively large amounts of removed boundary layer flow. The hollow air foil 260 can be used as a single air foil or as a multitude of separate air foils located at the appropriate location within the blower.

The specific location of the hollow air foils 260 is a function of pressure differential required for boundary layer removal and the local static pressure within FIG. 31, the hollow air foil 260 is connected to a fluid flow passage 262 which conveys a boundary layer removed from a point downstream of the location of the hollow air foil 260 to the hollow air foil 260 for return to the fluid flow path.

In FIG. 31A is shown a hollow blade 266*a* which can be used in lieu of one or more of the blades 266 shown in FIG. 31. The blade 266*a* has a hollowed out portion 266*b* which extends from a point adjacent the hub to a point adjacent the tip of the blade. The opening 266*b* has an outlet 266*c*. It will be understood that when the blade 266*a* is used in the guide vane configuration shown in FIG. 31, the hollow portion 266*b* will be disposed in fluid communication with an appropriately located fluid passage (not shown). The blade 266*a* is used where relatively large amounts of boundary layer are to be removed and returned to the fluid flow path. In order to provide adequate space for the formation of the outlet opening 266*c*, it will be appreciated that an appropriate adjustment in the blade camber must be made. When blade 266*a* is used in the guide vane configuration shown in FIG. 31 in lieu of one or more blades 266, it will be understood that the boundary layer is returned to the fluid flow path adjacent the trailing edge of the aft blades. The boundary layer, upon being returned to the fluid flow path, passes through the outlet 266*c* in a downstream direction.

Figure 33:
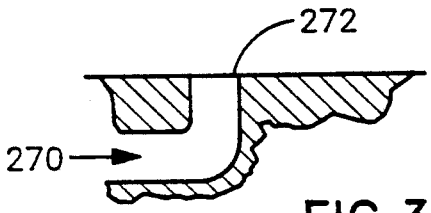
FIG. 33 is a partial view taken along line 33—33 of FIG. 32, showing a boundary layer control means suitable for use in the guide vanes shown in FIG. 32.
Figure 34:
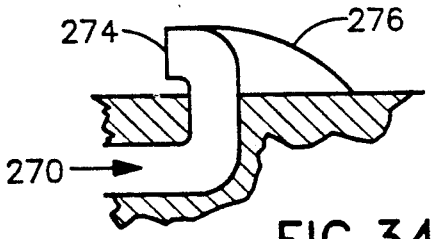
FIG. 34 shows a view similar to FIG. 33 of another embodiment of a boundary layer control means suitable for use in the guide vanes shown in FIG. 32.
Figure 32:
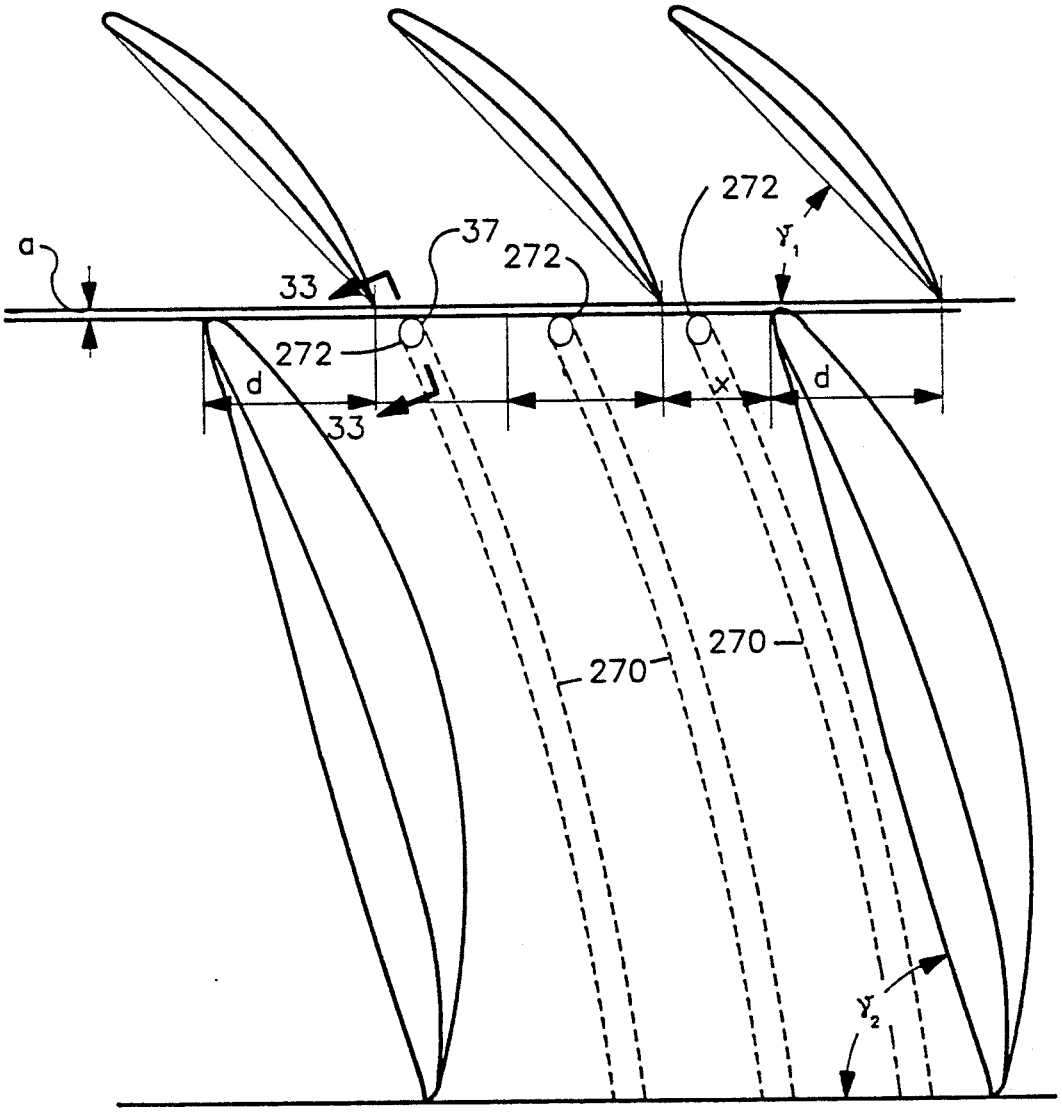
FIG. 32 shows a boundary layer return flow means constructed in accordance with the present invention.

For smaller amounts of boundary layer that is to be returned to the fluid flow path, the means for controlling boundary layer shown in FIGS. 32–34 may be used. FIG. 32 shows a plurality of fluid passages 270 each of which is connected to a corresponding circular opening 272 for returning the removed boundary layer to the boundary layer at a location upstream of the point where the boundary layer was originally removed.

Each of the openings 272 are preferably circular in cross-section in order to attenuate noise during operation of the blower. The use of openings 272 is to permit the return of the removed boundary layer back into the boundary layer itself.

Where it is desired or otherwise necessary to return the boundary layer to the mainstream of fluid flowing through the fluid flow path, an outlet 274, see FIG. 34, may be used in lieu of the outlet 272. It will be noted that the outlet 274 includes a stream lined member 276 to reduce noise and friction as the fluid flows past the outlet 274. The member 276 extends in an upstream direction away from the outlet 274. It will be understood that the outlets 272 and 274 may be located at the entrance, mean location or near the exit of a single row or two row guide vane system.

Figure 35:
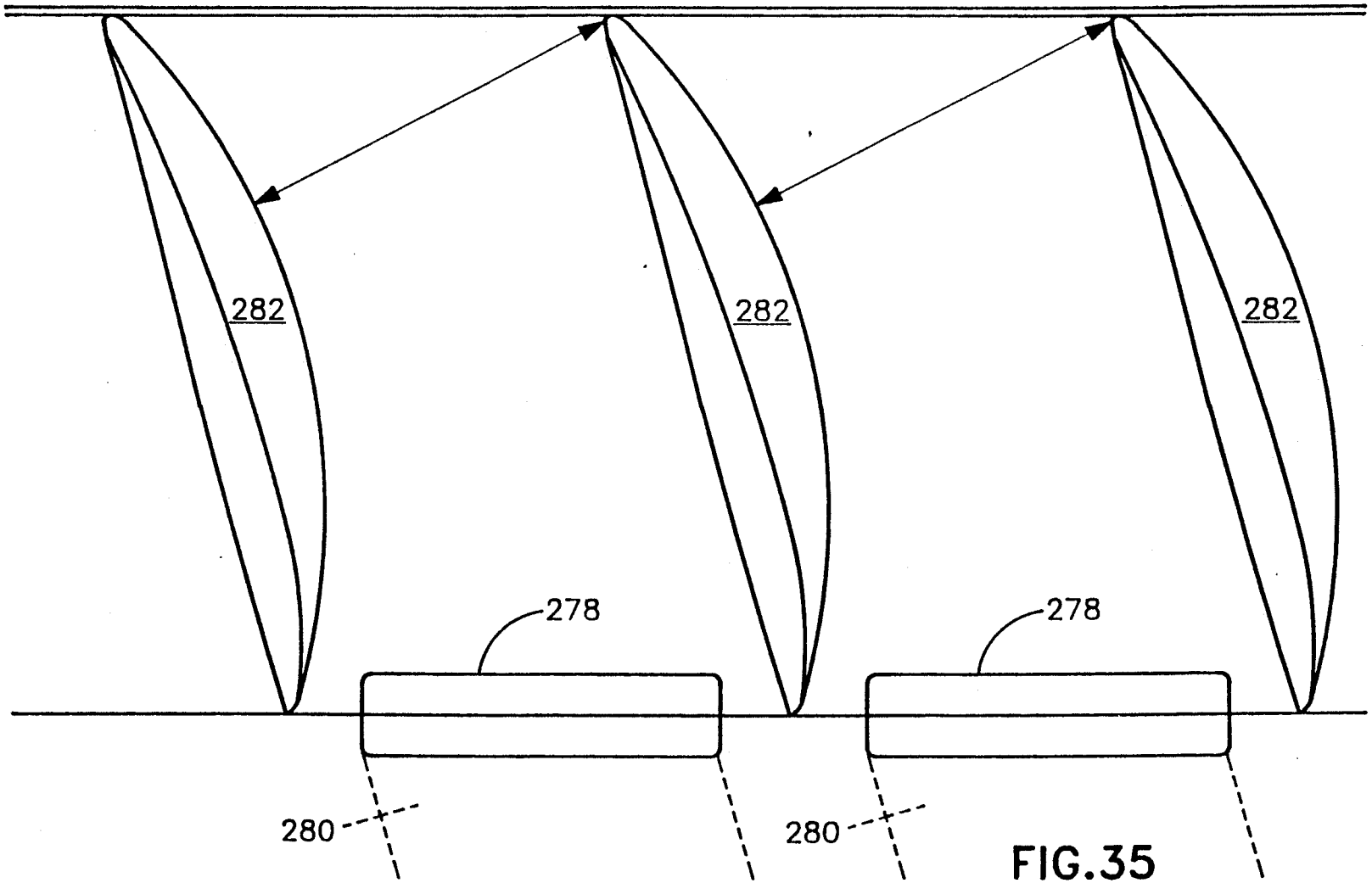
FIG. 35 shows another embodiment constructed in accordance with the present invention for returning boundary layer flow.

FIG. 35 shows the use of relatively large outlets 278 for the fluid passages 280. The outlets 278 may return the removed boundary layer at the exit of the guide vanes 282, as shown in FIG. 35; however, the outlets 278 may also be located near the inlet of the guide vanes 282 or in the middle location of the guide vanes 282.

It is important to select the correct location for the return of the boundary layer flow. The boundary layer flow is removed at a certain location. The pressure at the location is known. A pressure diagram, similar to that shown in FIG. 25B, will give an indication of the pressure existing at that location. The amount of boundary layer flow to be removed can be estimated from formula (27). The return location for the boundary layer flow can be selected from a pressure diagram similar to that shown in FIG. 25B. This will give the local pressure at the return location and the respective local velocity can be calculated from the impeller or guide vane configuration. The reduced pressure at the return location of the boundary layer flow compared to the pressure at boundary layer flow entrance can be used to return the flow and accelerate it to the velocity of the local flow at that specific location. Alternatively, if there exists a higher local velocity at the return location, it can be used as the driving energy of an ejector type pump to provide pumping action to return the boundary layer of flow into the main stream. Such ejector action can be used with a boundary layer flow discharge nozzle or outlet configuration similar to that shown in FIGS. 31 and 31A, and also with the configuration of the type shown in FIG. 34. In this manner, an appropriate location for the return flow for the removed boundary layer can be selected to have the complete system operate efficiently.

In light of the foregoing, it will now be evident that the herein invention relates to a method of removing a portion of the boundary layer formed on flow directing surfaces of a fluid flow path comprising the steps of forming a fluid flow path having flow directing surfaces, generating a flow of fluid through said flow path along said flow directing surfaces while simultaneously forming a boundary layer on said flow directing surfaces, forming a fluid flow passage, and removing a portion of the boundary layer from a first part of said boundary layer formed on at least one of said flow directing surfaces and returning said portion of said boundary layer to the fluid flow path located upstream of said first part. The herein invention also relates to the method as described above in which the step of removing a portion of said boundary layer includes effecting a thermal transfer of energy to said removed boundary layer portion before said removed boundary layer portion is returned to the fluid flow path at said second part. The herein invention also relates to the method as aforedescribed in which the step of removing a portion of the boundary layer includes returning said portion of said removed boundary layer to a second part of said flow path, said second part being located upstream of said first part, by simultaneously connecting said fluid passage in fluid communication with the first and second parts. The herein invention also relates to the method as aforedescribed in which the step of forming a fluid of passage includes forming said fluid passage outside of said fluid flow path.

It will also be noted that the herein invention relates to a method of producing fluid pressure at reduced noise levels. It has been found that with the use of impeller blades constructed in accordance with this invention, a much thinner boundary layer exists on the impeller blades. Since the boundary layer, being disclaimed from the impeller blades, impacts against the guide vanes, the greater amount of boundary layer there is, the greater amount of noise that is produced when the boundary layer impacts on the guide vanes. By reducing the thickness of the boundary layer through use of impeller blades constructed in accordance with this invention, there is a corresponding reduction in the amount of noise that is produced with the pump or blower of this invention. Thus, one of the methods of this invention relates to the producing of pressurized fluid at reduced noise levels comprising the steps of forming a fluid flow path, generating a flow of fluid through said fluid flow path, deflecting the flow of fluid as same flows through the fluid flow path while simultaneously maintaining the average relative velocity following said deflection approximately equal to the relative velocity prior to said deflection at least at one point in the fluid flow path, and generating pressure by turning back the flow of absolute fluid velocity by an amount approximately equal to the amount of absolute velocity deflection of the fluid while simultaneously decelerating the flow of fluid. In view of the foregoing, it will now be evident that the method of this invention for producing pressurized fluid also enables same to be done at reduced noise levels.

METHOD AND APPARATUS FOR PRODUCING FLUID PRESSURE AND CONTROLLING BOUNDARY LAYER

This invention also relates to a method and apparatus for producing pressurized fluid and controlling boundary layer. FIG. 1 shows an apparatus 50 constructed in accordance with this invention which uses essentially reactionless impellers 70 in combination with downstream guide vanes 60 to turn the direction of flow discharge from the impeller blades to the direction of entry of said flow into said impeller blades while the absolute flow through said guide vanes undergoes a substantial flow deceleration of at least approximately 0.66 or more at the hub location and the pressure coefficient for the blower or pump 50 is equal to at least 1.0 or more. The blower 50 also includes means for removing a portion of the boundary layer from a first predetermined part, at the inlet 75a to fluid passage 75, of one of said flow directing surfaces 74 located downstream of the impeller blades 70 and returning said removed boundary layer to the fluid flow path, through outlet **75*b*, at a second predetermined part of said flow directing surface 74 located upstream of said first predetermined part. As shown in FIG. 1, the means for removing a portion of the boundary layer from one of the flow directing surfaces 74 contained in the fluid flow path 76 includes a fluid passage 75 which extends generally in the direction of the flow of fluid through said fluid flow path, said fluid passage 75 having a first or inlet portion 75*a* disposed in fluid communication with a first predetermined part of said boundary layer and a second or outlet portion 75*b* disposed in fluid communication with the second predetermined part of said boundary layer. Preferably, the inlet 75*a* to and the outlet 75*b* from the fluid passage 75 is circular in cross-section in order to attenuate noise as fluid passes through the blower 50. The means 190 of FIG. 26, means 206 and 208 of FIG. 27 and means 228 and 230 of FIG. 28 may also be used in combination with the impeller blades and guide vanes as aforedescribed. The aforesaid boundary layer removal means may be varied or modified as disclosed and described in connection with FIGS. 31–35**.

Figure 20B:
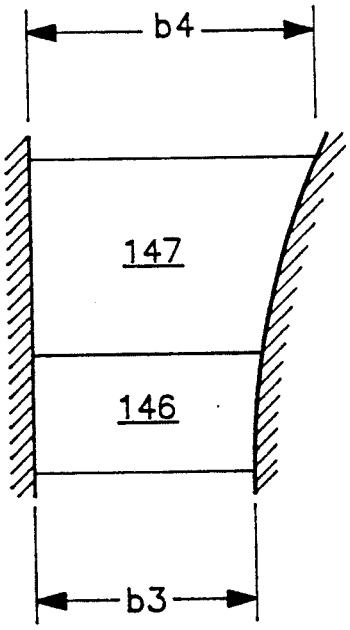
FIG. 20B is an enlarged view of the side walls of the centrifugal blower depicted in FIG. 20A.

An apparatus constructed in accordance with this invention may include inlet guide vanes such as guide vanes 72 shown in FIG. 1. The outlet guide vanes may comprise a plurality of single, solid blades, a two row guide vane configuration or a three row guide vane configuration all as shown and described in connection with FIGS. 1 and 10–13 and 15. Additionally, the blower or pump of this invention includes centrifugal blowers such as are shown in FIGS. 20–22.

The herein invention relates to a method of producing pressurized fluid comprising the steps of forming a fluid flow path, generating a flow of fluid through said fluid flow path, deflecting the flow of fluid as same flows through said fluid flow path while simultaneously maintaining the average relative velocity following said deflection approximately equal to the relative velocity prior to said deflection at least at one point in the fluid flow path, and generating pressure by turning back the flow of fluid by an amount approximately equal to the amount of deflection of the fluid while simultaneously decelerating the flow of fluid by maintaining the ratio of the axial through flow velocity through the fluid flow path to the outlet velocity before the generation of said pressure equal to approximately 0.66 or less. The herein method also relates to the method as aforedescribed in which the step of deflecting the flow of fluid is achieved substantially without generation of any pressure at least at one point in the fluid flow path.

The herein invention also relates to a method of producing pressurized fluid comprising the steps of forming a fluid flow path, generating the flow of fluid through said fluid flow path, deflecting the flow of fluid as same passes through said fluid flow path by approximately 50° or more while simultaneously maintaining the average relative velocity following said deflection approximately equal to or less than the relative velocity prior to said deflection at least at one point in the fluid flow path, and generating substantial pressure by turning back the flow of fluid by an amount greater than approximately 49° or more while simultaneously decelerating the flow of fluid by maintaining the ratio of the axial through flow velocity through the fluid flow path to the outlet velocity before the generation of said pressure equal to approximately 0.66 or less.

The herein invention also relates to a method of removing a portion of the boundary layer formed on flow directing surfaces, said method comprising the steps of forming a fluid flow path having flow directing surfaces, generating a flow of fluid through said flow path along said flow directing surfaces while simultaneously forming a boundary layer on said flow directing surfaces, forming a fluid flow passage, and removing a portion of the boundary layer from a first part of said boundary layer formed on at least one of said flow directing surfaces and returning said portion of said boundary layer to said fluid flow path at a location upstream of said first part by simultaneously connecting said fluid flow passage in fluid communication with said first part and said upstream location. The herein invention also relates to the method as aforedescribed in which the step of returning said portion of said boundary layer includes effecting a thermal transfer of energy with said removed boundary layer before said boundary layer is returned to the fluid flow path at said upstream location. The herein invention also relates to the method as aforedescribed in which the step for forming a fluid passage includes forming said fluid passage outside the said fluid flow path. The herein invention also relates to a method as aforedescribed in which the step for forming a fluid passage includes forming at least two fluid passages outside of said fluid flow path, and the step for removing a portion of the boundary layer includes removing portions of said boundary layer from at least two first parts of said boundary layer formed on at least one of said flow directing surfaces and returning each of said portions of said boundary layer to a respective one of at least two points located upstream of said two first parts by simultaneously connecting each of said fluid passages in fluid communication with the respective one of said first parts and said points.

The herein invention also relates to a method of controlling boundary layer formed on a flow directing surface, said method comprising the steps of forming a fluid flow path having flow directing surfaces, generating a flow of fluid through said fluid flow path and along said flow directing surfaces while simultaneously forming a boundary layer on said flow directing surfaces, forming a fluid flow passage, and controlling the boundary layer thickness on at least one of said flow directing surfaces by removing a portion of said boundary layer from a plurality of first parts of said boundary layer formed on said flow directing surface and returning each of said portions of said boundary layer to said fluid flow path at a respective one of a plurality of parts located upstream of said first parts by simultaneously connecting said fluid passage in fluid communication with said first parts and said points.

The herein invention also relates to a method of removing a portion of the boundary layer formed on flow directing surfaces, said method comprising the steps of forming a fluid flow path having spaced apart flow directing surfaces, forming a first fluid passage in one of said spaced apart flow directing surfaces outside the said fluid flow path, forming a second fluid passage in the other said spaced apart flow directing surface outside the said fluid flow path, generating a flow of fluid through said fluid flow path along said flow directing surfaces, removing portions of the boundary layer from a plurality of first parts of said boundary layer formed on one of said flow directing surfaces and returning each of said portions of said boundary layer to a respective one of a plurality of points located upstream of said first parts by connecting said first fluid flow passage in fluid communication with said first parts and said points, and removing portions of the boundary layer from a plurality of first parts of the other flow directing surface and returning each of said portions as said boundary layer to a respective one of a plurality of points located upstream of said first parts of the other flow directing surface by connecting said second fluid passage in fluid communication with the respective one of said first parts and said points.

The herein invention also relates to a method of producing pressurized fluid at reduced noise levels comprising the steps of forming a fluid flow path, generating a flow of fluid through said fluid flow path, deflecting the flow of fluid as same flows through the fluid flow path while simultaneously maintaining the average relative velocity following said deflection approximately equal to the relative velocity prior to said deflection at least at one point in the fluid flow path, and generating pressure by turning back the flow of absolute fluid velocity by an amount approximately equal to the amount of absolute velocity deflection of the fluid while simultaneously decelerating the flow of fluid.

The herein invention also relates to a method of producing pressurized fluid at reduced noise levels comprising the steps of forming a fluid flow path having flow directing surfaces, generating a flow of fluid through said fluid flow path along said flow directing surfaces while simultaneously forming a boundary layer on said flow directing surfaces, deflecting the flow of fluid as same flows through the fluid flow path while simultaneously maintaining the average relative velocity following said deflection approximately equal to the relative velocity prior to said deflection at least at one point in the fluid flow path, generating pressure by turning back the flow of absolute fluid velocity by an amount approximately equal to the amount of absolute velocity and deflection of the flow while simultaneously decelerating the flow of fluid, forming a fluid flow passage, and removing a portion of the boundary layer from a first part of said boundary layer formed on at least one of said flow directing surfaces and returning said portion of said boundary layer to said fluid flow path at a location upstream of said first part by simultaneously connecting said fluid passage in fluid communication with said first part and said upstream location.

The herein invention also relates to a method of producing pressurized fluid comprising the steps of forming a fluid flow path having flow directing surfaces, generating a flow of fluid through said flow path along said flow directing surfaces while simultaneously forming a boundary layer on said flow directing surfaces, deflecting the flow of fluid as same flows through said fluid flow path while simultaneously maintaining the average relative velocity following said deflection approximately equal to the relative velocity prior to said deflection, generating pressure by turning back the flow of fluid by an amount approximately equal to the amount of deflection of the fluid while simultaneously decelerating the flow of fluid by maintaining the ratio of the axial through flow velocity through the fluid flow path to the outlet velocity following the generation of said pressure equal to approximately 0.66 or less, forming a fluid flow passage located outside of said fluid flow path and removing a portion of the boundary layer from a first part of said boundary layer formed on at least one of said flow directing surfaces and returning said portion of said boundary layer to the fluid flow path upstream of first part by simultaneously connecting said fluid passage in fluid communication with said first part and the fluid flow path located upstream of said first part.

The invention described herein may be applied to apparatuses of the turbomachine type including blowers, compressors, pumps, turbines, fluid motors and the like. Additionally, it may be applied to turbomachines utilizing inlet guide vanes.

The specific embodiments of methods and apparatuses which have shown and described are to be understood to be illustrative only. Variations and modifications may be made without departing from the scope of the novel concepts of this invention.

What is claimed is:

1. In the blower of the centrifugal turbomachine type,
a. a stationary annular member.
b. an impeller positioned for rotation in said stationary annular member and being radially spaced therefrom by an annular fluid path which has a fluid inlet end and a fluid outlet end of larger diameter and which has a curved flow channel of progressively increasing area which extends from said fluid inlet end to said fluid outlet end,
c. a series of impeller blade rows located in said fluid flow path and being connected to said impeller and a series of guide vane rows located in said flow path and being connected to said annular stationary member, said guide vane rows being alternated with said impeller blade rows along said flow path, each of said impeller blade rows in conjunction with an adjacent one of said guide vane rows constituting one of a series of pressure generation stages in said curved portion of said flow path,
(1) each of said impeller blades having an impeller portion, an outer blade portion, a rounded leading edge and a relatively sharp trailing edge, and a combination of camber and solidity wherein, during operation of said impeller blades at the design point,
(a) the average outlet relative velocity is equal to or greater than 0.6 times the inlet relative velocity at the hub of the impeller portion of said blades, and
(b) the angle of flow deflection within the impeller blades is at least equal to approximately 50° or more,
(2) each of said guide vane rows including at least a forward row of blades and an aft row of blades,
(a) the chord of each of the blades in the aft row being greater than the chord of each of the blades in the forward row,
(b) each blade in the aft row cooperating with the corresponding blade in the forward row to form, during operation of the blower, multiple rows of blades,
(1) the trailing edge of the forward blades and the leading edge of aft blades is separated by an axial distance, the axial distance between the trailing edge of the forward blades and the leading edge of the aft blades is equal to or less than the absolute value of approximately 0.12 times the chord of the aft blade of the multiple rows of blades for each pair of blade rows,
(2) the leading edge of each aft blade and the trailing edge of the forward blade nearest the upper surface of said aft blade is separated by circumferential distance, the circumferential distance between the leading edge of each aft blade and the trailing edge of the forward blade nearest the upper surface of said aft blade is equal to or less than 0.33 times the pitch of the aft blades for each pair of blade rows,
(3) each row of blades of said guide vane rows having a combination of chamber and blade solidity wherein, during operation of the blower, the direction of discharge from said impeller blades is turned by said guide vane rows back to the direction of the entry of said row into said impeller blades, the deflection of flow being greater than approximately 49°, and
d. the pressure coefficient for each of said centrifugal blower stages is greater than approximately 1.1.

2. In a blower or pump as described in claim 1 in which
a. each of the blades in the forward row have a blade solidity equal to approximately $1.3 \pm 0.6$,
b. each of the blades in the aft row has a blade solidity equal to approximately $1.1 \pm 0.6$, and
c. the ratio of the guide vane exit fluid velocity to the guide vane inlet fluid velocity is equal to approximately 0.28 or more.

3. In a blower of a centrifugal turbomachine type as described in claim 1,
a. the absolute blade exit velocity of the impeller blades at the outlet is greater than the circumferential velocity and the inlet relative velocity, and
b. the flow vector of the circumferential component of the relative velocity of said impeller blades at the inlet is in a direction opposite to the direction of circumferential velocity and the flow vector of the circumferential component of the relative velocity of said impeller blades at the outlet is in the same direction as the circumferential impeller velocity.

4. In a blower of the centrifugal type as described in claim 1 in which
a. the aft row blades of said guide vane rows includes a plurality of part blades,
(1) each part blade having a chord equal to approximately one-half times the chord of the aft blade,
(2) each part blade having a trailing edge thereof located on the same line as the trailing edge of the aft blades of said guide vane rows,
(3) each part blade being disposed intermediate adjacent aft blades to form two flow channels between said adjacent aft blades, each flow channel having equal amounts of flow and approximately equal rates of flow deceleration therethrough, and
(4) each part blade having solidity equal to approximately $1.1 \pm 0.6$.

5. In a blower of the centrifugal turbomachine type as described in claim 1 in which
a. each of the blades in the forward row of said guide vane rows includes means for adjusting pressure and flow velocity through the impeller blades during the operation of the blower at a predetermined speed of operation,
(1) said means including means for mounting each of the forward blades for pivotal movement about a point located closely adjacent the trailing edge of each blade in said forward row, and
(2) said means including means for pivoting each forward blade about said point thereby changing the angle of attack of each blade of the forward row.

* * * * *